US012546177B2

(12) United States Patent
Moyes

(10) Patent No.: US 12,546,177 B2
(45) Date of Patent: Feb. 10, 2026

(54) RECIPROCATING DRIVE APPARATUS

(71) Applicant: Rotojar Innovations Limited, Abderdeen (GB)

(72) Inventor: Peter Barnes Moyes, Aberdeen (GB)

(73) Assignee: Rotojar Innovations Limited, Aberdeen (GB)

( * ) Notice: Subject to any disclaimer, the term of this patent is extended or adjusted under 35 U.S.C. 154(b) by 266 days.

(21) Appl. No.: 18/257,690

(22) PCT Filed: Dec. 16, 2021

(86) PCT No.: PCT/EP2021/086332
§ 371 (c)(1),
(2) Date: Jun. 15, 2023

(87) PCT Pub. No.: WO2022/129429
PCT Pub. Date: Jun. 23, 2022

(65) Prior Publication Data

US 2023/0374859 A1 Nov. 23, 2023

(30) Foreign Application Priority Data

Dec. 16, 2020 (GB) ..... 2019918
May 13, 2021 (GB) ..... 2106870

(51) Int. Cl.
*E21B 31/113* (2006.01)
*E21B 4/14* (2006.01)

(52) U.S. Cl.
CPC ..... *E21B 31/113* (2013.01); *E21B 4/14* (2013.01)

(58) Field of Classification Search
CPC ..... E21B 31/113; E21B 4/14
See application file for complete search history.

(56) References Cited

U.S. PATENT DOCUMENTS 3,307,636 A 3/1967 Le Blanc
3,412,806 A 11/1968 Fredd et al.
(Continued)

FOREIGN PATENT DOCUMENTS

CN 108131100 A 6/2018
EP 3553272 A1 10/2019
(Continued)

OTHER PUBLICATIONS

United Kingdom Search Report for Application No. 2106868.9 on Jan. 25, 2022.
(Continued)

*Primary Examiner* — Michelle Lopez
(74) *Attorney, Agent, or Firm* — Harness, Dickey & Pierce, P.L.C.

(57) ABSTRACT

A reciprocating drive apparatus (10) comprises a housing (12) and a mandrel (14), wherein the mandrel (14) and the housing (12) are configurable to be rotated relative to each other. The apparatus (10) further comprises a reciprocating piston (16) mounted within a piston housing (18) to define a piston chamber (20*a*), wherein the piston (16) is moveable in reverse first and second axial directions (A,B), and a rotary valve assembly (24) comprising a valve inlet (28) for communicating with a pressure region (P) and a valve exhaust (30) for communicating with an exhaust region (E). The rotary valve assembly (24) is operated by relative rotation between the mandrel (14) and the housing (12) to be cyclically reconfigured between a pressure configuration and an exhaust configuration. When in the pressure configuration the piston chamber (20*a*) is in pressure communication with the valve inlet (28) and isolated from the valve exhaust (30) to permit the piston to move in the first axial direction (A) in accordance with the piston chamber being pressurised via the valve inlet (28). When in the exhaust
(Continued)

configuration the piston chamber (20*a*) is isolated from the valve inlet (28) and in pressure communication with the valve exhaust (30) to permit the piston chamber to be depressurised and the piston (16) to move in the second axial direction (B). Movement of the piston (16) in at least one of the first and second axial directions (A,B) generates an applied force within the apparatus (10) and/or an applied force output from the apparatus (10).

26 Claims, 23 Drawing Sheets

(56) References Cited

U.S. PATENT DOCUMENTS

| | | | | |
|---|---|---|---|---|
| 4,114,701 | A | 9/1978 | Bouplon | |
| 4,566,546 | A * | 1/1986 | Evans | E21B 31/113 166/178 |
| 4,903,775 | A | 2/1990 | Manke | |
| 5,680,904 | A * | 10/1997 | Patterson | E21B 4/14 173/112 |
| 2002/0014354 | A1 * | 2/2002 | Patterson | E21B 4/14 173/78 |
| 2005/0230101 | A1 | 10/2005 | Zheng et al. | |
| 2010/0276204 | A1 | 11/2010 | Connell et al. | |
| 2011/0297380 | A1 | 12/2011 | Alberty et al. | |
| 2017/0234073 | A1 | 8/2017 | Nguyen | |
| 2018/0163479 | A1 | 6/2018 | Kutinsky | |
| 2018/0187491 | A1 | 7/2018 | Brand | |
| 2019/0153797 | A1 | 5/2019 | von Gynz-Rekowski et al. | |
| 2020/0080379 | A1 | 3/2020 | Liao et al. | |
| 2020/0240227 | A1 | 7/2020 | Kinsella et al. | |

FOREIGN PATENT DOCUMENTS

| | | |
|---|---|---|
| GB | 2487485 A | 7/2012 |
| GB | 2555561 A | 5/2018 |
| GB | 2570364 A | 7/2019 |

OTHER PUBLICATIONS

International Search Report and Written Opinion of the International Searching Authority for International Application No. PCT/EP2021/086332 dated Mar. 22, 2022.

United Kingdom Search Report for Great Britain Application No. 2106870.5 dated Feb. 28, 2022.

United Kingdom Search Report for Great Britain Application No. 2019918.8 dated Sep. 9, 2021.

International Preliminary Report on Patentability, dated Jun. 26, 2023, issued in corresponding International Patent Application No. PCT/EP2021/086332.

Office action dated Sep. 30, 2024, issued in corresponding U.S. Appl. No. 18/257,687.

Office Action for Saudi Arabia Application No. 523441169 dated Dec. 12, 2024.

* cited by examiner

RECIPROCATING DRIVE APPARATUS

CROSS-REFERENCE TO RELATED APPLICATIONS

This application is a national phase under 35 U.S.C. § 371 of PCT International Application No. PCT/EP2021/086332 which has an International filing date of Dec. 16, 2021, which claims priority to United Kingdom Application No. 2019918.8, filed Dec. 16, 2020, and United Kingdom Application No. 2106870.5, filed May 13, 2021, the entire contents of each of which are hereby incorporated by reference.

FIELD

The present disclosure relates to a reciprocating drive apparatus, a tool comprising the apparatus, and to a method for generating applied forces using the apparatus.

BACKGROUND

Many industries require the application of forces to support certain operations. Such applied forces may for example comprise or take the form of linear or axial forces and/or applied torque or rotational forces.

In the oil and gas exploration and production industry, for example, jarring apparatus might be used downhole to apply jarring to a stuck object, such as a stuck tool, drill bit, drill string, bottom hole assembly (BHA) and the like. Further, it might be desirable to apply jarring forces during the process of drilling, for example to apply a hammer drilling effect, and/or be available in the event of a drill bit or string becoming stuck. Jarring may also be necessary when pulling equipment, tools and infrastructure from a wellbore, for example in the process of removing casing from a well, and/or when running equipment into a wellbore, for example in the process of running lower completions, and the like. Other jarring applications may include piling, for example.

Generally, a jarring apparatus is a device used to deliver an impact load to another component such as a bottom hole assembly (BHA). Known jarring apparatus operate by storing energy, such as in a drilling string, for example by applying tension within the string, and suddenly releasing this energy to cause two impact surfaces to move axially and strike each other, creating an impact or jarring force.

Jarring apparatus are known which operate in response to a linear activation input, and are thus typically known as linear jarring apparatus.

Proposals have also been made concerning jarring apparatus which can provide a linear jar in response to a rotational drive input, such as from a drill string. In some proposals "rotary jarring" is provided by interaction of opposing rotary cams each having inter-engaging ramp profiles which gradually increase in a rotational direction until reaching a peak. During relative rotation of the cams the ramped surfaces interact to achieve relative axial displacement, and once the opposing cams peak they effectively drop-off and impact together, thus generating a jarring force.

While such rotary jarring can in some instances provide benefits over linear jarring concepts, some problems may arise. For example, the nature of the cam surfaces is such that as the cams approach their peak displacement the contact surface area reduces which can generate very significant stresses within the cams, theoretically tending to infinity at the drop-off point. Further, the cams themselves are subject to direct impact contact therebetween. As such, the cams may be subject to failure.

Other examples of applied forces include axial and/or rotational forces which, when applied to a connected component, assembly or tool provide an impact, actuation and/or motive force.

SUMMARY

Aspects of the present disclosure relate to a reciprocating drive apparatus, a tool comprising the apparatus, and to a method for generating applied forces.

A first aspect of the present disclosure relates to a reciprocating drive apparatus, comprising:

- a housing;
- a mandrel, wherein the mandrel and the housing are configurable to be rotated relative to each other;
- a reciprocating piston mounted within a piston housing to define a piston chamber, wherein the piston is moveable in reverse first and second axial directions; and
- a rotary valve assembly comprising a valve inlet for communicating with a pressure region and a valve exhaust for communicating with an exhaust region, the rotary valve assembly being operated by relative rotation between the mandrel and the housing to be cyclically reconfigured between:
  - a pressure configuration in which the piston chamber is in pressure communication with the valve inlet and isolated from the valve exhaust to permit the piston to move in the first axial direction in accordance with the piston chamber being pressurised via the valve inlet; and
  - an exhaust configuration in which the piston chamber is isolated from the valve inlet and in pressure communication with the valve exhaust to permit the piston chamber to be depressurised and the piston to move in the second axial direction,
- wherein movement of the piston in at least one of the first and second axial directions generates an applied force within the apparatus and/or an applied force output from the apparatus.

In use, movement of the piston in at least one of the first and second axial directions generates an applied force within the apparatus (for example to provide one or more jarring or impact forces within the apparatus) and/or an applied force output from apparatus, for example for transmission to a connected component, assembly or tool so as to provide an impact, actuation and/or motive force to said connected component, assembly or tool.

Where the apparatus is configured to generate an applied force output from the apparatus, the apparatus may comprise an output shaft or similar for transmission of said applied force output.

Beneficially, the apparatus may define a reciprocating engine for use in generating applied forces within the apparatus itself or an applied force output for transmission to a connected component, assembly or tool and may be utilised in a wide variety of applications. In particular, but not exclusively, the apparatus may be configured for use in downhole applications. In this respect, the apparatus may be defined as a downhole reciprocating drive apparatus.

The apparatus may be configured to transmit torque and axial forces to the connected component, assembly or tool. For example, the apparatus may comprise a connection with the connected component, assembly or tool, the connection configured to transmit applied axial forces generated by the apparatus to the connected component, assembly or tool and to transmit rotational movement and/or torque to the connected component, assembly or tool. The apparatus may comprise two connections with the connected component, assembly or tool, one connection configured to transmit applied axial forces generated by the apparatus to the connected component, assembly or tool and one connection configured to transmit rotational movement and/or torque to the connected component, assembly or tool.

Where, for example the connected component, assembly or tool is coupled to one connection, e.g. the output shaft, only, the apparatus may permit unconstrained or singular movement of the connected component, assembly or tool. Alternatively, where the connected component, assembly or tool is coupled to both connections, movement of the connected component, assembly or tool may be geared to be relative to a constrained component.

Alternatively, the apparatus may be configured to transmit axial forces only to said connected component, assembly or tool.

In particular configurations, the apparatus may comprise or take the form of a jarring apparatus. The piston may comprise or take the form of a jarring piston.

In this respect, the present disclosure may relate to a jarring apparatus, comprising:

a housing;

a mandrel, wherein the mandrel and the housing are configurable to be rotated relative to each other;

a jarring piston mounted within a piston housing to define a piston chamber, wherein the jarring piston is moveable in reverse first and second axial directions; and a rotary valve assembly comprising a valve inlet for communicating with a pressure region and a valve exhaust for communicating with an exhaust region, the rotary valve assembly being operated by relative rotation between the mandrel and the housing to be cyclically reconfigured between:

a pressure configuration in which the piston chamber is in pressure communication with the valve inlet and isolated from the valve exhaust to permit the jarring piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the jarring piston to move in the second axial direction, wherein movement of the jarring piston in at least one of the first and second axial directions generates a jarring force within the apparatus.

Alternatively, the apparatus may comprise or take the form of a hammer apparatus.

In this respect, the present disclosure may relate to a hammer apparatus, comprising:

a housing;

a mandrel, wherein the mandrel and the housing are configurable to be rotated relative to each other;

a reciprocating piston mounted within a piston housing to define a piston chamber, wherein the piston is moveable in reverse first and second axial directions; and a rotary valve assembly comprising a valve inlet for communicating with a pressure region and a valve exhaust for communicating with an exhaust region, the rotary valve assembly being operated by relative rotation between the mandrel and the housing to be cyclically reconfigured between:

a pressure configuration in which the piston chamber is in pressure communication with the valve inlet and isolated from the valve exhaust to permit the piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the piston to move in the second axial direction, wherein movement of the piston in at least one of the first and second axial directions generates an applied axial force output from the apparatus, said applied axial force output forming an impact force for transmission to a connected component, assembly or tool.

The hammer apparatus may be configured to generate an applied axial force output for transmission to a connected component, assembly or tool so as to provide an impact force to said connected component, assembly or tool.

Alternatively, the apparatus may comprise or take the form of a reciprocator apparatus.

In this respect, the present disclosure may relate to a reciprocator apparatus, comprising:

a housing;

a mandrel, wherein the mandrel and the housing are configurable to be rotated relative to each other;

a reciprocating piston mounted within a piston housing to define a piston chamber, wherein the piston is moveable in reverse first and second axial directions; and a rotary valve assembly comprising a valve inlet for communicating with a pressure region and a valve exhaust for communicating with an exhaust region, the rotary valve assembly being operated by relative rotation between the mandrel and the housing to be cyclically reconfigured between:

a pressure configuration in which the piston chamber is in pressure communication with the valve inlet and isolated from the valve exhaust to permit the piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the piston to move in the second axial direction, wherein movement of the piston in at least one of the first and second axial directions generates an applied axial force output from the apparatus, said applied axial force output forming an actuation and/or motive force for transmission to a connected component, assembly or tool.

The reciprocator apparatus may be configured to generate an applied axial force output for transmission to a connected component, assembly or tool so as to provide an actuation and/or motive force to said connected component, assembly or tool.

In use, continued or sustained relative rotation between the housing and the mandrel operates the rotary valve assembly to cause the piston chamber to be cyclically pressurised and depressurised to permit reciprocating movement of the piston to generated repeated forces.

Where, for example, the apparatus comprises or takes the form of a jarring apparatus, continued or sustained relative rotation between the housing and the mandrel operates the rotary valve assembly to cause the piston chamber to be cyclically pressurised and depressurised to permit reciprocating movement of the jarring piston to generate repeated jarring forces within the apparatus.

Where, for example, the apparatus comprises or takes the form of a hammer apparatus, continued or sustained relative rotation between the housing and the mandrel operates the rotary valve assembly to cause the piston chamber to be cyclically pressurised and depressurised to permit reciprocating movement of the piston to generate repeated impact forces for transmission to the connected component, assembly or tool.

Where, for example, the apparatus comprises or takes the form of a reciprocator apparatus, continued or sustained relative rotation between the housing and the mandrel operates the rotary valve assembly to cause the piston chamber to be cyclically pressurised and depressurised to permit reciprocating movement of the reciprocating piston to generate repeated motive forces for transmission to the connected component, assembly or tool.

As forces are generated by relative rotation between the mandrel and the housing, the apparatus may be defined as a rotary reciprocating drive apparatus. In this case, the frequency of generated forces will be a function of the relative rotational speed between the mandrel and the housing, which may be infinitely variable to thus provide infinite variability of the frequency of the forces generated by the apparatus, providing significant advantages.

Where, for example, the apparatus comprises or takes the form of a jarring apparatus, as jarring forces are generated by relative rotation between the mandrel and the housing, the jarring apparatus may be defined as a rotary jarring apparatus. In this case, the frequency of generated jarring forces will be a function of the relative rotational speed between the mandrel and the housing, which may be infinitely variable to thus provide infinite variability of the jarring frequency, providing significant advantages.

Furthermore, as forces are generated as a result of fluid pressure, the apparatus may be defined as a fluid actuated reciprocating drive apparatus, for example a hydraulically actuated apparatus. The apparatus may define a fluid actuated switching device or mode selector.

By using fluid pressure the magnitude of forces may be readily varied, at least in some implementations, by varying fluid pressure. In downhole applications, for example, the apparatus may be particularly beneficial in extended reach, high angle or horizontal wellbores which can present significant challenges to conventional tools and equipment due to the restrictions on the ability to apply force and/or weight in the horizontal section of the bore.

Where, for example, the apparatus comprises or takes the form of a jarring apparatus as jarring forces are generated as a result of fluid pressure, the jarring apparatus may be defined as a fluid actuated jarring apparatus, for example a hydraulically actuated jarring apparatus. This may provide an alternative solution to jarring apparatus in which a jarring mass (e.g., hammer) is displaced using a mechanical system, such as a cam system which may need to accommodate significant loading and wear tolerance and thus may present difficult design challenges. Further, by using fluid pressure the magnitude of jarring forces may be readily varied, at least in some implementations, by varying fluid pressure without necessarily requiring the same considerations around the force limitations of mechanical displacement systems. In downhole applications, for example, the apparatus may be particularly beneficial in extended reach, high angle or horizontal wellbores which can present significant challenges to conventional tools and equipment due to the restrictions on the ability to apply force and/or weight in the horizontal section of the bore.

In use, the apparatus may be used in combination with the pressure and exhaust regions such that a pressure differential is applied across the rotary valve assembly. In this respect the pressure and exhaust regions may be considered to be separate and distinct pressure regions such that a pressure differential therebetween may be utilised. Specifically, the pressure within the pressure region may be elevated above the pressure in the exhaust region. In particular, the pressure within the pressure region may be sufficient (for example sufficiently high) to pressurise the piston chamber to permit the piston to move in the first axial direction, and the pressure within the exhaust region may be sufficient (for example sufficiently low) to permit the piston chamber to be depressurised and the piston to move in the second axial direction.

The apparatus may be configured to operate irrespective of the direction of the pressure differential applied across the rotary valve assembly. As an example, in one mode of operation, suggested above, the pressure of the pressure region may be higher than the pressure of the exhaust region. However, should the pressure differential be reversed then what was previously the pressure region becomes the exhaust region, and vice versa, and what was previously the valve inlet becomes the valve exhaust, and vice versa. In this respect, it should be recognised that the valve inlet and the pressure region, and valve exhaust and exhaust region, may be defined as such in accordance with the direction of an applied pressure differential applied across the rotary valve assembly. With this in mind, although features will be defined herein as relating to the valve inlet and valve exhaust (and pressure and exhaust regions), this is done so for clarity and brevity purposes and it should be understood that the function and thus identity of the valve inlet and valve exhaust (and pressure and exhaust regions) could switch depending on the operational conditions. While the identity of the valve inlet and valve exhaust (and pressure and exhaust regions) may be changeable, the valve assembly will still have separate and distinct valve inlet and exhaust to facilitate the disclosed mode of operation.

This ability for the apparatus to operate irrespective of the direction of the pressure differential applied across the rotary valve assembly may be possible without requiring an operator to undertake any modification to the apparatus, for example modifications in-situ or by recovery and re-deploying, which may be complex and time consuming.

The ability for the apparatus to be employed irrespective of the direction of the pressure differential applied across the rotary valve assembly may provide significant advantages. For example, this arrangement could provide contingency in the event that the ability to establish a pressure differential in one direction becomes compromised, for example where one of the first and second regions suffers some kind of failure preventing pressure to be elevated therein to the required level. Further, the flexibility of the apparatus to function irrespective of the direction of the pressure differential may provide advantages in allowing the same apparatus to be used in multiple different applications where a particular pressure differential direction is preferred.

As described above, movement of the piston in at least one of the first and second axial directions generates an applied force within the apparatus and/or an applied force output from the apparatus. In some examples, forces may be generated by movement of the piston in both the first and second axial directions. Where, for example, the apparatus comprises or takes the form of a jarring apparatus, jarring forces may be generated within the jarring apparatus by movement of the jarring piston in both the first and second axial directions. In other examples, movement of the piston in one of the first and second axial directions generates the applied force. In such examples, the apparatus may be configured to generate forces in one of said axial directions and may dampen or otherwise control transmission of forces in the other of said axial directions.

Where, for example, the apparatus comprises or takes the form of a jarring apparatus, movement of the jarring piston in one of the first and second axial directions generates a jarring force within the apparatus. In such examples, the jarring apparatus may be configured to generate jarring forces in one of said axial directions and may dampen or otherwise control transmission of forces in the other of said axial directions.

The ability to generate forces, such as jarring forces, in one of said axial directions and dampen or otherwise control transmission of forces in the other of said axial directions may beneficially facilitate the preferential transmission of the forces, such as jarring forces, for example but not exclusively to a selected region or tool and/or protect other selected regions or tools.

The apparatus may comprise an axial throughbore.

The apparatus may be configurable in a first, open, configuration which permits access, e.g. full bore or substantially full bore access, through the axial throughbore of the apparatus. The apparatus may be configurable in a second, obturated, configuration in which access through the apparatus is restricted or blocked.

The apparatus may be reconfigurable between the first and second configurations, that is from the first configuration to the second configuration and vice-versa.

In the first, open, configuration, the apparatus may beneficially facilitate full flow and/or passage of tools through the apparatus. Thus, in circumstances where an applied force, e.g. jarring force, actuation force etc. is not required the apparatus does not impinge on the passage of the fluid and/or tools through the apparatus.

The second, obturated, configuration may provide an elevated pressure within the apparatus which may be utilised by the apparatus. For example, where the second, obturated, configuration forms a partial restriction through the axial throughbore the restriction may generate a back pressure for use in operation of the apparatus.

Alternatively, where the second, obturated, configuration prevents or substantially prevents access through the axial throughbore, an elevated pressure region may be created within the apparatus upstream of the blockage, for use in operation of the apparatus.

Relative axial movement of the mandrel and the housing may be utilised to align lateral flow passages, e.g. ports, and bring the apparatus into an operational mode, as will be described further below. Where, for example, the apparatus comprises or takes the form of a jarring apparatus, relative axial movement of the mandrel and the housing may be utilised to align lateral flow passages, e.g. ports, and bring the jarring apparatus into jarring mode.

As described above, the apparatus comprises a housing and a mandrel mounted within the housing, the mandrel and the housing being configurable to be rotated relative to each other.

It will be understood that reference to relative rotation between the housing and the mandrel may include the apparatus being configured such that: the mandrel rotates while the housing is stationary; such that the housing rotates while the mandrel is stationary; or such that the mandrel and the housing both rotate.

Beneficially, this facilitates flexibility in that operations may be carried out in a number of different operational scenarios.

It will be understood that while the terms "housing" and "mandrel" have been used herein for convenience, these components may alternatively be referred to as a first structure or first body portion and a second structure or second body portion of the apparatus, the first structure or body portion and the second structure or body portion being rotatable relative to each other. In this respect the term "housing" is not intended to be limiting in terms of a component which houses another component (e.g., the second structure/body or mandrel), and similarly the term "mandrel" is not intended to be limiting in terms of a component about which another component (e.g., the first structure/body or housing) is mounted.

In this respect, the present disclosure may relate to a reciprocating drive apparatus, comprising:

- a first structure or body portion;
- a second structure or body portion, wherein the first and second structures or body portions are configurable to be rotated relative to each other;
- a reciprocating piston mounted within a piston housing to define a piston chamber, wherein the piston is moveable in reverse first and second axial directions; and
- a rotary valve assembly comprising a valve inlet for communicating with a pressure region and a valve exhaust for communicating with an exhaust region, the rotary valve assembly being operated by relative rotation between the first and second structures or body portions to be cyclically reconfigured between:
  - a pressure configuration in which the piston chamber is in pressure communication with the valve inlet and isolated from the valve exhaust to permit the piston to move in the first axial direction in accordance with the piston chamber being pressurised via the valve inlet; and
  - an exhaust configuration in which the piston chamber is isolated from the valve inlet and in pressure communication with the valve exhaust to permit the piston chamber to be depressurised and the piston to move in the second axial direction,
- wherein movement of the piston in at least one of the first and second axial directions generates an applied force within the apparatus and/or applied force output from the apparatus.

The housing may be disposed at least partially around the mandrel. The mandrel may be fully disposed within the housing. The mandrel may be partially disposed within the housing.

The mandrel may be mounted within the housing, wholly or partially.

The housing and the mandrel may be disposed and/or mounted axially end to end. The mandrel may be positioned and/or mounted above or below the housing. The housing and the mandrel may be disposed and/or mounted co-axially or substantially co-axially.

Where the housing and the mandrel are disposed and/or mounted axially relative to each other, the housing may define a first housing part and the mandrel may define a second housing part.

The housing may be tubular. The housing may comprise a plurality of components.

Alternatively, the housing may comprise a single or unitary component.

The housing may define the axial throughbore of the apparatus.

The housing may define the valve exhaust. The housing may define the valve inlet.

The housing may comprise one or more lateral flow passages. One or more of the lateral flow passages of the housing may define or communicate with the valve exhaust. One or more of the lateral flow passages of the housing may define or communicate with the valve inlet.

In particular examples, the housing may comprise a plurality of the lateral flow passages, for example but not exclusively two lateral flow passages, three lateral flow passages, four or more lateral flow passages. The lateral flow passages may be arranged circumferentially and/or axially.

At least one of the lateral flow passages of the housing may be disposed at a first, uphole, location relative to the piston. Said lateral flow passages may define an upper valve exhaust of the apparatus. In particular examples, a plurality of the lateral flow passages of the housing may be disposed at the first, uphole, location relative to the piston.

At least one of the lateral flow passages of the housing may be disposed at a second, downhole, location relative to the piston. Said lateral flow passages may define a lower valve exhaust of the apparatus. In particular examples, a plurality of the lateral flow passages of the housing may be disposed at the second, downhole, location relative to the piston.

The housing may comprise, may take the form of, or may be coupled to a sleeve. The sleeve may comprise one or more blade portions. The sleeve may be configured to engage the borehole. The sleeve may act as a non-rotating element (or as a relatively lower rotational speed element compared to the mandrel).

In use, the mandrel may rotate while the housing—which by virtue of its engagement with borehole—does not rotate or rotates at a lower rotational speed than the mandrel.

The mandrel may be tubular. The mandrel may comprise a plurality of components. Alternatively, the mandrel may comprise a single or unitary component.

The mandrel may define the axial throughbore of the jarring apparatus.

The mandrel may be disposed and/or mounted concentrically or substantially concentrically within the housing. The mandrel may be disposed and/or mounted eccentrically within the housing.

The mandrel may be rotatably coupled to the housing. The mandrel may be rotatably coupled to the housing by one or more rotary bearing. The mandrel may be axially coupled to the housing. The mandrel may be rotatably and axially coupled to the housing. For example, the mandrel may be rotatably and axially coupled to the housing by a spline connection.

The mandrel and the housing may be rotatably fixed such that the mandrel and the housing rotate together, until released. The mandrel and the housing may be rotatably coupled, and wherein: in a first configuration the mandrel and the housing may be rotatably fixed such that the mandrel and the housing are configured to rotate together;

and in a second configuration the mandrel and the housing may be released for relative rotation.

The mandrel and the housing may be configured, e.g. shaped and/or dimensioned, so as to define an axial flow passage therebetween. The axial flow passage may be annular or part annular. The axial flow passage may provide fluid communication between the valve inlet and the piston chamber. The axial flow passage may be radially offset, .e.g. may be disposed radially outwards, from the axial throughbore. The apparatus may be configured to selectively permit fluid communication between the axial throughbore and the axial flow passage.

The mandrel may define the valve inlet. The mandrel may define the valve exhaust.

The mandrel may comprise one or more lateral flow passages. One or more of the lateral flow passages of the mandrel may define or communicate with the valve inlet. One or more of the lateral flow passages of the mandrel may define or communicate with the valve exhaust.

In particular examples, the mandrel may comprise a plurality of lateral flow passages. The lateral flow passages may be arranged circumferentially and/or axially.

At least one of the lateral flow passages of the mandrel may be disposed at a first, uphole, location relative to the piston. Said lateral flow passage or passages may define an upper valve inlet of the apparatus. In particular examples, a plurality of the lateral flow passages may be disposed at the first, uphole, location relative to the piston.

At least one of the lateral flow passages of the mandrel may be disposed at a second, downhole, location relative to the piston. Said lateral flow passage or passages may define a lower valve inlet of the apparatus. In particular examples, a plurality of the lateral flow passages may be disposed at the second, downhole, location relative to the piston.

In some examples, the one or more lateral flow passages of the mandrel may be provided on a circumferential surface of the mandrel. This may allow the flow area to be readily increased and/or decreased simply by axially extending or reducing the length of the one or more lateral flow passages. The number and/or configuration, e.g. dimensions or form, of the lateral flow passages of the mandrel may be selected in accordance with considerations such as total required inlet or exhaust area, frequency of the force(s) to be generated and/or the like. Moreover, the ability to increase the flow area may allow a more rapid pressurisation and depressurisation which may be more explosive in terms of the forces generated. Where, for example, the apparatus comprises or take the form of a jarring apparatus or hammer apparatus, the ability to increase the flow area may allow a more rapid pressurisation and depressurisation which may be more explosive in terms of the jarring forces or impact forces generated. The apparatus may be configured so that the flow area of the valve inlet and the valve exhaust are the same or substantially the same.

As described above, movement of the piston in at least one of the first and second axial directions generates an applied force, e.g. jarring or impact force, within the apparatus and/or an applied force output from the apparatus.

In particular but not exclusively, when the apparatus is configured to cyclically move the piston in first and second axial directions (in other words the piston is double-acting), the flow areas of the valve inlet and valve exhaust may be matched for each direction. For example, the relative flow area size of the valve inlet and valve exhaust associated with generating upwards forces may be increased or maximised while the flow area size of the valve inlet and valve exhaust associated with the return/down-stroke may be reduced or minimised.

Alternatively, the apparatus may be configured so that the flow area of the valve inlet and the vale exhaust are different. By selecting the flow area of the valve inlet and the valve outlet to be different, the apparatus may be tuned to reduce damping or choking and/or increase damping or choking, as required.

The relative flow area of the valve inlet and the valve exhaust may be configured to reduce damping or choking of fluid flow for example where it is desired to facilitate more rapid exhaust of fluid, such that the impulse of the piston, and corresponding force generated, is increased. This may be achieved, for example, by increasing the flow area of the valve exhaust relative to the flow area of the valve inlet. Where, for example, the apparatus comprises or takes the form of a jarring apparatus, the relative flow area of the valve inlet and the valve exhaust may be configured to reduce damping or choking of fluid flow for example where it is desired to facilitate more rapid exhaust of fluid, such that the impulse of the jarring piston, and corresponding jarring force generated, is increased. This may be achieved, for example, by increasing the flow area of the valve exhaust relative to the flow area of the valve inlet.

The relative flow area of the valve inlet and the valve exhaust may be configured to increase damping or choking of fluid where it is desired to dampen or control movement of the piston, and thereby limit the impulse and corresponding force, generated. This may be achieved, for example, by decreasing the flow area of the exhaust relative to the flow area of the valve inlet.

Where, for example, the apparatus comprises or takes the form of a jarring apparatus, the relative flow area of the valve inlet and the valve exhaust may be configured to increase damping or choking of fluid where it is desired to dampen or control movement of the jarring piston, and thereby limit the impulse and corresponding jarring force, generated.

As described above, the rotary valve assembly is operated by relative rotation between the mandrel and the housing to be cyclically reconfigured between:

a pressure configuration in which the piston chamber is in pressure communication with the valve inlet and isolated from the valve exhaust to permit the piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the piston to move in the second axial direction.

In use, pressure within the pressure region may function to cause or drive the piston to move in the first axial direction when the valve assembly is in its pressure configuration. That is, pressure from the pressure region may act as a driving force, to physically drive or bias the piston in the first axial direction.

The valve inlet and the valve exhaust may be provided as separate integers. That is, the valve assembly may concurrently include both a valve inlet and a valve exhaust to ensure proper functioning of the apparatus as disclosed.

The cyclical reconfiguring of the valve assembly may be considered to switch a pressure connection of the piston chamber cyclically between the valve inlet and valve exhaust.

The relative opening and closure timing of the valve inlet and the valve exhaust may be tuned to reduce damping or choking and/or increase damping or choking, as required.

The opening and closure timing of the valve inlet and the valve exhaust may be configured to reduce damping or choking of fluid flow for example where it is desired to facilitate more rapid exhaust of fluid, such that the impulse of the piston, and corresponding force generated, is increased. Where, for example, the apparatus comprises or takes the form of a jarring apparatus, the opening and closure timing of the valve inlet and the valve exhaust may be configured to reduce damping or choking of fluid flow for example where it is desired to facilitate more rapid exhaust of fluid, such that the impulse of the jarring piston, and corresponding jarring force generated, is increased.

The opening and closure timing of the valve inlet and the valve exhaust may be configured to increase damping or choking of fluid flow for example where it is desired to dampen or control movement of the piston, and thereby limit the impulse and corresponding force generated. Where, for example, the apparatus comprises or takes the form of a jarring apparatus, the opening and closure timing of the valve inlet and the valve exhaust may be configured to increase damping or choking of fluid flow for example where it is desired to dampen or control movement of the jarring piston, and thereby limit the impulse and corresponding jarring force, generated.

As described above, the rotary valve assembly comprises a valve inlet for communicating with a pressure region and a valve exhaust for communicating with an exhaust region, the rotary valve assembly being operated by relative rotation between the mandrel and the housing to be cyclically reconfigured between: a pressure configuration in which the piston chamber is in pressure communication with the valve inlet and isolated from the valve exhaust to permit the piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the piston to move in the second axial direction, wherein movement of the piston in at least one of the first and second axial directions generates an applied force, e.g. jarring force, within the apparatus or applied force output from the apparatus.

The rotary valve assembly may be configured to facilitate selective fluid communication between the valve inlet and the axial throughbore.

The rotary valve assembly may be configured to facilitate selective fluid communication between the axial flow passage defined between the mandrel and the housing and the piston chamber.

The valve inlet may comprise one or more inlet ports. The inlet ports may form the lateral flow passages of the mandrel. The inlet ports may be defined as pressure ports. The number and/or configuration, e.g. dimensions, of the inlet ports may be selected in accordance with considerations such as total required inlet or exhaust area, frequency of applied force(s) to be generated and/or the like.

In some examples, the one or more inlet ports may be provided on a circumferential surface of the mandrel. This may allow the area to be readily increased simply by axially extending their length. Moreover, this may allow a more rapid pressurisation and depressurisation which may be more explosive in terms of the force generated. Where, for example, the apparatus comprises or takes the form of a jarring apparatus, a more rapid pressurisation and depressurisation which may be more explosive in terms of the jarring force generated.

The valve inlet may be rotatably fixed to one of the mandrel and the housing.

The valve inlet may be integrally formed with one of the mandrel and the housing.

Alternatively, the valve inlet may be provided on a valve body.

The inlet ports may be provided through a wall of the mandrel.

The inlet ports may be provided on an inlet body. The inlet body may be configured for coupling to or form part of the mandrel or housing.

In some examples, the valve inlet may be configured to be arranged in pressure communication with a conduit which contains a fluid at a desired pressure. Such a conduit may be routed in any suitable form to facilitate communication of pressure from a pressure source (e.g., a pump system, hydrostatic head etc.) to the valve inlet. In some examples, which will be described in further detail below, the mandrel may define a conduit which provides said pressure communication.

The valve exhaust may comprise one or more outlet ports. The outlet ports may form the lateral flow passages of the housing. The number of outlet ports may be selected in accordance with considerations such as total required inlet or outlet area, jarring frequency and/or the like.

The outlet ports may be dimensioned to limit or prevent ingress of debris from the exhaust region, e.g. annulus into the piston chamber. For example, the outlet ports may be provided with a screen, such as a mesh, and/or a filter, so as to limit debris ingress from the exhaust region, e.g. annulus, getting into the piston chamber.

The valve exhaust may be rotatably fixed to one of the mandrel and the housing.

The valve exhaust may be integrally formed with one of the mandrel and the housing. In particular examples, the valve exhaust may be integrally formed with the housing.

The valve exhaust may be provided on an outlet body.

The outlet body may be configured for coupling to or form part of the mandrel or housing.

In some examples, the ports may be provided on a circumferential surface of the housing. This may allow the area to be readily increased simply by axially extending the length. This may allow a more rapid pressurisation and depressurisation which may be more explosive in terms of the force generated. Where, for example, the apparatus comprises or takes the form of a jarring apparatus or hammer apparatus, a more rapid pressurisation and depressurisation may be more explosive in terms of the jarring force or impact force generated.

The valve exhaust of the rotary valve assembly may be configured, for example by its position, construction and/or the like, to be arranged in pressure communication with an exhaust region. Such an exhaust region may provide suitable pressure conditions to permit the piston chamber to be depressurised. The pressure source or region and exhaust region may be provided in various ways, some examples of which will be described later below.

In use, the rotary valve assembly may function to control a flow of fluid between the pressure and exhaust regions (i.e., via the valve inlet and the valve exhaust). That is:

- when the valve assembly is in its pressure configuration fluid originating in the pressure region may be permitted to flow, via the valve inlet, into the piston chamber to pressurise the piston chamber and permit the piston to move in the first axial direction; and
- when the valve assembly is in its exhaust configuration fluid within the piston chamber may be permitted to flow, via the valve exhaust, to the exhaust region.

The rotary valve assembly may be axially and/or radially interposed between the mandrel and the housing. The rotary valve assembly may be disposed in the axial flow passage formed between the outside of the mandrel and the inside of the housing.

The rotary valve assembly may form or form part of a rotary valve arrangement. The rotary valve arrangement may comprise a single rotary valve assembly. Alternatively, the rotary valve arrangement may comprise first and second rotary valve assemblies, for example in the form of an upper rotary valve assembly and a lower rotary valve assembly.

The rotary valve assembly may form a first rotary valve assembly of a rotary valve arrangement of the apparatus, and the rotary valve arrangement may comprise a second rotary valve assembly.

The first rotary valve assembly and the second rotary valve assembly may be disposed either side of and/or may communicate with respective sides of the piston.

The rotary valve assembly may comprise at least one rotary valve member which is rotatably fixed to one of the housing and the mandrel.

The rotary valve member, or where the rotary valve assembly comprises a plurality of the rotary valve members at least one of the rotary valve members, may be integrally formed with the one of the housing and the mandrel. Alternatively, the rotary valve member, or where the rotary valve assembly comprises a plurality of the rotary valve members at least one of the rotary valve members may comprise a separate component.

The rotary valve member, or where the rotary valve assembly comprises a plurality of the rotary valve members at least one of the rotary valve members, may be coupled to one of the housing and mandrel, for example by a key arrangement, a thread connection, a spline connection or other suitable connection. By way of example, the rotary valve member may comprise a series of circumferential teeth or grooves for connection with one of the housing and mandrel by a spline connection.

In some examples, the rotary valve assembly comprises a single rotary valve member. In such examples, the rotary valve member may be operatively associated with the valve inlet and the valve exhaust.

In other examples, the rotary valve assembly comprises a plurality of rotary valve members. For example, the rotary valve assembly may comprise a rotary valve member operatively associated with the valve inlet, or each valve inlet where there are a plurality of valve inlets. The rotary valve assembly may comprise a rotary valve member operatively associated with the valve exhaust, or each valve exhaust where there are a plurality of valve exhausts.

The rotary valve assembly may comprise or take the form of one or more inlet selector, e.g. one or more inlet selector sleeve.

The one or more inlet selector may form the rotary valve member operatively associated with the valve inlet. The one or more inlet selector may be operatively associated with the valve inlet. The one or more inlet selector and the valve inlet may be configured for relative rotation to each other such that rotation causes the inlet selector sleeve or sleeves to selectively block or obturate the valve inlet(s). That is, during one phase of relative rotation, the valve inlet may define an open configuration in which pressure communication with the piston chamber is permitted and in another phase the valve inlet may define a closed configuration in which pressure communication is prevented, substantially prevented or obturated by the inlet selector sleeve.

The one or more inlet selector may be rotatably fixed to one of the housing and mandrel.

The one or more inlet selector may be coupled to one of the housing and the mandrel by a key arrangement or other suitable coupling arrangement.

The valve inlet may be rotatably fixed to one of the housing and the mandrel and the one or more inlet selector may be rotatably fixed to the other of the housing and the mandrel.

The valve inlet may be provided on an inlet body and the rotary valve assembly may comprise an inlet selector sleeve, wherein the inlet body and inlet selector sleeve are arranged to be rotatable relative to each other to selectively open and close the valve inlet. The inlet body and the inlet selector sleeve or sleeves may be configured such that relative rotation therebetween cyclically opens and closes the valve inlet(s). In this respect, the open condition may be such that pressure communication with the piston chamber is provided. The closed condition may substantially or fully prevent fluid communication with the piston chamber.

The one or more inlet selector may be tubular.

The one or more inlet selector may comprise one or more lateral flow passages. The lateral flow passages of the inlet selector may comprise flow ports. The one or more lateral flow passages may be circular or take the form of elongate slots.

The rotary valve assembly may comprise or take the form of one or more outlet selector, e.g. one or more outlet selector sleeves.

The one or more outlet selector may form the rotary valve member operatively associated with the valve exhaust. The one or more outlet selector and the valve exhaust may be configured for relative rotation to each other such that rotation causes the one or more outlet selector to selectively block or obturate the valve exhaust(s). That is, during one phase of relative rotation, the valve inlet may define an open configuration in which pressure communication with the piston chamber is permitted and in another phase the valve inlet may define a closed configuration in which pressure communication is prevented, substantially prevented or obturated by the outlet selector sleeve.

The outlet selector sleeve may be rotatably fixed to one or the housing and mandrel. The valve exhaust may be rotatably fixed to one of the housing and the mandrel and the outlet selector sleeve may be rotatably fixed to the other of the housing and the mandrel. In particular examples, the outlet selector sleeve may be coupled to the mandrel. The outlet selector sleeve may be coupled to the mandrel by a key arrangement or other suitable coupling arrangement.

The one or more outlet selector sleeve may be tubular.

The one or more outlet selector may comprise one or more lateral flow passages. The lateral flow passages of the one or more outlet selector may comprise flow ports. The one or more lateral flow passages may be circular or take the form of elongate slots.

The inlet selector sleeve and the outlet selector sleeve may be separate components. Alternatively, the inlet selector sleeve and the outlet selector sleeve may comprise a single component, for example may be integrally formed.

The valve assembly may form part of a valve arrangement of the apparatus, the valve arrangement comprising a second valve assembly. The valve arrangement may comprise a first, upper, valve assembly and a second, lower, valve assembly.

The second valve assembly may comprise one or more valve inlet such as described above.

The second valve assembly may comprise one or more valve exhaust such as described above.

The second valve assembly comprise one or more rotary valve member as described above. In particular examples, the valve arrangement may comprise the first, upper, valve assembly, wherein said first valve assembly comprises one or more rotary valve member operatively associated with one or both of the upper valve inlet and the upper valve exhaust and a second, lower, valve assembly comprising one or more rotary valve member operatively associated with one or both of the lower valve inlet and the lower valve exhaust.

In use, the rotary valve arrangement may act to bias the piston towards the first axial direction or the second axial direction when the valve assembly is in its pressure configuration. The rotary valve arrangement may form or form part of a biasing arrangement.

The apparatus may comprise a first biasing arrangement. The first biasing arrangement may comprise the rotary valve assembly. In this respect, the first biasing arrangement may function to bias the piston in the first axial direction when the valve assembly is in its pressure configuration. When the valve assembly is in the exhaust configuration such that the piston chamber is vented the piston may move in the second direction under action or control of a second biasing arrangement.

In this example, with the provision of first and second biasing arrangements the jarring apparatus may be defined as comprising:

- a housing;
- a mandrel, wherein the mandrel and the housing are configurable to be rotated relative to each other;
- a piston mounted within a piston housing to define a piston chamber, wherein the piston is moveable in reverse first and second axial directions;
- a first biasing arrangement comprising a rotary valve assembly having a pressure port for communicating with a pressure region and an exhaust port for communicating with an exhaust region, the rotary valve assembly being operated during relative rotation between the mandrel and the housing to be cyclically reconfigured between:
  - a pressure configuration in which the piston chamber is in pressure communication with the pressure port and isolated from the exhaust port to permit the piston to move in the first axial direction in accordance with the piston chamber being pressurised; and
  - an exhaust configuration in which the piston chamber is isolated from the pressure port and in pressure communication with the exhaust port to permit the piston chamber to be vented and the piston to move in the second axial direction under action or control of a second biasing arrangement,
- wherein movement of the piston in at least one of the first and second axial directions generates an applied force within the apparatus and/or applied force output from the apparatus.

As described above, the rotary valve arrangement may comprise a single valve assembly or a plurality of rotary valve assemblies, said rotary valve assemblies forming a biasing arrangement of the apparatus.

In examples comprising a single valve assembly, the apparatus may comprise a second biasing arrangement. The second biasing arrangement may comprise or take the form of a mechanical biasing arrangement. The second biasing arrangement may comprise or take the form of a spring arrangement.

As described above, the piston is disposed and/or mounted within the piston housing to define the piston chamber, the piston being moveable in reverse first and second axial directions.

The piston housing may form part of the housing or may be a separate component coupled to, e.g. rotatably coupled to, the housing.

The piston housing may form part of the mandrel or may be a separate component coupled to, e.g. rotatably coupled to, the mandrel.

In some examples, the piston may be interposed between the mandrel and the housing.

The piston may be disposed within the piston chamber so as define first and second piston chamber portions.

The apparatus may comprise co-operating impact surfaces, wherein engagement of the impact surfaces results in the generation of the applied force. Where, for example, the apparatus comprises or take the form of a jarring apparatus, the jarring apparatus may comprise co-operating impact surfaces, wherein engagement of the impact surfaces results in the jarring force.

The impact surfaces may comprise co-operating first and second impact surfaces.

The first impact surface may be provided on the piston. In particular examples, the first impact surface may be provided on a hammer coupled to or forming part of the piston. Alternatively, the first impact surface may be provided on a separate hammer member. Alternatively, the first impact surface may be formed on the mandrel.

The second impact surface may be formed on a surface of the housing and/or the mandrel. In particular examples, the second impact surface may be formed on an anvil coupled to or forming part of the mandrel or housing.

In use, the rotary valve assembly may be operable by relative rotation between the mandrel and the housing to be cyclically reconfigured between the pressure configuration and the exhaust configuration, so as to move the piston in one of the first and second axial directions, said movement of the piston engaging the first and second impact surfaces to generate the force within the apparatus or force output from the apparatus.

In some instances, however, the apparatus may be configured so that the impact surfaces do not engage, said movement of the piston itself being sufficient to generate jarring or agitation forces.

As described above, the apparatus may be configured to dampen and/or control movement of the piston.

The apparatus may comprise means for controlling and/or dampening the movement of the piston in one of the axial directions.

The apparatus may comprise a damper arrangement.

The damper arrangement may comprise or take the form of a mechanical damper arrangement and/or a fluid damper arrangement, for example hydraulic damper arrangement.

The apparatus may comprise an end stop. The end stop may comprise or take the form of a buffer, for example a rubber buffer. Alternatively, the end stop may comprise or take the form of co-operating impact surfaces similar to the first and second impact surfaces described above.

The damper arrangement may comprise a dash-pot assembly. The dash-pot assembly may be coupled to or operatively associated with the piston. In use, the dash-pot assembly may provide hydraulic dampening at the end of the travel of the piston in the direction of buffering.

Alternatively or additionally, and as described above, the valve inlet and the valve exhaust flow areas may be choked so as to dampen and/or control the force generated.

Alternatively or additionally, and as described above, the opening and closure timings of the valve inlet and the valve exhaust may be configured to dampen and/or control the force generated.

Pressure may be applied in any suitable way. In one example, pressure may be elevated at the inlet by pressuring fluid in a seal space, such as a cavity, conduit and/or the like. Alternatively, pressure may be applied on a flow of fluid, for example by establishing fluid dynamic conditions which establish a desired backpressure.

The apparatus may comprise, may be coupled to or operatively associated with a valve arrangement configured to generate the elevated pressure for use by the apparatus. The valve arrangement may be configured to provide selective fluid communication through the axial throughbore of the apparatus.

The valve arrangement may comprise a valve member. The valve member may comprise or take the form of a ball. The ball may comprise a throughbore.

The valve arrangement may comprise an upper valve seat and a lower valve seat. The valve member, e.g. ball, may be captivated between an upper valve seat and a lower valve seat.

The valve arrangement may comprise an actuator. The actuator may comprise or take the form of a linear actuator. The actuator may comprise or take the form of an actuator sleeve.

The valve arrangement may comprise a valve operator arrangement. The valve operator arrangement may comprise one or more operator members.

The one or more operator members may be disposed between and configured to couple the actuator to the valve member. The one or more operator members may be coupled to or configured to engage the actuator. For example, one or more of the operator members may comprise a tab which seats in a corresponding recess in the actuator. Other means for coupling or engaging the one or more operator members with the actuator may be used.

The one or more operator members may be coupled to or configured to engage the valve member. For example, one or more of the operator members may comprise a pin which seats in an offset slot in the valve member. Other means for coupling or engaging the one or more operator members with the valve member may be used.

In use, axial movement of the actuator sleeve may translate the operator members to pivot the valve member, e.g. ball, and thereby reconfigure the valve member from the open configuration to the closed configuration.

Rotation of the valve member, e.g. ball, may be limited. For example, rotation of the valve member may be limited to ¼ turn. The valve arrangement may comprise a movement limiter.

The valve member may comprise an orifice. When the valve member, e.g. ball, defines the closed configuration, the orifice may be aligned with the axial throughbore. Flow through the orifice generates a back pressure for use by the apparatus. The provision of the orifice may also mean that even when the valve arrangement defines the closed configuration, some fluid communication through the apparatus is nevertheless provided. Beneficially, this permits the apparatus to function without complete closure of the axial flow passage and, for example, permits circulation of fluid below the apparatus and/or transmission of pressure forces which may be required to operate downhole tools or other connected tools.

The valve arrangement may comprise, may be coupled to operatively associated with an indexer mechanism. The indexer mechanism may comprise or take the form of a dog indexer.

The indexer mechanism may comprise one or more slots. The indexer mechanism may comprise one or more dogs.

The one or more dogs may be configured to engage the one or more slots. The dog or dogs may be disposed on the mandrel such that relative axial movement of the mandrel and the housing de-supports the dogs and permits axial movement of the actuator.

The indexer mechanism may comprise one or more further dogs, which may be defined as upper dogs. The one or more dogs may be provided in a recess in the mandrel, in particular an outer circumferential surface of the mandrel.

In use, relative axial movement of the mandrel and the housing aligns the dogs with corresponding recesses formed in the inner circumferential surface of the housing, allowing the dogs to move radially outwards and thereby stop further axial movement of the actuator.

The indexer mechanism may comprise a ramp profile. The ramp profile may be provided on the mandrel, in particular an outer circumferential surface of the mandrel.

In use, relative axial movement of the mandrel and the housing may urge the ramp profile into engagement with the further dogs, picking up the indexer mechanism and closing the valve arrangement.

The valve arrangement may thus be opened and closed repeatedly as required, by relative axial movement of the mandrel and the housing.

As described above, the apparatus may be configured to generate significant forces in at least one axial direction. Where, for example, the apparatus comprises or takes the form of a jarring apparatus, the jarring apparatus may be configured to generate significant jarring forces in at least one axial direction. In some examples, the apparatus may comprise means to limit the transmission of forces. For example, the apparatus may comprise a pressure regulator, e.g. pressure regulator, pressure relief valve (PRV) or the like. In use, the pressure regulator may be configured to vent pressure to the exhaust region on exceeding a predetermined threshold pressure.

The apparatus may comprise, may be coupled to or operatively associated with one or more swivel. The swivel may be interposed, e.g. radially interposed between the mandrel and the housing.

The provision of one or more swivel may be particularly beneficial in downhole applications such as running completions and the like having components which are unsuitable to transmission of rotary forces.

The swivel may comprise a thrust assembly.

The thrust assembly may comprise a first thrust profile. The first thrust profile may comprise or take the form of a shoulder. The first thrust profile, e.g. shoulder, may be formed or provided on the mandrel.

The thrust assembly may comprise a second thrust profile. The second thrust profile may comprise or take the form of a shoulder. The second thrust profile, e.g. shoulder, may be formed or provided on the housing.

The apparatus may be configured such that the first and second thrust profiles may be axially separated and thus disengaged, wherein relative axial movement of the mandrel and the housing brings the first and second thrust profiles into engagement, such that axial loading may be transmitted between the mandrel and the housing via the thrust assembly, thus diverting such loading from other components within the apparatus.

The thrust assembly permits rotation between the first and second thrust profiles when engaged, such that the thrust assembly may function as a thrust bearing arrangement.

The thrust assembly may comprise one or more thrust bearing assembly.

In particular examples, the thrust assembly may comprise a plurality of thrust bearing assemblies. The thrust bearing assemblies may be arranged axially. Beneficially, the thrust bearing assemblies share the axial load force exerted on the thrust assembly.

The thrust bearing assembly may comprise one or more thrust bearings. At least one of the thrust bearings may comprise or take the form of a plain bearing, for example a PTFE thrust bearing or the like.

The thrust bearing assembly may comprise a carrier member. The one or more thrust bearings may be disposed on and carried by the carrier member. The carrier member may be annular or part annular. The carrier comprise or take the form of a sleeve.

The apparatus may comprise, may be coupled to or operatively associated with a mechanism for providing cooling and/or lubrication of the thrust assembly.

The mechanism may comprise a seal arrangement. The seal arrangement may be interposed, e.g. radially interposed, between the mandrel and the housing.

The seal arrangement may comprise one or more seal elements and in particular examples the seal arrangement may comprise a plurality of seal elements. The seal arrangement may comprise a seal stack.

The mechanism for providing cooling and/or lubrication of the thrust assembly may comprise one or more lateral flow passages, e.g. flow ports. The one or more lateral flow passages, e.g. flow ports, may be circumferentially arranged and/or spaced. The one or more lateral flow passages may be configured to provide fluid communication between the axial throughbore of the apparatus and the thrust assembly.

When seated, the seal arrangement may prevent or at least inhibit fluid communication to the thrust assembly. When unseated by relative axial movement between the mandrel and the housing, the one or more lateral flow passages, e.g. flow ports, fluid communication to the thrust assembly may be permitted, thereby acting to cool and/or lubricate the thrust assembly.

The apparatus may be configured to generate one or more downwards or downhole-directed forces. Where, for example, the apparatus comprises or takes the form of a jarring apparatus, the jarring apparatus may be configured to generate one or more downwards or downhole-directed jarring forces within the jarring apparatus. The apparatus may comprise co-operating impact surfaces arranged to generate one or more downwards or downhole-directed forces. A first impact surface may comprise a shoulder. A second impact surface may comprise or may be provided on a separate member, such as an anvil or the like.

In use, relative axial movement of the housing and the mandrel may bring the first and second impact surfaces into engagement, so as to generate the one or more downwards or downhole-directed forces. Where, for example, the apparatus comprises or takes the form of a jarring apparatus, relative axial movement of the housing and the mandrel may bring the first and second impact surfaces into engagement, so as to generate the one or more downwards or downhole-directed jarring forces within the apparatus.

The apparatus may comprise, may be coupled to operatively associated with an axial trigger arrangement.

The axial trigger arrangement may be configured to selectively axially lock the mandrel and the housing. In a first configuration, the axial trigger arrangement may be configured to axially lock the mandrel and the housing. In a second configuration, the axial trigger arrangement may be configured to permit axial movement between the mandrel and the housing.

The axial trigger arrangement may comprise a locking profile. The locking profile may be provided on or coupled to the mandrel. The locking profile may comprise or take the form of a male profile. Alternatively, the locking profile may comprise or take the form of a female profile. The locking profile may comprise or take the form of a castellated or toothed profile or the like.

The axial trigger arrangement may comprise one or more locking keys. In some examples, the axial trigger arrangement comprises a single locking key. Alternatively, the axial trigger arrangement may comprise a plurality of locking keys. The one or more locking keys may be annular or part annular.

The one or more locking keys may be configured to engage the locking profile. The one or more locking keys may comprise a locking profile configured to engage the locking profile provided on or coupled to the mandrel. The locking profile may comprise or take the form of a male profile. Alternatively, the locking profile may comprise or take the form of a female profile. The locking profile may comprise or take the form of a castellated or toothed profile or the like.

The one or more locking keys may be reconfigurable between a retracted configuration, for example radially retracted configuration, and an extended configuration, for example radially extended configuration.

The one or more locking keys may be biased towards the retracted configuration. For example, the one or more locking keys may be constructed from a resilient material such that the one or more keys are biased toward the retracted configuration and/or the apparatus may comprise a resilient member for urging the one or more locking keys towards the retracted configuration.

The axial trigger arrangement may comprise a retainer for retaining the one or more locking keys in a radially retracted position.

The axial trigger arrangement may comprise a taper lock. The taper lock may form or form part of the retainer. The taper lock may comprise a lock bowl defining a tapered surface configured to engage a corresponding tapered surface on at least one of the locking keys.

The axial trigger arrangement may comprise a spring arrangement. The spring arrangement may form or form part of the retainer. The spring arrangement may comprise one or more spring elements, or other suitable biasing member. In particular examples, the spring arrangement may comprise a plurality of spring elements, such as a spring stack, and more particularly but not exclusively the spring arrangement may comprise a Belleville spring stack.

The spring arrangement may be coupled to or configured to engage the taper lock to urge the one or more locking keys towards their retracted configuration. For example, the spring arrangement may be configured to urge the tapered surface of the lock bowl towards the corresponding tapered surface on at least one of the locking keys so as to urge the one or more locking keys towards and/or retain the locking keys in their retracted configuration.

The axial trigger arrangement may be configured to move the one or more locking keys to the extended configuration in response to an axial pull or tensile force applied to the mandrel. The axial trigger arrangement may be configured to move the one or more locking keys to the extended configuration in response to an axial pull or tensile force above a predetermined threshold force, in particular the spring force of the spring arrangement.

Beneficially, the axial trigger arrangement may be resettable.

For example, it will be recognised that the axial trigger arrangement may, by virtue of application of a pull or tensile force above a predetermined threshold or a push, compressive or applied weight force above a predetermined threshold, may be reconfigurable between the first configuration in which the axial trigger arrangement is configured to axially lock the mandrel and the housing and the second configuration in which the axial trigger arrangement is configured to permit axial movement between the mandrel and the housing. Where, for example, the apparatus comprises or takes the form of a jarring apparatus, the application of a pull or tensile force may, for example, facilitate an axial up jar operation and/or rotary jarring operation. The application of a push, compressive or applied weight force may, for example, facilitate an axial down jar operation.

The axial trigger arrangement may facilitate a predetermined axial (up or down) jar to be carried out.

The apparatus may comprise, may be coupled to or operatively associated with a rotational drive mechanism. Where, for example, the apparatus comprises or takes the form of a jarring apparatus, relative rotation between the first and second jarring assemblies to provide jarring may be achieved via the rotational drive mechanism. The rotational drive mechanism may be configured separately from the apparatus. Alternatively, or additionally, the apparatus may comprise a rotational drive mechanism.

The rotational drive mechanism may be coupled or otherwise associated with at least one of the first and second jarring assemblies and configured to provide a relative rotational movement therebetween.

The rotational drive mechanism may comprise a rotatable work string. The rotational drive mechanism may comprise a rotatable work string coupled to at least one of the first and second jarring assemblies. The work string may be defined by, for example, a drilling string.

The rotational drive mechanism may comprise a motor, such as an electric motor, pneumatic motor, hydraulic motor, mud motor or the like.

As described above, it will be understood that while the terms "housing" and "mandrel" have been used herein for convenience, these components may alternatively be referred to as a first structure or first body portion and a second structure or second body portion of the apparatus. Accordingly, references above or below to the housing may be substituted with first structure or first body portion and/or references above or below to the mandrel may be substituted with second structure or second body portion.

Another aspect of the present disclosure relates a tool comprising the apparatus according to the first aspect.

The tool may comprise the jarring apparatus described above with respect to the first aspect.

The tool may comprise the hammer apparatus described above with respect to the first aspect.

The hammer apparatus may comprise or take the form of an axial hammer apparatus.

The hammer apparatus may comprise or take the form of a radial hammer apparatus. The radial hammer apparatus may comprise a radial hammer assembly. The radial hammer assembly may comprise a tapered bowl having a tapered outer surface. The radial hammer assembly may comprise one or more hammer members. The hammer members may comprise a plurality of hammer members. The hammer members may be circumferentially arranged and/or spaced. One or more of the hammer members may comprise a tapered inner surface. One or more of the hammer members may comprise or take the form of a dog.

The radial hammer assembly may be reconfigurable between a first configuration in which the hammer members define a radially retracted position within the apparatus and a second configuration in which the hammer members define a radially extended position which, in use, engages the borehole.

The output force generated by the apparatus may be transmitted to the bowl which, by virtue of the engagement of the tapered surfaces transmits the output force to the hammer members.

The apparatus may comprise the reciprocator apparatus described above with respect to the first aspect.

The tool may comprise a downhole tool.

The tool may comprise or take the form of a drilling tool, for example a percussion drilling tool, comprising the hammer apparatus and a drill bit.

The tool may comprise or take the form of a pump tool. The tool may comprise the reciprocator apparatus and a pump.

The tool may comprise or take the form of a packer. The tool may comprise the reciprocator apparatus and a packer.

The tool may comprise the valve arrangement configured to generate a back pressure for use by the apparatus, as described above with respect to the first aspect.

The tool may comprise the thrust assembly, as described above with respect to the first aspect.

The tool may comprise the mechanism for providing cooling and/or lubrication of the thrust assembly, as described above with respect to the first aspect.

The tool may comprise the axial trigger arrangement, as described above with respect to the first aspect.

The tool may further comprise a top sub. The top sub may be generally tubular in construction. The top sub may comprise an axial throughbore extending therethrough.

An end portion, e.g. upper end portion, of the top sub may be configured for coupling the jarring apparatus to another component of a tool assembly, e.g. tool string. The top sub may define a connector for coupling the jarring apparatus to another component of a tool assembly. The connector may comprise or take the form of threaded connector. The connector may comprise or take the form of threaded male connector, such as a threaded pin connector, or female connector, such as a threaded box connector. In particular examples, the connector may comprise a threaded box connector.

An end portion, e.g. lower end portion, of the top sub may be configured for coupling to the mandrel. The top sub may define a profile configured for coupling to the mandrel, e.g. an upper end portion of the mandrel. The profile may comprise or take the form of a female profile. The profile may comprise or take the form of a male profile.

The top sub may be configured for coupling to the mandrel by a connector. The connector may comprise a thread connection.

The tool may comprise a bottom sub. The bottom sub may be generally tubular in construction having an axial throughbore extending therethrough.

An end portion, e.g. lower end portion, of the bottom sub may be configured for coupling the apparatus to another component of a tool assembly, e.g. tool string.

The bottom sub may define a connector for coupling the apparatus to said other component of the tool string. The connector may comprise or take the form of threaded connector. The connector may comprise or take the form of threaded male connector, such as a threaded pin connector, or female connector, such as a threaded box connector. In particular examples, the connector may comprise a threaded pin connector.

An end portion, e.g. upper end portion, of the bottom sub configured for coupling to the housing. The bottom sub may define a profile configured for coupling to the housing, e.g. an end portion of the housing. The profile may comprise or take the form of a female profile. In particular examples, the profile may comprise or take the form of a male profile.

The bottom sub may be configured for coupling to the housing by a connector. The connector may comprise a thread connection.

Another aspect of the present disclosure relates to a method for generating applied forces, the method comprising:

- providing a housing and a mandrel, wherein the mandrel and the housing are configurable to be rotated relative to each other;
- providing a reciprocating piston mounted within a piston housing to define a piston chamber, wherein the piston is moveable in reverse first and second axial directions; and
- providing a rotary valve assembly comprising a valve inlet for communicating with a pressure region and a valve exhaust for communicating with an exhaust region, the rotary valve assembly being operated by relative rotation between the mandrel and the housing to be cyclically reconfigured between:
  - a pressure configuration in which the piston chamber is in pressure communication with the valve inlet and isolated from the valve exhaust to permit the piston to move in the first axial direction in accordance with the piston chamber being pressurised via the valve inlet; and
  - an exhaust configuration in which the piston chamber is isolated from the valve inlet and in pressure communication with the valve exhaust to permit the piston chamber to be depressurised and the jarring piston to move in the second axial direction,
- wherein movement of the piston in at least one of the first and second axial directions generates an applied force within the apparatus and/or an applied force output from the apparatus.

In particular, but not exclusively, the method may be employed in downhole applications. In this respect, the method may be defined as a downhole method.

In use, movement of the piston in at least one of the first and second axial directions generates an applied force (e.g. to provide one or more jarring or impact forces within an apparatus) and/or an applied force output an apparatus, e.g. for transmission to a connected component or assembly of the apparatus or other connected tool so as to provide an actuation or motive force to said connected component, assembly or tool.

The method may generate jarring forces.

In this respect, the present disclosure may relate to a method for generating jarring forces, the method comprising:

- providing a housing and a mandrel, wherein the mandrel and the housing are configurable to be rotated relative to each other;
- providing a jarring piston mounted within a piston housing to define a piston chamber, wherein the jarring piston is moveable in reverse first and second axial directions; and
- providing a rotary valve assembly comprising a valve inlet for communicating with a pressure region and a valve exhaust for communicating with an exhaust region, the rotary valve assembly being operated by relative rotation between the mandrel and the housing to be cyclically reconfigured between:

a pressure configuration in which the piston chamber is in pressure communication with the valve inlet and isolated from the valve exhaust to permit the jarring piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the jarring piston to move in the second axial direction, wherein movement of the jarring piston in at least one of the first and second axial directions generates a jarring force within the apparatus.

The method may generate impact forces.

The method may generate an actuation and/or motive forces.

Another aspect of the present disclosure relates to a method for generating applied forces, the method comprising:

establishing relative rotation between a housing and a mandrel to operate a rotary valve assembly, the rotary valve assembly comprising a valve inlet for communicating with a pressure region and a valve exhaust for communicating with an exhaust region, such that the rotary valve assembly is cyclically reconfigured between:

a pressure configuration in which a piston chamber is in pressure communication with the valve inlet and isolated from the valve exhaust to permit a piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the piston to move in the second axial direction, wherein movement of the piston in at least one of the first and second axial directions generates an applied force within the apparatus and/or an applied force output from the apparatus.

The method may generate jarring forces.

In this respect, the present disclosure may relate to a method for generating jarring forces, the method comprising:

establishing relative rotation between a housing and a mandrel to operate a rotary valve assembly, the rotary valve assembly comprising a valve inlet for communicating with a pressure region and a valve exhaust for communicating with an exhaust region, such that the rotary valve assembly is cyclically reconfigured between:

a pressure configuration in which a piston chamber is in pressure communication with the valve inlet and isolated from the valve exhaust to permit a jarring piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the jarring piston to move in the second axial direction, wherein movement of the jarring piston in at least one of the first and second axial directions generates a jarring force within the apparatus.

The method may generate impact forces.

The method may generate an actuation and/or motive forces.

In some examples, the apparatus may be for use within a wellbore. As such, the apparatus may define a downhole apparatus. The apparatus may be configured to apply an applied force to a pipe string, downhole tool, bottom hole assembly (BHA), such as a drilling BHA, or the like. The apparatus may be configured for use in releasing an object which is stuck within a wellbore. In some examples the apparatus may be deployable downhole on an elongate medium, such as wireline, coiled tubing, jointed tubing or the like. The apparatus may be tractor deployed downhole.

The apparatus may be configured for use in pulling plugs within a wellbore or associated infrastructure.

The apparatus may be configured for use in pulling or retrieval operations associated with removal of infrastructure from a wellbore, such as fishing operations, pulling completions, casing, liner, conductor and the like.

The apparatus may be configured for use in subsea applications, such as in piling applications, equipment removal applications, and the like.

In some applications, the apparatus may be required to support load, for example significant load therethrough. For example, in a casing pulling operation the apparatus may be directly or indirectly coupled to a casing string being pulled, which might generate loading, for example significant loading through the apparatus of up to and beyond 4.5 MN.

The apparatus may be configured to permit axial forces to be generated in one axial direction, such as in an upward or downward direction. Where, for example, the apparatus comprises or takes the form of a jarring apparatus, the apparatus may be configured to permit axial jarring in one axial direction, such as in an upward or downward direction. The apparatus may be configured to permit axial forces to be generated in opposing axial directions. Where, for example, the apparatus comprises or takes the form of a jarring apparatus, the apparatus may be configured to permit axial jarring in opposing axial directions.

Another aspect of the present disclosure relates to a reciprocating drive apparatus, comprising:

a housing;

a mandrel, wherein the mandrel and the housing are configurable to be rotated relative to each other;

a reciprocating piston mounted within a piston housing to define a piston chamber, wherein the piston is moveable in reverse first and second axial directions; and a rotary valve assembly operated by relative rotation between the mandrel and the housing to cyclically pressurise and depressurise the piston chamber to provide reciprocating movement of the reciprocating piston, wherein movement of the piston in at least one of the first and second axial directions generates an applied force within the apparatus and/or an applied force output from the apparatus.

Another aspect of the present disclosure relates to a reciprocating drive apparatus comprising:

a throughbore;

a pressure operated force-generating mechanism operable by fluid pressure to generate applied forces within the apparatus and/or an applied force output form the apparatus, wherein the pressure operated force-generating mechanism is in pressure communication with the throughbore; and a pressure control mechanism within the throughbore, wherein the pressure control mechanism is selectively variable within the throughbore to permit pressure to be varied within the throughbore for use in operating the pressure operated force-generating mechanism.

The apparatus may comprise or take the form of a jarring apparatus.

In this respect, the present disclosure may relate to a jarring apparatus comprising:

a throughbore;

a pressure operated jarring mechanism operable by fluid pressure to generate jarring forces within the apparatus, wherein the pressure operated jarring mechanism is in pressure communication with the throughbore; and a pressure control mechanism within the throughbore, wherein the pressure control mechanism is selectively variable within the throughbore to permit pressure to be varied within the throughbore for use in operating the pressure operated jarring mechanism.

Alternatively, the apparatus may comprise or take the form of a hammer apparatus.

Alternatively, the apparatus may comprise or take the form of a reciprocator apparatus. Another aspect of the present disclosure relates to a reciprocating drive apparatus comprising:

an axial throughbore; and a mechanism disposed in the axial throughbore, wherein the mechanism is configurable between a first, open, configuration which permits access through the axial throughbore of the apparatus and a second, obturated, configuration in which access through the axial throughbore of the apparatus is restricted or blocked, said restriction or blockage providing an elevated fluid pressure or fluid pressure differential within the axial throughbore; and a force-generating mechanism configured to utilise the elevated fluid pressure generated by the mechanism in the generation of applied forces within the jarring apparatus and/or an applied force output from the apparatus.

The apparatus may comprise or take the form of a jarring apparatus. The jarring apparatus may comprise or take the form of a rotary jarring apparatus.

In this respect, the present disclosure may relate to a jarring apparatus comprising:

an axial throughbore; and a mechanism disposed in the axial throughbore, wherein the mechanism is configurable between a first, open, configuration which permits access through the axial throughbore of the jarring apparatus and a second, obturated, configuration in which access through the axial throughbore of the jarring apparatus is restricted or blocked, said restriction or blockage providing an elevated fluid pressure or fluid pressure differential within the axial throughbore; and a jarring mechanism configured to utilise the elevated fluid pressure generated by the mechanism in the generation of jarring forces within the jarring apparatus.

Alternatively, the apparatus may comprise or take the form of a hammer apparatus.

Alternatively, the apparatus may comprise or take the form of a reciprocator apparatus.

The apparatus may be configurable in the first, open, configuration which permits access, e.g. full bore or substantially full bore access, through the axial throughbore of the apparatus. The apparatus may be configurable in the second, obturated, configuration in which access through the apparatus is restricted or blocked.

The apparatus may be reconfigurable between the first and second configurations, that is from the first configuration to the second configuration and vice-versa.

In the first, open, configuration, the apparatus may beneficially facilitate full flow and/or passage of tools through the apparatus. Thus, in circumstances where generation of applied forces is not required the apparatus does not impinge on the passage of the fluid and/or tools through the apparatus.

In the second, obturated, configuration, the restriction or blockage may provide an elevated pressure within the apparatus which may be utilised by the apparatus. For example, where the second, obturated, configuration forms a partial restriction through the axial throughbore the restriction may generate a back pressure for use in operation of the apparatus. Alternatively, where the second, obturated, configuration prevents or substantially prevents access through the axial throughbore, an elevated pressure region may be created within the apparatus upstream of the blockage, for use in operation of the apparatus.

Another aspect of the present disclosure relates to a reciprocating drive apparatus, comprising:

a piston mounted within a piston housing to define a piston chamber;

a rotary valve assembly comprising a pressure port for communicating with a pressure region and a vent port for communicating with a vent region, the rotary valve assembly being cyclically reconfigured between:

a pressure configuration in which the piston chamber is in pressure communication with the pressure port and isolated from the vent port to permit the piston to move in a first axial direction in accordance with the piston chamber being pressurised; and a vent configuration in which the piston chamber is isolated from the pressure port and in pressure communication with the vent port to permit the piston chamber to be vented and the piston to move in a second axial direction opposite the first axial direction, wherein movement of the piston in at least one of the first and second axial directions generates an applied force within the apparatus and/or an applied force output from the apparatus.

The apparatus may comprise or take the form of a jarring apparatus.

In this respect, the present disclosure may relate to a jarring apparatus, comprising:

a jarring piston mounted within a piston housing to define a piston chamber;

a rotary valve assembly comprising a pressure port for communicating with a pressure region and a vent port for communicating with a vent region, the rotary valve assembly being cyclically reconfigured between:

a pressure configuration in which the piston chamber is in pressure communication with the pressure port and isolated from the vent port to permit the jarring piston to move in a first axial direction in accordance with the piston chamber being pressurised; and a vent configuration in which the piston chamber is isolated from the pressure port and in pressure communication with the vent port to permit the piston chamber to be vented and the jarring piston to move in a second axial direction opposite the first axial direction, wherein movement of the jarring piston in at least one of the first and second axial directions generates a jarring force within the apparatus.

Alternatively, the apparatus may comprise or take the form of a hammer apparatus.

Alternatively, the apparatus may comprise or take the form of a reciprocator apparatus.

Another aspect of the present disclosure relates to a reciprocating drive apparatus, comprising:

a piston axially moveable within a piston chamber;

a rotary valve assembly comprising a first valve port for communicating with a first pressure region and a second valve port for communicating with a second pressure region in pressure communication with first and second pressure regions which in use are exposed to different pressures, the rotary valve assembly being rotatably operated to be cyclically reconfigured between:

a first configuration in which the piston chamber is in pressure communication with the first pressure region and isolated from a second pressure region to permit the piston to move in a first axial direction; and a second configuration in which the piston chamber is isolated from the first pressure region and in pressure communication with the second pressure region to permit the piston to more in a second axial direction opposite the first axial direction, wherein movement of the jarring piston in at least one of the first and second axial directions generates an applied force within the apparatus and/or an applied force output from the apparatus.

The apparatus may comprise or take the form of a jarring apparatus.

In this respect, the present disclosure may relate to a jarring apparatus, comprising:

a jarring piston axially moveable within a piston chamber;

a rotary valve assembly comprising a first valve port for communicating with a first pressure region and a second valve port for communicating with a second pressure region in pressure communication with first and second pressure regions which in use are exposed to different pressures, the rotary valve assembly being rotatably operated to be cyclically reconfigured between:

a first configuration in which the piston chamber is in pressure communication with the first pressure region and isolated from a second pressure region to permit the jarring piston to move in a first axial direction; and a second configuration in which the piston chamber is isolated from the first pressure region and in pressure communication with the second pressure region to permit the jarring piston to more in a second axial direction opposite the first axial direction, wherein movement of the jarring piston in at least one of the first and second axial directions generates a jarring force within the apparatus.

Alternatively, the apparatus may comprise or take the form of a hammer apparatus.

Alternatively, the apparatus may comprise or take the form of a reciprocator apparatus.

Another aspect of the present disclosure relates to a reciprocating drive apparatus, comprising:

an axially moveable piston mounted within a piston housing to define first and second piston chambers isolated by a piston sealing arrangement;

a rotary valve assembly being rotatably operated to be cyclically reconfigured between:

a first configuration in which the first piston chamber is in pressure communication with a first pressure region to establish a first pressure differential between the first and second piston chambers and isolated from a second pressure region to permit the piston to move in a first axial direction; and a second configuration in which the piston chamber is isolated from the first pressure region and in pressure communication with the second pressure region to permit the piston to more in a second axial direction opposite the first axial direction, wherein movement of the piston in at least one of the first and second axial directions generates an applied force within the apparatus and/or an applied force output from the apparatus.

The apparatus may comprise or take the form of a jarring apparatus.

In this respect, the present disclosure may relate to a jarring apparatus, comprising:

an axially moveable jarring piston mounted within a piston housing to define first and second piston chambers isolated by a piston sealing arrangement;

a rotary valve assembly being rotatably operated to be cyclically reconfigured between:

a first configuration in which the first piston chamber is in pressure communication with a first pressure region to establish a first pressure differential between the first and second piston chambers and isolated from a second pressure region to permit the jarring piston to move in a first axial direction; and a second configuration in which the piston chamber is isolated from the first pressure region and in pressure communication with the second pressure region to permit the jarring piston to more in a second axial direction opposite the first axial direction, wherein movement of the jarring piston in at least one of the first and second axial directions generates a jarring force within the apparatus.

Alternatively, the apparatus may comprise or take the form of a hammer apparatus.

Alternatively, the apparatus may comprise or take the form of a reciprocator apparatus.

Another aspect of the present disclosure relates to a reciprocating drive apparatus, comprising:

a piston axially moveable within a piston chamber;

a rotary valve assembly being rotatably operated to be cyclically reconfigured between:

a first configuration in which the piston chamber is in pressure communication with a first pressure region and isolated from a second pressure region to permit the piston to move in a first axial direction; and a second configuration in which the piston chamber is isolated from the first pressure region and in pressure communication with the second pressure region to permit the piston to more in a second axial direction opposite the first axial direction, wherein movement of the piston in at least one of the first and second axial directions generates an applied force within the apparatus and/or an applied force output from the apparatus.

The apparatus may comprise or take the form of a jarring apparatus.

In this respect, the present disclosure may relate to a jarring apparatus, comprising:

a jarring piston axially moveable within a piston chamber;

a rotary valve assembly being rotatably operated to be cyclically reconfigured between:

a first configuration in which the piston chamber is in pressure communication with a first pressure region and isolated from a second pressure region to permit the jarring piston to move in a first axial direction; and a second configuration in which the piston chamber is isolated from the first pressure region and in pressure communication with the second pressure region to permit the jarring piston to more in a second axial direction opposite the first axial direction, wherein movement of the jarring piston in at least one of the first and second axial directions generates a jarring force within the apparatus.

Alternatively, the apparatus may comprise or take the form of a hammer apparatus.

Alternatively, the apparatus may comprise or take the form of a reciprocator apparatus.

Another aspect of the present disclosure relates to a reciprocating drive apparatus, comprising:

a piston chamber;

a piston axially moveable within the piston chamber;

a control flow path extending between first and second pressure regions and being in pressure communication with the piston chamber;

a rotary valve assembly mounted within the control flow path and being rotatable to be cyclically reconfigured between:

a first configuration in which the piston chamber is in pressure communication with the first pressure region and isolated from the second pressure region to permit the piston to move in a first axial direction; and a second configuration in which the piston chamber is isolated from the first pressure region and in pressure communication with the second pressure region to permit the piston to more in a second axial direction opposite the first axial direction, wherein movement of the piston in at least one of the first and second axial directions generates an applied force within the apparatus and/or an applied force output from the apparatus.

The apparatus may comprise or take the form of a jarring apparatus.

In this respect, the present disclosure may relate to a jarring apparatus, comprising:

a piston chamber;

a jarring piston axially moveable within the piston chamber;

a control flow path extending between first and second pressure regions and being in pressure communication with the piston chamber;

a rotary valve assembly mounted within the control flow path and being rotatable to be cyclically reconfigured between:

a first configuration in which the piston chamber is in pressure communication with the first pressure region and isolated from the second pressure region to permit the jarring piston to move in a first axial direction; and a second configuration in which the piston chamber is isolated from the first pressure region and in pressure communication with the second pressure region to permit the jarring piston to more in a second axial direction opposite the first axial direction, wherein movement of the jarring piston in at least one of the first and second axial directions generates a jarring force within the apparatus.

Alternatively, the apparatus may comprise or take the form of a hammer apparatus.

Alternatively, the apparatus may comprise or take the form of a reciprocator apparatus.

The apparatus or any aspect defined herein, or any individual component or groups of components, may be manufactured in any suitable manner. In some examples the disclosed apparatus, or any individual component or groups of components may be manufactured by additive manufacturing. Such described additive manufacturing typically involves processes in which components are fabricated based on three-dimensional (3D) information, for example a three-dimensional computer model (or design file), of the component.

Accordingly, examples described herein not only include the apparatus and associated components, but also methods of manufacturing the apparatus or associated components via additive manufacturing and computer software, firmware or hardware for controlling the manufacture of the apparatus and associated components via additive manufacturing. All future reference to "product" are understood to include the described apparatus and all associated components.

The structure of the product may be represented digitally in the form of a design file. A design file, or computer aided design (CAD) file, is a configuration file that encodes one or more of the surface or volumetric configuration of the shape of the product. That is, a design file represents the geometrical arrangement or shape of the product.

Design files may take any now known or later developed file format. For example, design files may be in the Stereolithography or "Standard Tessellation Language" (.stl) format which was created for stereolithography CAD programs of 3D Systems, or the Additive Manufacturing File (.amf) format, which is an American Society of Mechanical Engineers (ASME) standard that is an extensible markup-language (XML) based format designed to allow any CAD software to describe the shape and composition of any three-dimensional object to be fabricated on any additive manufacturing printer.

Further examples of design file formats include AutoCAD (.dwg) files, Blender (.blend) files, Parasolid (.x_t) files, 3D Manufacturing Format (.3mf) files, Autodesk (3ds) files, Collada (.dae) files and Wavefront (.obj) files, although many other file formats exist.

Design files may be produced using modelling (e.g. CAD modelling) software and/or through scanning the surface of a product to measure the surface configuration of the product.

Once obtained, a design file may be converted into a set of computer executable instructions that, once executed by a processer, cause the processor to control an additive manufacturing apparatus to produce a product according to the geometrical arrangement specified in the design file. The conversion may convert the design file into slices or layers that are to be formed sequentially by the additive manufacturing apparatus. The instructions (otherwise known as geometric code or "G-code") may be calibrated to the specific additive manufacturing apparatus and may specify the precise location and amount of material that is to be formed at each stage in the manufacturing process. The formation may be through deposition, through sintering, or through any other form of additive manufacturing method.

The code or instructions may be translated between different formats, converted into a set of data signals and transmitted, received as a set of data signals and converted to code, stored, etc., as necessary. The instructions may be an input to the additive manufacturing system and may come from a part designer, an intellectual property (IP) provider, a design company, the operator or owner of the additive manufacturing system, or from other sources. An additive manufacturing system may execute the instructions to fabricate the product using any of the technologies or methods disclosed herein.

Design files or computer executable instructions may be stored in a (transitory or non-transitory) computer readable storage medium (e.g., memory, storage system, etc.) storing code, or computer readable instructions, representative of the product to be produced. As noted, the code or computer readable instructions defining the product that may be used to physically generate the object, upon execution of the code or instructions by an additive manufacturing system. For example, the instructions may include a precisely defined 3D model of the product and may be generated from any of a large variety of well-known computer aided design (CAD) software systems such as AutoCAD®, TurboCAD®, DesignCAD 3D Max, etc. Alternatively, a model or prototype of the component may be scanned to determine the three-dimensional information of the component.

Accordingly, by controlling an additive manufacturing apparatus according to the computer executable instructions, the additive manufacturing apparatus may be instructed to print out the product.

In light of the above, examples include methods of manufacture via additive manufacturing. This includes the steps of obtaining a design file representing the product and instructing an additive manufacturing apparatus to manufacture the product in assembled or unassembled form according to the design file. The additive manufacturing apparatus may include a processor that is configured to automatically convert the design file into computer executable instructions for controlling the manufacture of the product. In these examples, the design file itself may automatically cause the production of the product once input into the additive manufacturing device. Accordingly, in this examples, the design file itself may be considered computer executable instructions that cause the additive manufacturing apparatus to manufacture the product. Alternatively, the design file may be converted into instructions by an external computing system, with the resulting computer executable instructions being provided to the additive manufacturing device.

Given the above, the design and manufacture of implementations of the subject matter and the operations described in this specification may be realised using digital electronic circuitry, or in computer software, firmware, or hardware, including the structures disclosed in this specification and their structural equivalents, or in combinations of one or more of them. For instance, hardware may include processors, microprocessors, electronic circuitry, electronic components, integrated circuits, etc. Implementations of the subject matter described in this disclosure may be realised using one or more computer programs, i.e., one or more modules of computer program instructions, encoded on computer storage medium for execution by, or to control the operation of, data processing apparatus. Alternatively or in addition, the program instructions may be encoded on an artificially generated propagated signal, e.g., a machine-generated electrical, optical, or electromagnetic signal that is generated to encode information for transmission to suitable receiver apparatus for execution by a data processing apparatus. A computer storage medium may be, or be included in, a computer-readable storage device, a computer-readable storage substrate, a random or serial access memory array or device, or a combination of one or more of them. Moreover, while a computer storage medium is not a propagated signal, a computer storage medium may be a source or destination of computer program instructions encoded in an artificially generated propagated signal. The computer storage medium may also be, or be included in, one or more separate physical components or media (e.g., multiple CDs, disks, or other storage devices).

Although additive manufacturing technology is described herein as enabling fabrication of complex objects by building objects point-by-point, layer-by-layer, typically in a vertical direction, other methods of fabrication are possible and within the scope of the present subject matter. For example, although the discussion herein refers to the addition of material to form successive layers, one skilled in the art will appreciate that the methods and structures disclosed herein may be practiced with any additive manufacturing technique or other manufacturing technology.

The invention is defined by the appended claims. However, for the purposes of the present disclosure it will be understood that any of the features defined above or described below may be utilised in isolation or in combination. For example, features described above in relation to one of the above aspects or below in relation to the detailed description below may be utilised in any other aspect, or together form a new aspect.

BRIEF DESCRIPTION OF THE DRAWINGS

These and other aspects will now be described with reference to the accompanying drawings, in which.

DETAILED DESCRIPTION OF THE DRAWINGS

Figure 1:
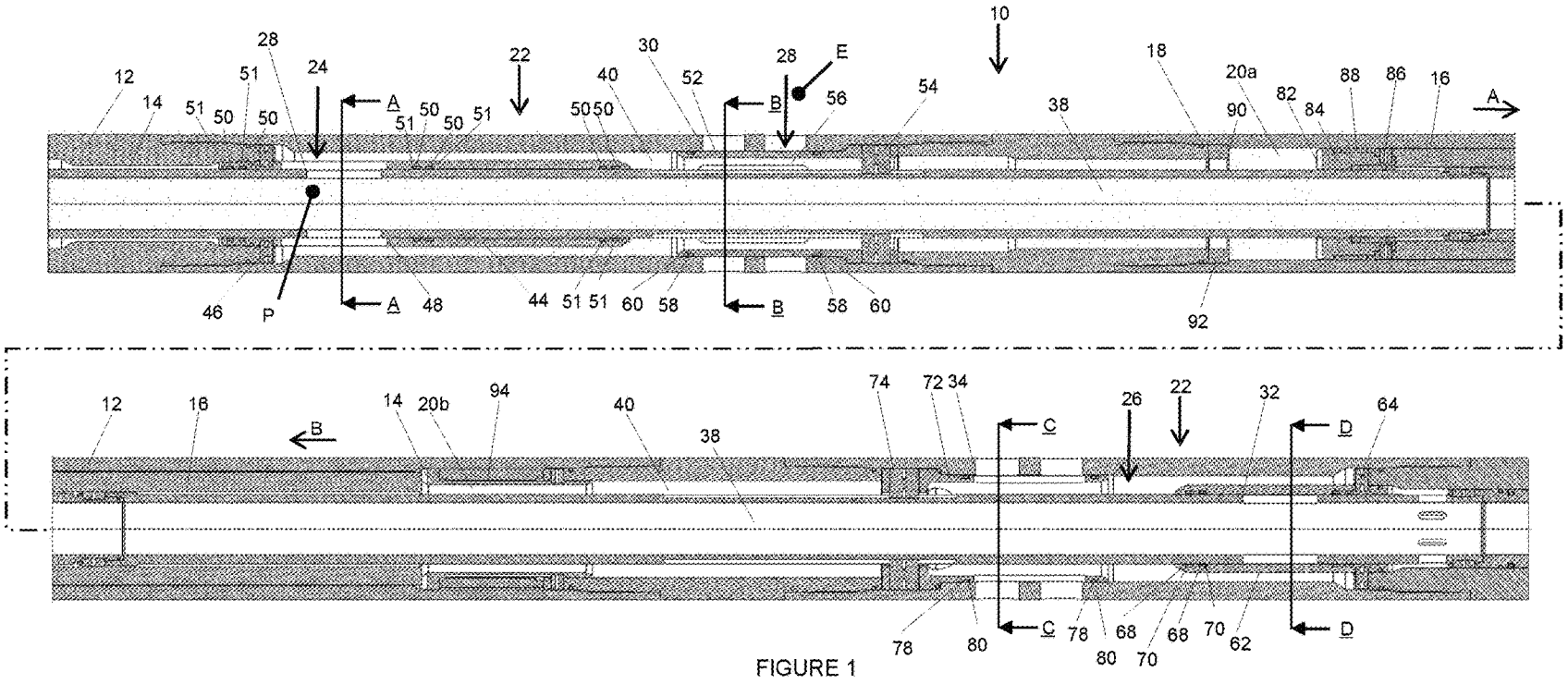
FIG. 1 shows a longitudinal sectional view of a reciprocating drive apparatus in the form of a jarring apparatus.

Referring first to FIG. 1 of the accompanying drawings, there is a jarring apparatus 10 for generating jarring forces.

In use, the jarring apparatus 10 may be utilised to generate jarring forces for use in a range of different downhole applications. For example, the jarring apparatus 10 may be utilised to generate jarring forces to a stuck object, such as a stuck tool, drill bit, drill string, bottom hole assembly (BHA) and the like. Alternatively or additionally, the jarring apparatus 10 may be utilised to generate jarring forces during the process of drilling, for example to apply a hammer drilling effect. The jarring apparatus 10 may also be operable to generate jarring forces for use in pulling equipment, tools and infrastructure from a wellbore, for example in the process of removing casing, and/or for other downhole jarring applications such as piling, for example. It will be recognised that while the jarring apparatus 10 is particularly beneficial in downhole applications (which pose particular challenges due to the need to manipulate equipment at significant distance from surface, e.g. several kilometres, and in the case of high angle or horizontal wells with restricted ability to apply forces in the non-vertical section) the jarring apparatus 10 may be utilised in a range of different applications and environments.

Referring now also to FIGS. 2 to 5 which show cross-sectional views A-A, B-B, C-C and D-D of the jarring apparatus 10, the jarring apparatus 10 comprises a housing 12 and a mandrel 14. The mandrel 14 is mounted within the housing 12, the mandrel 14 and the housing 12 configurable to be rotated relative to each other. The jarring apparatus 10 further comprises a jarring piston 16 mounted within a piston housing 18 to define first and second piston chambers 20*a*,20*b*. The jarring piston 16 is moveable within the first and second piston chambers 20*a*,20*b* in reverse first and second axial directions A, B.

The jarring apparatus 10 further comprises a rotary valve arrangement, generally denoted 22. As shown in FIG. 1, the rotary valve arrangement 22 comprises a first, upper, valve assembly, generally denoted 24, and a second, lower, valve assembly, generally denoted 26.

The upper rotary valve assembly 24 comprises a valve inlet 28 (which for ease of reference will be referred to below as upper valve inlet 28) for communicating with a pressure region P and a valve exhaust 30 (which for ease of reference will be referred to below as upper valve exhaust 30) for communicating with an exhaust region E.

Figure 3:
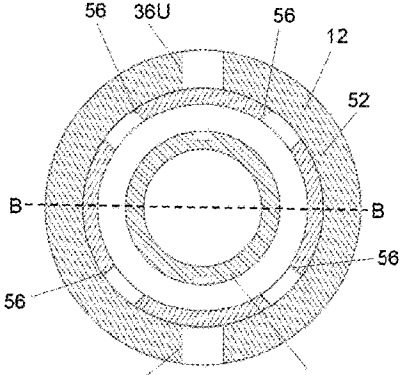
FIG. 3 shows cross-sectional view B-B of the jarring apparatus shown in FIG. 1.
Figure 2:
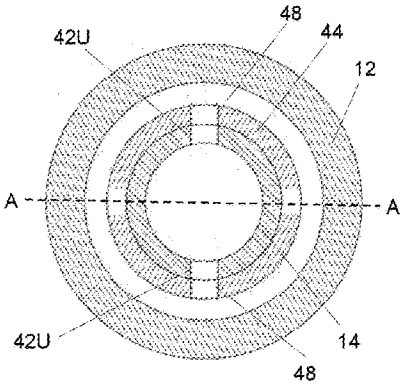
FIG. 2 shows cross-sectional view A-A of the jarring apparatus shown in FIG. 1.

FIG. 2 of the accompanying drawings shows cross section A-A through the upper valve inlet 28 of the jarring apparatus 10. FIG. 3 shows cross section B-B through the upper valve exhaust 30 of the jarring apparatus 10.

The upper rotary valve assembly 24 is operated by relative rotation between the mandrel 14 and the housing 12 to be cyclically reconfigured between: a pressure configuration in which the piston chamber 20*a* is in pressure communication with the upper valve inlet 28 and isolated from the upper valve exhaust 30 to permit the jarring piston 16 to move in the first axial direction A in accordance with the piston chamber 20*a* being pressurised via the upper valve inlet 28; and an exhaust configuration in which the piston chamber 20*a* is isolated from the upper valve inlet 28 and in pressure communication with the upper valve exhaust 30 to permit the piston chamber 20*a* to be depressurised and the jarring piston 16 to move in the second axial direction B. Movement of the jarring piston 16 in at least one of the first and second axial directions A, B generates a jarring force within the jarring apparatus 10, as will be described further below.

The lower rotary valve assembly 26 comprises a valve inlet 32 (which for ease of reference will be referred to below as lower valve inlet 32) which communicates with the pressure region P and a valve exhaust 34 (which for ease of reference will be referred to below as lower valve exhaust 34) for communicating with the exhaust region E.

Figure 4:
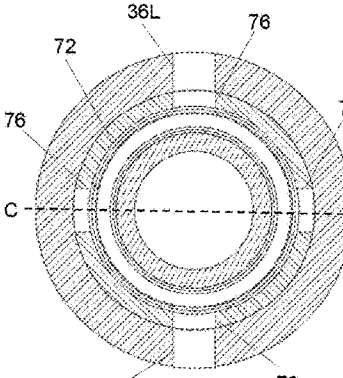
FIG. 4 shows cross-sectional view C-C of the jarring apparatus shown in FIG. 1.
Figure 5:
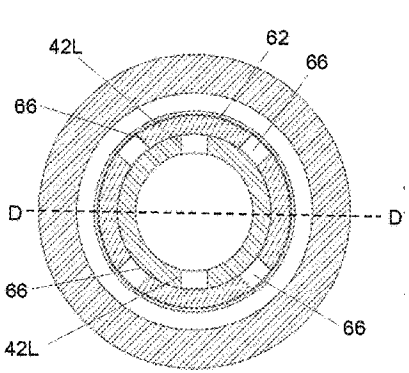
FIG. 5 shows cross-sectional view D-D of the jarring apparatus shown in FIG. 1.

FIG. 4 shows cross section C-C through the lower valve exhaust 34 of the jarring apparatus 10. FIG. 5 shows cross section D-D through the lower valve inlet 32 of the jarring apparatus 10.

The lower rotary valve assembly 26 is operated by relative rotation between the mandrel 14 and the housing 12 to be cyclically reconfigured between: a pressure configuration in which the piston chamber 20*b* is in pressure communication with the lower valve inlet 32 and isolated from the lower valve exhaust 34 to permit the jarring piston 16 to move in the second axial direction B in accordance with the piston chamber 20*b* being pressurised via the lower valve inlet 32; and an exhaust configuration in which the piston chamber 20*b* is isolated from the lower valve inlet 32 and in pressure communication with the lower valve exhaust 34 to permit the piston chamber 20*b* to be depressurised and the jarring piston 16 to move in the first axial direction A.

It will be recognised that in the illustrated jarring apparatus 10, the upper rotary valve assembly 24 and the lower rotary valve assembly 26 may be configured to co-operate, with the pressure configuration of the upper rotary valve assembly 24 coinciding with the exhaust configuration of the lower rotary valve assembly 26.

While in the illustrated apparatus 10, the rotary valve arrangement 22 comprises two valve assemblies 24, 26, the rotary valve arrangement 22 may comprise a single valve assembly 24;26 (an example of which is described below with reference to FIGS. 25 and 26).

In use, movement of the jarring piston 16 in the first and second axial directions A, B generates jarring forces within the apparatus 10 as will be described further below.

Continued relative rotation between the housing 12 and the mandrel 14 operates the rotary valve arrangement 22 to cause the piston chambers 20*a*,20*b* to be cyclically pressurised and depressurised to permit reciprocating movement of the jarring piston 16 to generate repeated jarring forces within the apparatus 10. As jarring forces are generated by relative rotation between the mandrel 14 and the housing 12, the illustrated jarring apparatus 10 may be defined as a rotary jarring apparatus 10.

The frequency of generated jarring forces will be a function of the number and/or configuration of ports of the rotary valve arrangement 22 and the relative rotational speed between the mandrel 14 and the housing 12, which may be infinitely variable to thus provide infinite variability of the jarring frequency, providing significant advantages.

Moreover, as jarring forces are generated as a result of fluid pressure, the illustrated jarring apparatus 10 may be defined as a fluid actuated jarring apparatus 10, for example a hydraulically actuated jarring apparatus 10, the jarring apparatus 10 providing an alternative solution to jarring apparatus in which a jarring mass (e.g., hammer) is displaced using a mechanical system, such as a cam system which may need to accommodate significant loading and wear tolerance and thus may present difficult design challenges. Further, by using fluid pressure the magnitude of jarring forces may be readily varied, at least in some implementations, by varying fluid pressure without necessarily requiring the same considerations around the force limitations of mechanical displacement systems.

In use, the jarring apparatus 10 is used in combination with the pressure and exhaust regions P,E such that a pressure differential is applied across the rotary valve arrangement 22. Specifically, the pressure within the pressure region P is elevated above the pressure in the exhaust region E. In particular, the pressure within the pressure region P is sufficient (for example sufficiently high) to pressurise the piston chamber 20*a* to permit the jarring piston 16 to move in the first axial direction A (to the right as shown in FIG. 1), and the pressure within the exhaust region E is sufficient (for example sufficiently low) to permit the piston chamber 20*a* to be depressurised and the jarring piston 16 to move in the second axial direction B (to the left as shown in FIG. 1).

The jarring apparatus 10 is configured to operate irrespective of the direction of the pressure differential applied across the rotary valve arrangement 22. As an example, in one mode of operation, suggested above, the pressure of the pressure region P is higher than the pressure of the exhaust region E. However, should the pressure differential be reversed then what was previously the pressure region P becomes the exhaust region E, and vice versa, and what was previously the valve inlet becomes the valve exhaust, and vice versa.

In this respect, it should be recognised that the valve inlet and the pressure region P, and valve exhaust and exhaust region E, may be defined as such in accordance with the direction of an applied pressure differential applied across the rotary valve arrangement 22. With this in mind, although features will be defined herein as relating to the valve inlet and valve exhaust (and pressure and exhaust regions P,E), this is done so for clarity and brevity purposes and it should be understood that the function and thus identity of the valve inlet and valve exhaust (and pressure and exhaust regions P,E) could switch depending on the operational conditions.

Similarly, it should be recognised that the terms upper and lower, uphole and downhole, up and down and the like are for ease of reference since the jarring apparatus 10 may be used in any orientation. The term upper or uphole may for example but not exclusively be considered as proximal and the term lower may for example but not exclusively be considered to represent distal.

This ability for the jarring apparatus 10 to operate irrespective of the direction of the pressure differential applied across the rotary valve arrangement 22 is possible without requiring an operator to undertake any modification to the apparatus 10, for example modifications in-situ or by recovery and re-deploying, which may be complex and time consuming.

The ability for the jarring apparatus 10 to be employed irrespective of the direction of the pressure differential applied across the rotary valve arrangement 22 provides significant advantages. For example, this arrangement could provide contingency in the event that the ability to establish a pressure differential in one direction becomes compromised, for example where one of the pressure and exhaust regions suffers a failure preventing pressure to be elevated therein to the required level. Further, the flexibility of the jarring apparatus 10 to function irrespective of the direction of the pressure differential may provide advantages in allowing the same jarring apparatus 10 to be used in multiple different applications where a particular pressure differential direction is preferred.

As described above, the jarring apparatus 10 comprises housing 12 and mandrel 14 mounted within the housing 12. The mandrel 14 is rotatably and axially coupled to the housing 12. It will be understood that reference to relative rotation between the housing 12 and the mandrel 14 may include the jarring apparatus 10 being configured such that: the mandrel 14 rotates while the housing 12 is stationary; such that the housing 12 rotates while the mandrel 14 is stationary; or such that the mandrel 14 and the housing 12 both rotate. Beneficially, this facilitates flexibility in that jarring operations may be carried out in a number of different operational scenarios.

As shown in FIG. 1, the housing 12 is disposed around the mandrel 14 and is generally tubular in construction. In the illustrated jarring apparatus 10, the housing 12 comprises a plurality of components coupled together. Construction of the housing 12 in such a manner facilitate ease of manufacture and assembly. However, it will be recognised that the housing 12 may alternatively comprise a single component.

The housing 12 comprises one or more lateral flow passages 36U,36L in the form of flow ports through a circumferential wall of the housing 12, the lateral flow passages 36U forming the upper valve exhaust 30 and the lateral flow passages 36L forming the lower valve exhaust 34. In the illustrated jarring apparatus 10, the lateral flow passages 36U,36L are arranged circumferentially and axially.

The lateral flow passages 36U,36L straddle the piston housing 18, with a plurality of the lateral flow passages 36U,36L being disposed at a first, uphole, location relative to the piston housing 18 and a plurality of the lateral flow passage 36U,36L being disposed at a second, downhole, location relative to the piston housing 18.

The mandrel 14 is generally tubular in construction and defines an axial throughbore 38 of the jarring apparatus 10. The axial throughbore 38 is configured, i.e., shaped and/or dimensioned, to permit passage of fluid and/or tools through the jarring apparatus 10.

Beneficially, the jarring apparatus 10 may form part of a tool string and so the ability to permit passage of fluid and/or tools through the jarring apparatus 10 facilitates access through the jarring apparatus 10, for example to operate tools positioned downhole of the jarring apparatus 10.

In the illustrated jarring apparatus 10, the mandrel 14 comprises a plurality of components coupled together by a coupling arrangement. Construction of the mandrel 14 in such a manner facilitates ease of manufacture and assembly. However, it will be recognised that the mandrel 14 may alternatively comprise a single component.

As shown in FIG. 1, the mandrel 14 and the housing 12 are configured, e.g. shaped and/or dimensioned, so as to define an axial flow passage 40 therebetween, which in the illustrated jarring apparatus 10 is annular.

The mandrel 14 comprises one or more lateral flow passages 42U,42L in the form of flow ports through a circumferential wall of the mandrel 14, the lateral flow passages 42U forming the upper valve inlet 28 and the lateral flow passages 42L forming the lower valve inlet 32. In the illustrated jarring apparatus 10, the lateral flow passages 42 are arranged circumferentially and axially.

The lateral flow passages 42U,42L straddle the piston housing 18, with two of the lateral flow passages 42U being disposed at a first, uphole, location relative to the piston housing 18 and two of the lateral flow passages 42L being disposed at a second, downhole, location relative to the piston housing 18.

An upper portion of the axial flow passage 40 provides fluid communication between the upper valve inlet 28, the upper valve exhaust 30 and the upper piston chamber 20*a*, although as will be described below the upper valve assembly 24 is configured to provide selective fluid communication either between the upper valve inlet 28 and the upper piston chamber 20*a* via the axial flow passage 40 or between the upper valve exhaust and the piston chamber 20*a* via the axial flow passage 40.

A lower portion of the axial flow passage 40 provides fluid communication between the lower valve inlet 32, the lower valve exhaust 34 and the lower piston chamber 20*b*, although as will be described below the lower valve assembly 26 is configured to provide selective fluid communication either between the lower valve inlet 32 and the lower piston chamber 20*b* via the axial flow passage 40 or between the lower valve exhaust 34 and the piston chamber 20*b* via the axial flow passage 40.

As shown in FIGS. 1 and 2, the upper rotary valve assembly 24 comprises a rotary valve member 44 operatively associated with the upper valve inlet 28. In the illustrated jarring apparatus 10, the rotary valve member 44 takes the form of an inlet selector sleeve. The rotary valve member 44 and the upper valve inlet 28 are configured for relative rotation to each other such that rotation causes the rotary valve member 44 to selectively block or obturate the upper valve inlet 28. That is, during one phase of relative rotation, the valve inlet 28 defines an open configuration in which pressure communication with the piston chamber 20*a* is permitted and in another phase the valve inlet 28 defines the closed configuration in which pressure communication with the piston chamber 20*a* is prevented, substantially prevented or obturated.

In the illustrated jarring apparatus 10, the rotary valve member 44 is rotatably fixed relative to the housing 12 by a key arrangement 46.

As shown in FIGS. 1 and 2, the rotary valve member 44 comprises a number of lateral flow passages 48, which in the illustrated apparatus 10 take the form of elongate slots disposed through the rotary valve member 44. Seal elements 50 in the form of rotary seal elements are disposed in annular grooves 51 provided on an inner circumferential surface of the rotary valve member 44. As shown, the seal elements 50 straddle the lateral flow passages 48 and provide sealing between the rotary valve member 44 and the mandrel 14.

As shown in FIGS. 1 and 3, the upper rotary valve assembly 24 comprises a rotary valve member 52 operatively associated with the upper valve exhaust 30. In the illustrated jarring apparatus 10, the rotary valve member 52 takes the form of an outlet selector sleeve. The rotary valve member 52 and the upper valve exhaust 30 are configured for relative rotation to each other such that rotation causes the rotary valve member 52 to selectively block or obturate the upper valve exhaust 30. That is, during one phase of relative rotation, the upper valve exhaust 30 defines an open configuration in which pressure communication with the upper piston chamber 20*a* is permitted. In another phase, the upper valve exhaust 30 defines the closed configuration in which pressure communication with the upper piston chamber 20*a* is prevented, substantially prevented or obturated.

In the illustrated jarring apparatus 10, the rotary valve member 52 is rotatably fixed relative to the mandrel 14 by a key arrangement 54.

As shown in FIGS. 1 and 3, the rotary valve member 52 comprises a number of lateral flow passages 56, which in the illustrated apparatus 10 take the form of elongate slots disposed through the rotary valve member 52. Seal elements 58 in the form of rotary seal elements are disposed in annular grooves 60 provided on an outer circumferential surface of the rotary valve member 52. As shown, the seal elements 58 straddle the lateral flow passages 56 and provide sealing between the rotary valve member 52 and the housing 12.

In a similar arrangement to that described above with respect to the upper rotary valve assembly 24, the lower rotary valve assembly 26 comprises a rotary valve member 62 operatively associated with the lower valve inlet. In the illustrated jarring apparatus 10, the rotary valve member 62 takes the form of an inlet selector sleeve. The rotary valve member 62 and the lower valve inlet 32 are configured for relative rotation to each other such that rotation causes the rotary valve member 62 to selectively block or obturate the lower valve inlet 32. That is, during one phase of relative rotation, the lower valve inlet 32 defines an open configuration in which pressure communication with the lower piston chamber 20*b* is permitted. In another phase, the lower valve inlet 32 defines a closed configuration in which pressure communication with the lower piston chamber 20*b* is prevented, substantially prevented or obturated.

In the illustrated jarring apparatus 10, the rotary valve member 62 is rotatably fixed relative to the housing 12 by fasteners 64.

As shown in FIGS. 1 and 5, the rotary valve member 62 comprises a number of lateral flow passages 66, which in the illustrated apparatus 10 take the form of elongate slots disposed through the rotary valve member 62. Seal elements 68 in the form of rotary seal elements are disposed in annular grooves 70 provided on an inner circumferential surface of the rotary valve member 62. As shown, the seal elements 68 straddle the lateral flow passages 66 and provide sealing between the rotary valve member 62 and the mandrel 14.

As shown in FIGS. 1 and 4, the lower rotary valve assembly 26 comprises a rotary valve member 72 operatively associated with the lower valve exhaust 34. In the illustrated jarring apparatus 10, the rotary valve member 72 takes the form of an outlet selector sleeve. The rotary valve member 72 and the lower valve exhaust 34 are configured for relative rotation to each other such that rotation causes the rotary valve member 72 to selectively block or obturate the lower valve exhaust 34. That is, during one phase of relative rotation, the lower valve exhaust 34 defines an open configuration in which pressure communication with the upper piston chamber 20*b* is permitted. In another phase, the lower valve exhaust 34 defines a closed configuration in which pressure communication with the lower piston chamber 20*b* is prevented, substantially prevented or obturated.

In the illustrated jarring apparatus 10, the rotary valve member 72 is rotatably fixed relative to the mandrel 14 by a key arrangement 74.

As shown in FIGS. 1 and 4, the rotary valve member 72 comprises a number of lateral flow passages 76, which in the illustrated apparatus 10 take the form of elongate slots disposed through the rotary valve member 72. Seal elements 78 in the form of rotary seal elements are disposed in annular grooves 80 provided on an outer circumferential surface of the rotary valve member 72. As shown, the seal elements 78 straddle the lateral flow passages 76 and provide sealing between the rotary valve member 72 and the housing 12.

As described above, the jarring piston 16 is mounted within the piston housing 18 to define the piston chambers 20*a*,20*b*, the jarring piston 16 being moveable in the reverse first and second axial directions A,B.

The jarring apparatus 10 comprises co-operating impact surfaces, wherein engagement of the impact surfaces results in the generation of the jarring forces.

A first impact surface 82 is provided on the jarring piston 16, and more particularly on an axial end face of a hammer 84 coupled to and carried by the jarring piston 16. As shown in FIG. 2, the hammer 84 is coupled to the jarring piston 16 by fasteners 86. A seal arrangement 88 is interposed between the hammer 84 and the housing 12 and between the hammer 84 and the mandrel 14.

A second impact surface 90 is formed on an axial end face of an anvil 92. In the illustrated jarring apparatus 10, the anvil 92 takes the form of a separate component and is disposed in and carried by the housing 12.

In use, the upper rotary valve assembly 24 is operable by relative rotation between the mandrel 14 and the housing 12 to be cyclically reconfigured between the pressure configuration and the exhaust configuration, so as to move the jarring piston 16 in one of the first and second axial directions A,B, said movement of the jarring piston 16 engaging the first and second impact surfaces 82,90 to generate the jarring forces within the apparatus 10.

As shown in FIG. 1, movement of the jarring piston 16 in the first axial direction A (to the right as shown in FIG. 2) is limited by an end stop 94 which, in the illustrated jarring apparatus 10 takes the form of a rubber buffer element. However, it will be recognised that the end stop 94 may take any suitable form and in some examples may be replaced with a hammer and/or anvil such as described above.

Figure 6:
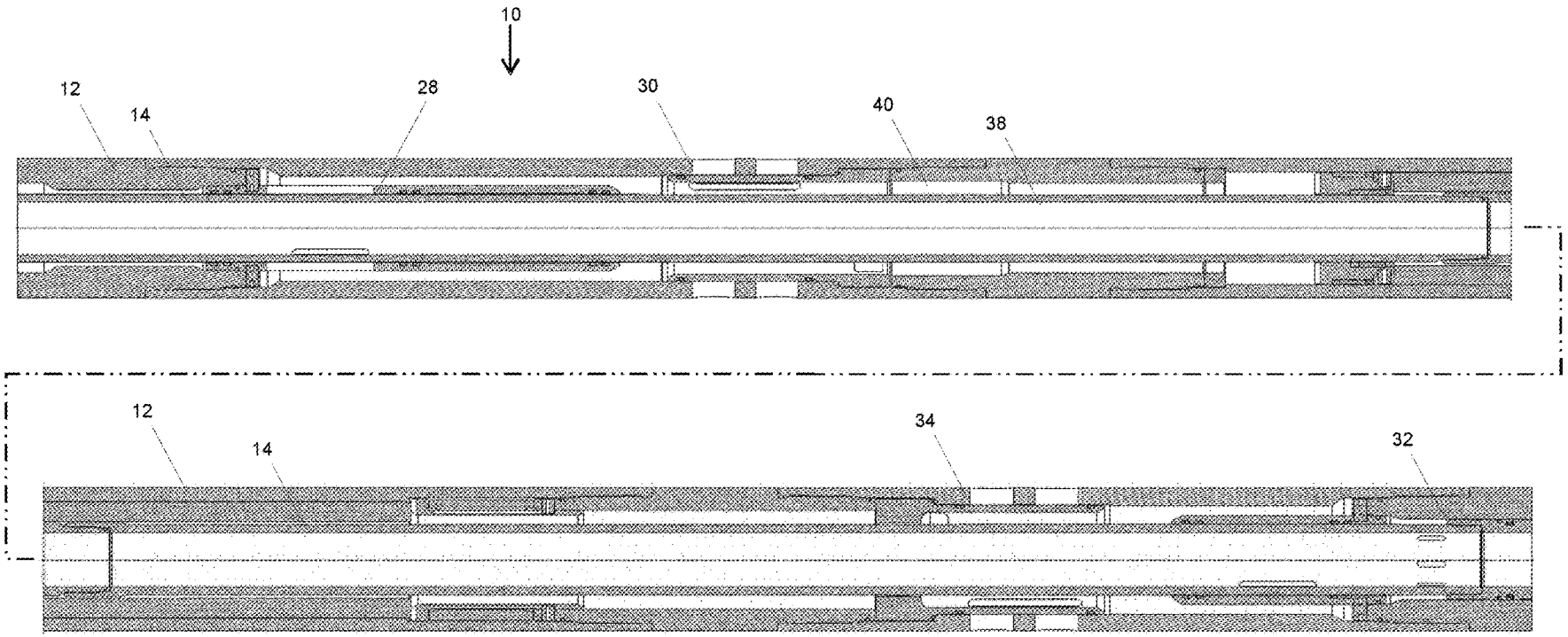
FIG. 6 shows the jarring apparatus shown in FIG. 1, in a first phase of rotation.

Referring now to FIG. 6 of the accompanying drawings, there is shown a longitudinal sectional view of the jarring apparatus 10 in a first configuration corresponding to a first phase of rotation.

As shown in FIG. 6, in the first configuration the upper and lower valve inlets 28, 32 are in their closed configuration such that fluid communication between the axial throughbore 38 and the axial flow passage 40 between the mandrel 14 and the housing 12 is prevented or at least restricted. The upper and lower valve exhausts 30,34 also define their closed configuration such that fluid communication between the axial flow passage 38 and the exhaust region E is prevented or at least restricted.

Figures 7, 8, 9, 10, 11:
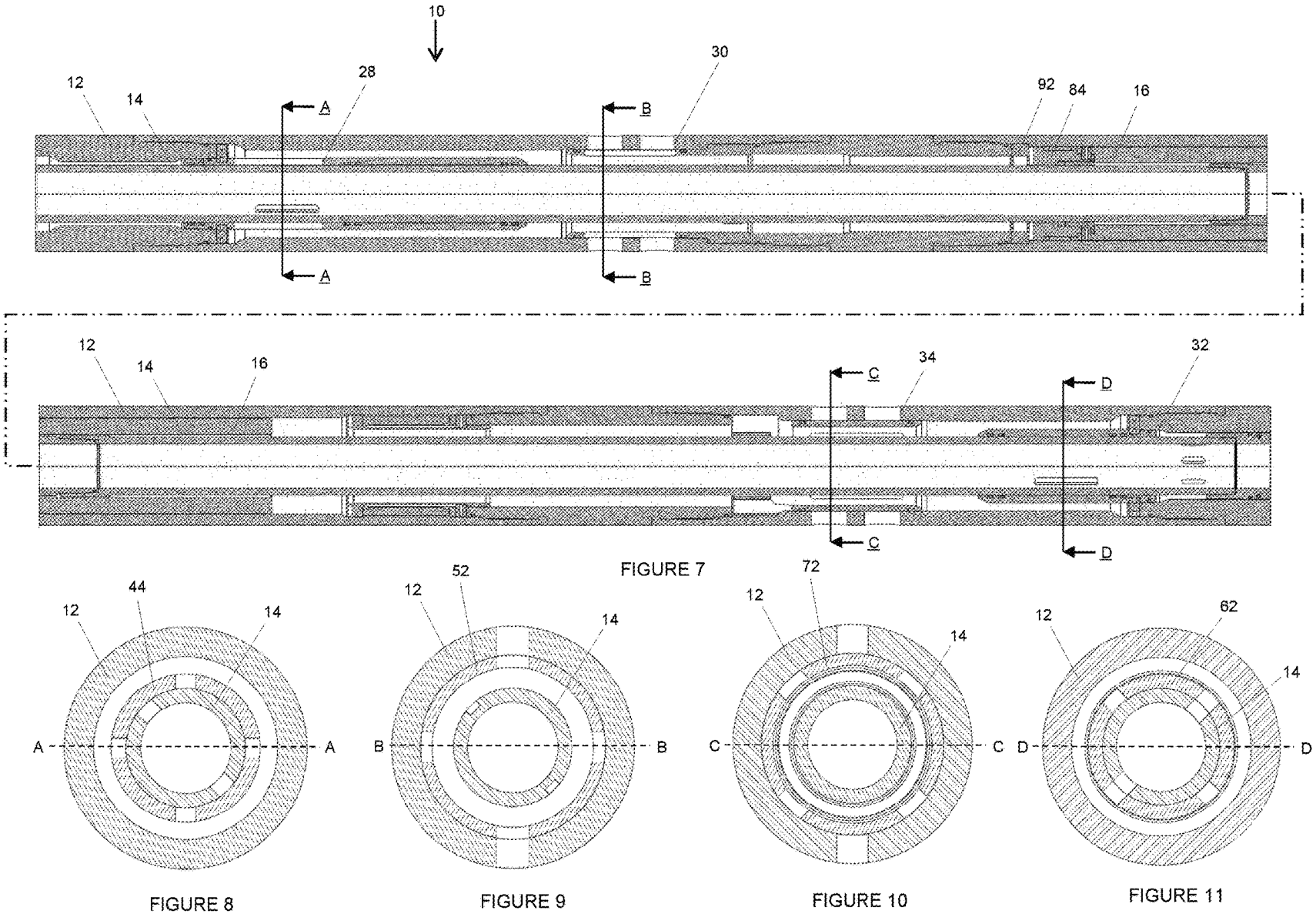
FIG. 7 shows the jarring apparatus shown in FIG. 1, in a second phase of rotation.
FIG. 8 shows cross-sectional view A-A of the jarring apparatus shown in FIG. 7.
FIG. 9 shows cross-sectional view B-B of the jarring apparatus shown in FIG. 7.
FIG. 10 shows cross-sectional view C-C of the jarring apparatus shown in FIG. 7.
FIG. 11 shows cross-sectional view D-D of the jarring apparatus shown in FIG. 7.

FIGS. 7 to 11 of the accompanying drawings shows the jarring apparatus 10 in a second configuration corresponding to a second phase of rotation. FIG. 7 shows a longitudinal sectional view of the apparatus 10 while FIGS. 8 to 11 respectively show cross-sectional views A-A, B-B, C-C and D-D of the upper valve inlet 28, upper valve exhaust 30, lower valve exhaust 34 and lower valve inlet 32 of the jarring apparatus 10.

In this second configuration, the upper valve inlet 28 is in the closed configuration. The upper valve exhaust 30 is in the open configuration. The lower valve inlet 32 is in the open configuration (the open configuration is out of plane and so not shown in FIG. 7 but can be seen in FIG. 11). The lower valve exhaust 34 is in the closed configuration.

In this configuration, and by virtue of the lower valve inlet 32 being in the open configuration, fluid communication is provided between the axial throughbore 38 and the lower piston chamber 20*b* and is thus available to act on the jarring piston 16. By virtue of the upper valve exhaust 30 being in the open configuration, fluid communication is provided between the upper piston chamber 20*a* and the exhaust region E surrounding the jarring apparatus 10.

In use, where the fluid pressure within the axial throughbore 38 is greater than that present in the exhaust region E, a pressure differential acts across the jarring piston 16 which urges the jarring piston 16 in an uphole direction (to the left as shown in FIG. 7). By virtue of the upper valve exhaust 30 being in the open configuration, fluid present in the upper piston chamber 20*a* is vented into the exhaust region E, e.g. annulus surrounding the apparatus 10. The motive force resulting from the pressure differential is significant, causing the jarring piston 16 and the coupled hammer 84 to move rapidly into engagement with the anvil 92 and thereby create a jarring force within the apparatus 10.

Figure 12:
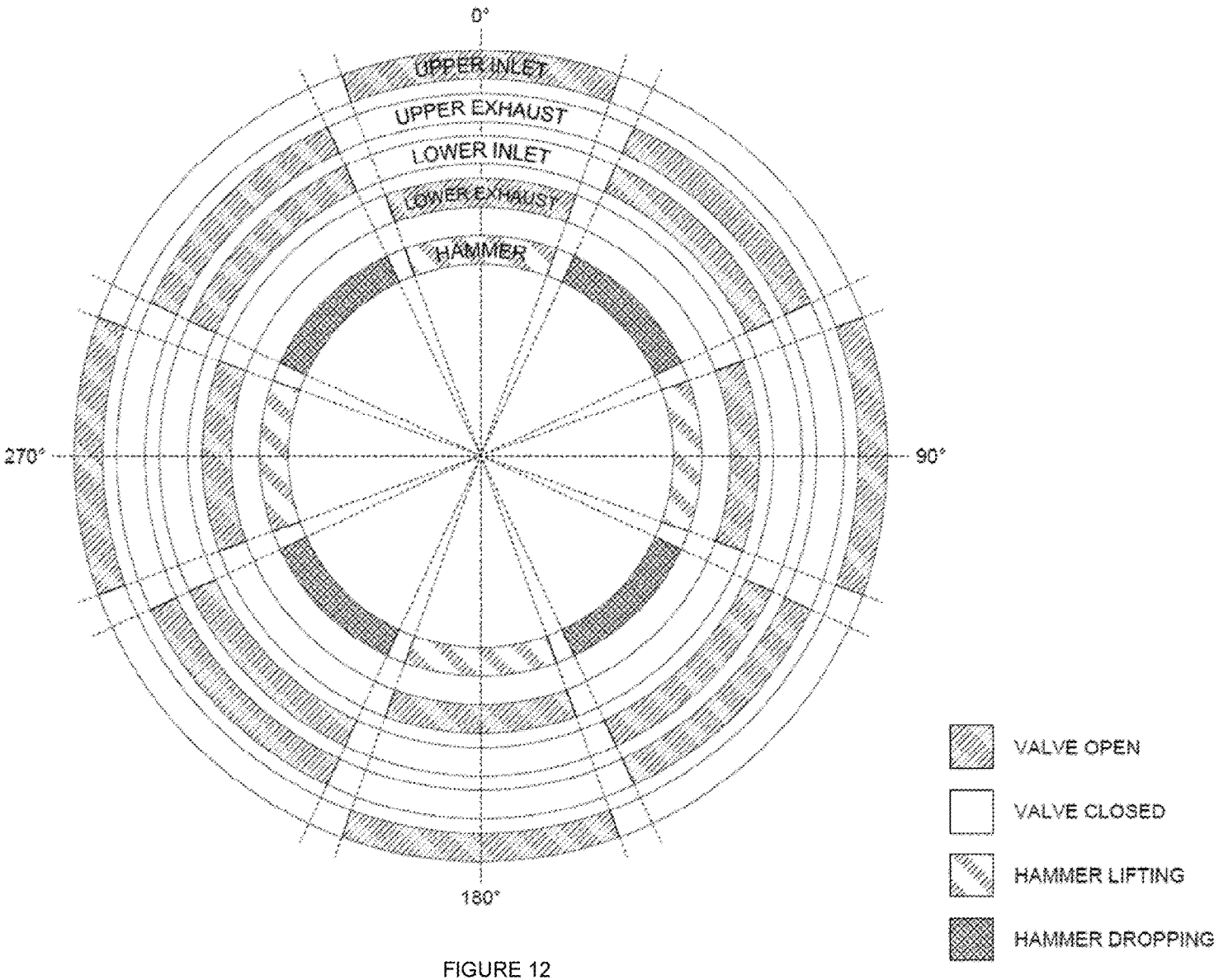
FIG. 12 shows a diagrammatic view of the jarring apparatus showing the relative position and state of components of the apparatus at different angular positions.

As described above, the rotary valve arrangement 22 is operable by relative rotation between the mandrel 14 and the housing 12 to be cyclically reconfigured between the pressure configuration and the exhaust configuration, and FIG. 12 of the accompanying drawings shows a diagrammatic view of the jarring apparatus 10 showing the relative position and state of components of the apparatus 10 at different angular positions, i.e., the open or closed configurations of each of the upper valve inlet 28, the upper valve exhaust 30, the lower valve inlet 32, and the lower valve exhaust 34. The operational state of the jarring piston 16 and hammer 84, i.e. whether the jarring piston 16 is moving in an upward or uphole direction ("lifting") or a downward or downhole direction ("dropping") is also shown relative to angular position in FIG. 12.

Figure 13:
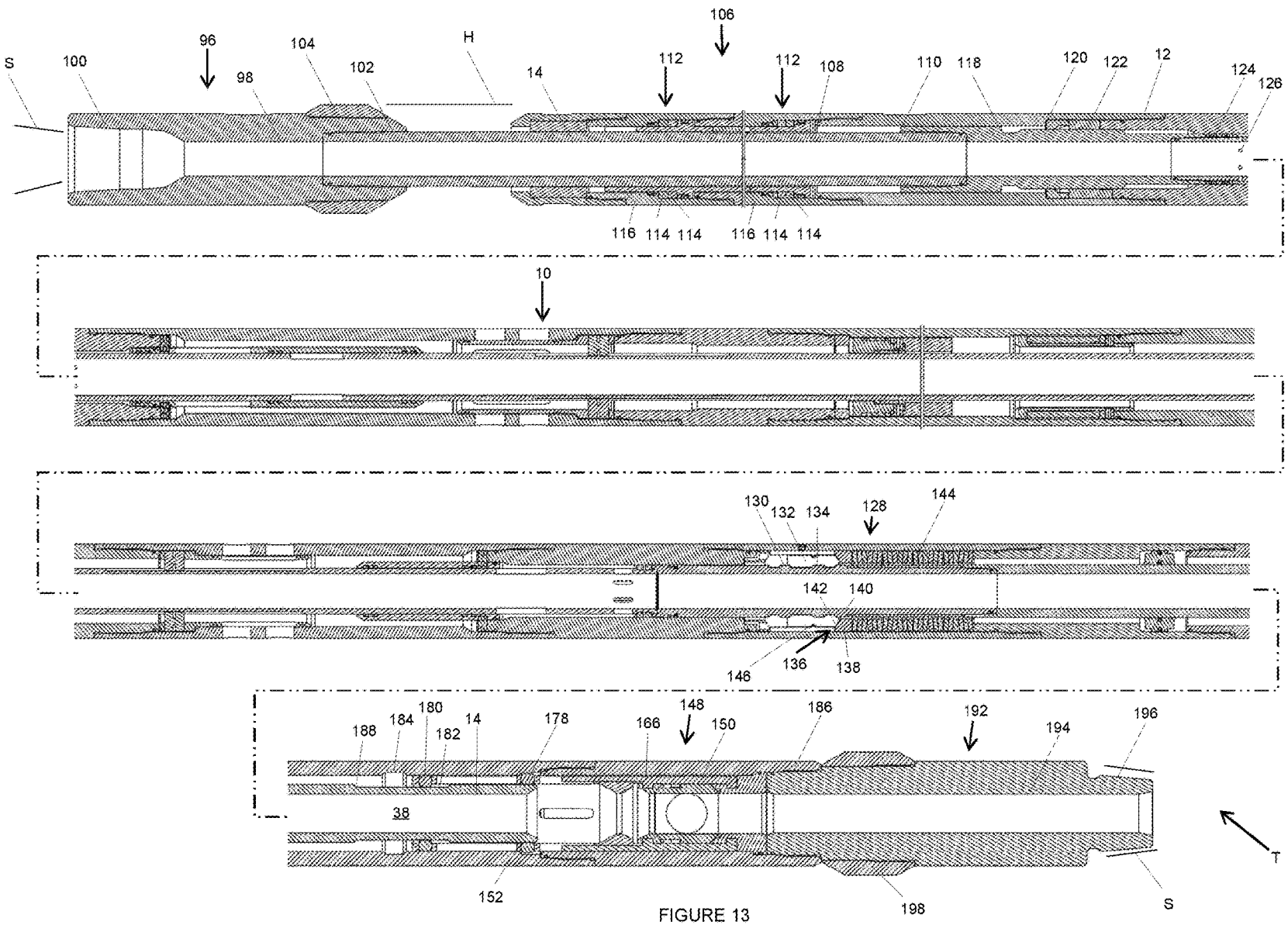
FIG. 13 shows a longitudinal sectional view of a downhole tool comprising the jarring apparatus of FIG. 1, in a first phase of rotation.

Referring now to FIG. 13 of the accompanying drawings, there is shown a longitudinal sectional view of a tool T comprising the jarring apparatus 10. The illustrated tool T takes the form of a downhole tool for generating jarring forces for use in a number of downhole applications. However, it will be recognised that the jarring apparatus 10 (or apparatus 2010,3010,4010 described below) may be utilised with any suitable tool where there is a desire to generate jarring and/or agitation forces.

As shown in FIG. 13, the tool T comprises a top sub 96. The top sub 96 is generally tubular in construction having an axial throughbore 98 extending therethrough. An upper end portion of the top sub 96 defines a connector 100 for coupling the jarring apparatus to another component of the tool string S. In the illustrated tool T, the connector 100 takes the form of a female connector, more specifically a threaded box connector. A lower end portion of the top sub 96 defines a female profile 102 configured to the upper end of the mandrel 14. In the illustrated tool T, the top sub 96 further comprises stabiliser blades 104 for offsetting the tool T from a borehole, generally denoted H.

As shown in FIG. 13, the tool T further comprises a swivel, generally denoted 106. The swivel 106 may comprise a thrust assembly. The swivel 106 is interposed between the mandrel 14 and the housing 12. In the illustrated tool T, the swivel 106 includes a first thrust shoulder 108 provided on the mandrel 14, and a second thrust shoulder 110 provided on the housing 12.

In the configuration shown in FIG. 13, the first and second thrust shoulders 108,110 are axially separated and thus disengaged. However, in use relative axial movement between the mandrel 14 and housing 12 will bring the first and second thrust shoulders 108,110 into engagement, such that axial loading may be transmitted between the mandrel 14 and the housing 12 via the swivel 106, thus diverting such loading from other components within the apparatus 10. The swivel 106 permits rotation between the first and second thrust shoulders 108,110 when engaged, such that the swivel 106 may function as a thrust bearing arrangement.

The swivel 106 comprises a plurality of axially arranged thrust bearing assemblies 112. Beneficially, the thrust bearing assemblies 112 share the axial load force exerted on the swivel 106.

The thrust bearing assemblies 112 each comprise thrust bearings 114. In the illustrated jarring apparatus 10, the thrust bearings 114 take the form of PTFE thrust plain bearings, although it will be understood that any suitable thrust bearings may be utilised.

The thrust bearing assemblies 112 also comprise a carrier member 116, the thrust bearings 114 being disposed on and carried by the carrier member 116. In the illustrated jarring apparatus 10, the carrier member 116 takes the form of an annular sleeve.

As shown in FIG. 13, the tool T further comprises a shoulder 118 defined by an axial end face of a portion of the mandrel 14. In use, relative axial movement of the housing 12 and the mandrel 14 brings the shoulder 118 into engagement with an anvil 120 disposed in the housing 12.

As described above, the mandrel 14 is rotatably and axially coupled to the housing 12 and as shown in FIG. 13 the jarring apparatus 10 comprises a spline connection 122 for rotationally and axially coupling the mandrel 14 to the housing 12.

As shown in FIG. 13, the jarring apparatus 10 further comprises a seal arrangement 124, which in the illustrated jarring apparatus 10 takes the form of a seal stack, and ports 126. The seal arrangement 124 is radially interposed between the mandrel 14 and the housing 12. When seated, the seal arrangement 124 prevents fluid communication to the thrust assembly 106. When unseated by relative axial movement between the mandrel 14 and the housing 12, the ports 126 provide fluid communication to the thrust assembly 106, acting to cool and/or lubricate the thrust assembly 106.

Also shown in FIG. 13 is an axial trigger arrangement, generally denoted 128. The axial trigger arrangement 128 is configured to selectively axially lock the mandrel 14 and the housing 12. In a first configuration (as shown in FIG. 13), the axial trigger arrangement 128 is configured to axially lock the mandrel 14 and the housing 12. In a second configuration, the axial trigger arrangement 128 is configured to permit axial movement between the mandrel 14 and the housing 12.

As shown in FIG. 13, the axial trigger arrangement 128 comprises a locking profile 130. The locking profile 130 is provided on the mandrel 14. In the illustrated tool T, the locking profile 130 comprises or take the form of a castellated profile.

The axial trigger arrangement 128 comprises locking keys 132 comprising a castellated profile 134 on their inner circumferential surface which is configured to engage the locking profile 130 on the mandrel 14.

The locking keys 132 are reconfigurable between a radially retracted configuration as shown in FIG. 13 and a radially extended configuration.

The axial trigger arrangement 128 further comprises a taper lock 136 formed by lock bowl 138 defining a tapered surface 140 configured to engage corresponding tapered surfaces 142 on the locking keys 132.

In the illustrated tool T, the axial trigger arrangement 128 further comprises a spring arrangement 144 which in the illustrated jarring apparatus 10 takes the form of a Belleville spring stack.

The spring arrangement 144 is coupled to or configured to engage the lock bowl 138 to urge the locking keys 132 towards their retracted configuration. In use, the spring arrangement 144 and taper lock 136 define a retainer of the axial trigger arrangement 128.

In the illustrated tool T, the locking keys 132 are also held in the radially retracted configuration by a resilient element 146 in the form of an elastic member.

The axial trigger arrangement 128 is configured to move the locking keys 132 to the extended configuration in response to an axial pull or tensile force applied to the mandrel 14 or a push, compressive or applied weight force. More particularly, the axial trigger arrangement is configured to move the one or more locking keys 132 to the extended configuration in response to an axial pull or tensile force or axial push, compressive or applied weight above a predetermined threshold force, in particular the spring force of the spring arrangement 144 and where applicable the force exerted by the resilient element 146. The application of a pull or tensile force facilitates an axial up jar operation and/or rotary jarring operation. The application of a push, compressive or applied weight force facilitates an axial down jar operation.

Figure 15:
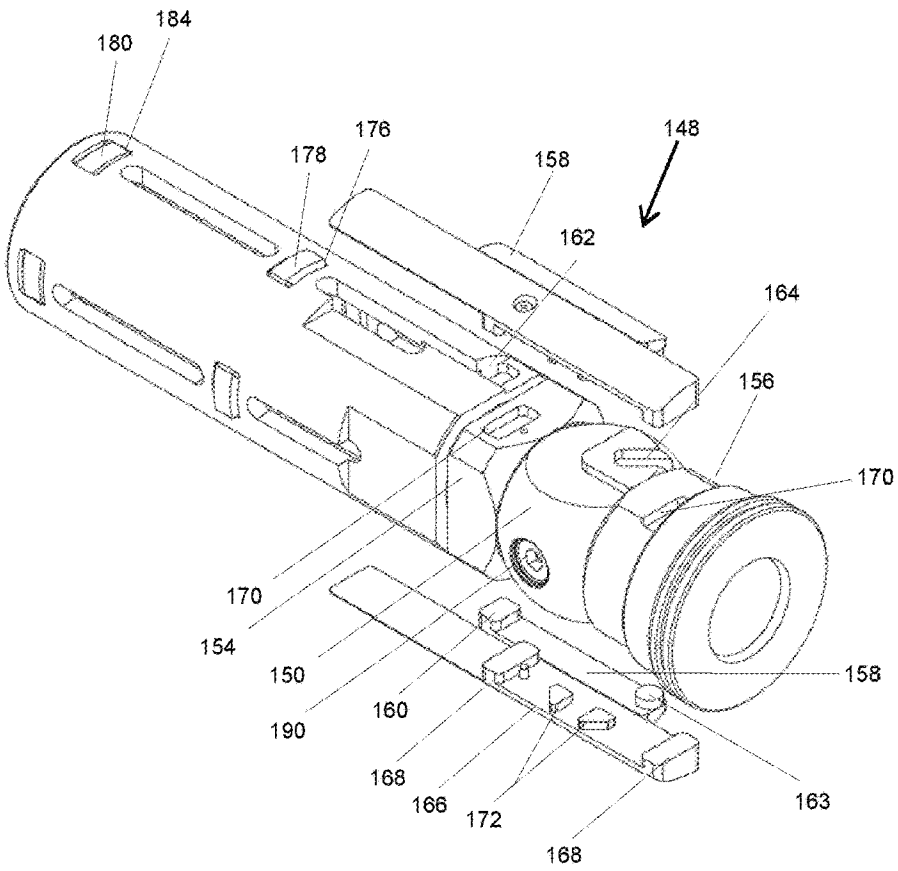
FIGS. 14 and 15 show a valve arrangement configured to generate back pressure for use in operation of the jarring apparatus.
Figure 14:
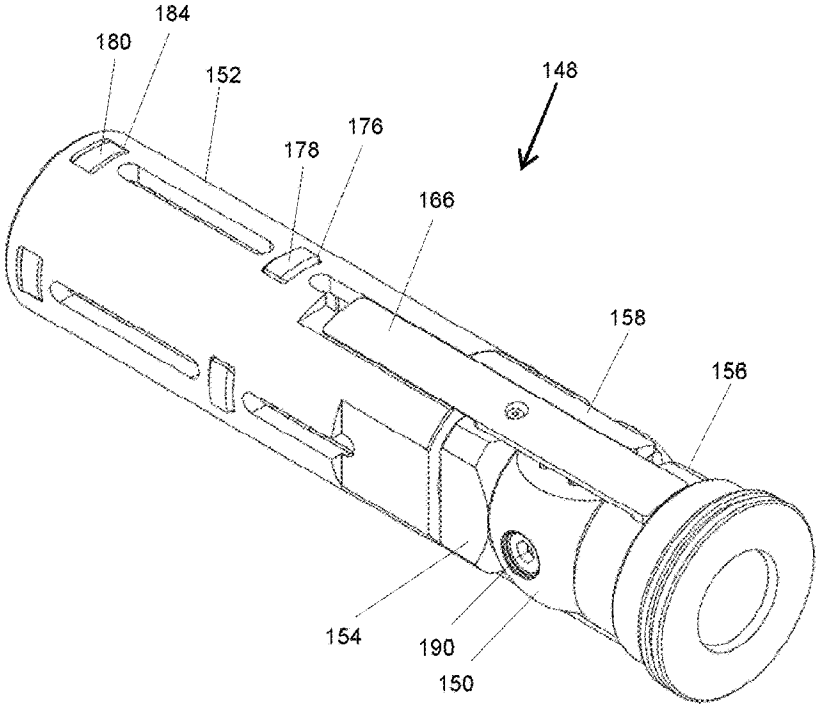

As shown in FIG. 13, and referring now also to FIGS. 14 and 15 of the accompanying drawings, the tool T further comprises a valve arrangement, generally denoted 148, configured to provide selective fluid communication through the axial throughbore 38 of the jarring apparatus 10.

In use, the valve arrangement 148 is configurable between a first, open, configuration which permits full bore access through the axial throughbore 38 of the jarring apparatus and an obturated configuration in which access through the jarring apparatus 10 is restricted, such restriction providing a back pressure for use in operation of the jarring apparatus 10 as will be described further below.

The valve arrangement 148 comprises a valve member 150, which in the illustrated apparatus 10 takes the form of a ball having throughbore 151, and an actuator sleeve 152. The valve member 150 is captivated between an upper valve seat 154 and a lower valve seat 156. The valve arrangement 148 comprises a valve operator arrangement comprising operator members 158. As shown most clearly in FIG. 15, each operator member 158 comprises a tab 160 which seats in a corresponding recess 162 in the actuator sleeve 1520 and a pin 163 which engages an offset slot 164 in the valve member 150.

In use, axial movement of the actuator sleeve 152 translates the operator members 158 to pivot the valve member 150 and thereby reconfigure the valve arrangement 148 from the open configuration to the obturated configuration.

As shown, seat plates 166 are provided, the seat plates 166 having tabs 168 for engaging corresponding recesses 170 in the upper and lower valve seats 154,156. In the illustrated tool T, rotation of the valve member 150 is limited to a ¼ turn by movement limiters 172 provided on the seat plates 166.

The valve arrangement 148 comprises an indexer mechanism, generally denoted 174, which in the illustrated tool T takes the form of a dog indexer as will be described below.

An upper portion of the actuator sleeve 152 has slots 176, through which are disposed a number of dogs 178. As shown in FIG. 13, the dogs 178 are disposed on the mandrel 14 such that axial movement of the mandrel 14 de-supports the dogs 178 and permits axial movement of the actuator sleeve 152.

As shown in FIG. 13, upper dogs 180 are disposed on a recess 182 in the outer circumferential surface of the mandrel 14. In use, relative axial movement of the mandrel 14 and the housing 12 aligns the dogs 180 with corresponding recesses 184 formed in the inner circumferential surface of the housing 12, allowing the dogs 180 to move radially outwards and thereby stop further axial movement of the actuator sleeve 152.

A ramp profile 188 is provided on the outer circumferential surface of the mandrel 14, such that relative axial movement of the mandrel 14 and the housing 12 in the opposing direction will release the upper dogs 180 from the recesses 184 and push the dogs 178 radially outwards, so that the valve arrangement 148 is returned to the first, open, configuration. The valve arrangement 148 may thus be opened and closed repeatedly as required, by relative axial movement of the mandrel 14 and the housing 12.

As shown, the valve member 150 has an orifice 190, which in the illustrated jarring apparatus 10 is provided as an insert. When the valve member 150 defines the obturated configuration, the orifice 190 is aligned with the axial throughbore 38. Flow through the orifice 190 generates a back pressure. The provision of the orifice 190 also means that even when the valve arrangement 148 defines the obturated configuration, some fluid communication through the jarring apparatus 10 is nevertheless provided. Beneficially, this permits the jarring apparatus 10 to function without complete closure of the axial flow passage 38 and, for example, permits circulation of fluid below the jarring apparatus 10 and/or transmission of pressure forces which may be required to operate downhole tools.

As shown in FIG. 13, the jarring apparatus 10 further comprises a bottom sub 192. The bottom sub 192 is generally tubular in construction having an axial throughbore 194 extending therethrough. A lower end portion of the top sub 192 defines a connector 196 for coupling the jarring apparatus 10 to another component of the tool string S. In the illustrated jarring apparatus 10, the connector 196 takes the form of a male connector, more specifically a threaded pin connector. A lower end portion of the bottom sub 192 defines a male profile 186 configured to engage the lower end of the housing 12. In the illustrated jarring apparatus 10, the bottom sub 192 further comprises stabiliser blades 198 for offsetting the jarring apparatus 10 from the borehole.

Figure 16:
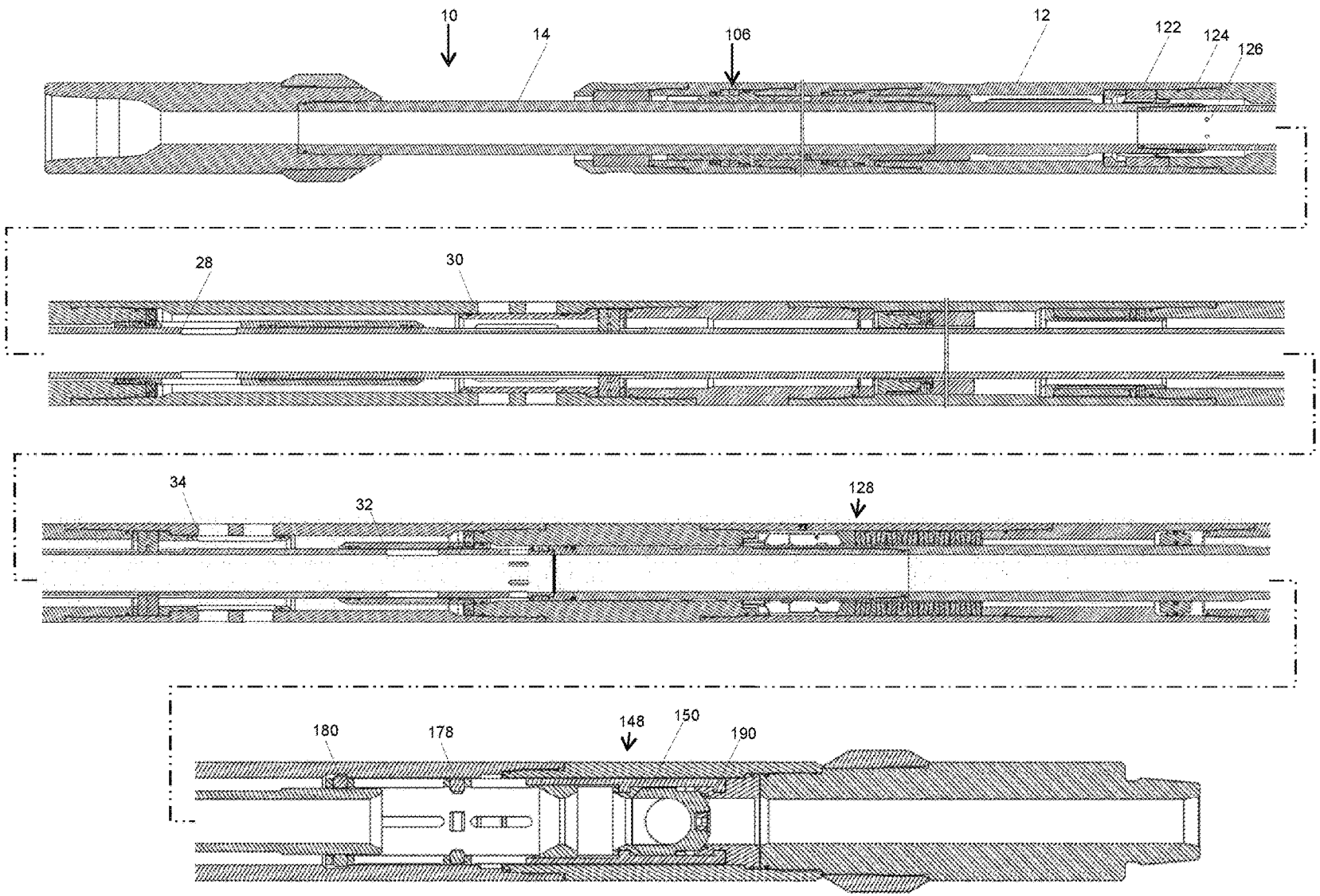
FIG. 16 shows a longitudinal sectional view of the downhole tool of FIG. 13, primed for performing a jarring operation.

FIG. 16 of the accompanying drawings shows the tool T with the jarring apparatus 10 in a primed configuration suitable for performing a jarring operation.

As shown in FIG. 16, the spline connection 122 has been disengaged, with relative axial movement of the mandrel 14 and the housing 12 bringing the thrust assembly 106 into engagement. In the configuration shown in FIG. 16, the seal arrangement 124 is unseated such that fluid communication is permitted between the axial throughbore 38 and the thrust assembly 106 via the ports 126, so as to facilitate cooling and/or lubrication of the thrust assembly 106.

In this primed configuration, the upper valve inlet 28 is in the open configuration, the upper valve exhaust 30 is in the closed configuration, the lower valve inlet 32 is in the closed configuration and the lower valve exhaust 34 is in the open configuration. The axial trigger arrangement 128 has been released.

Figure 17:
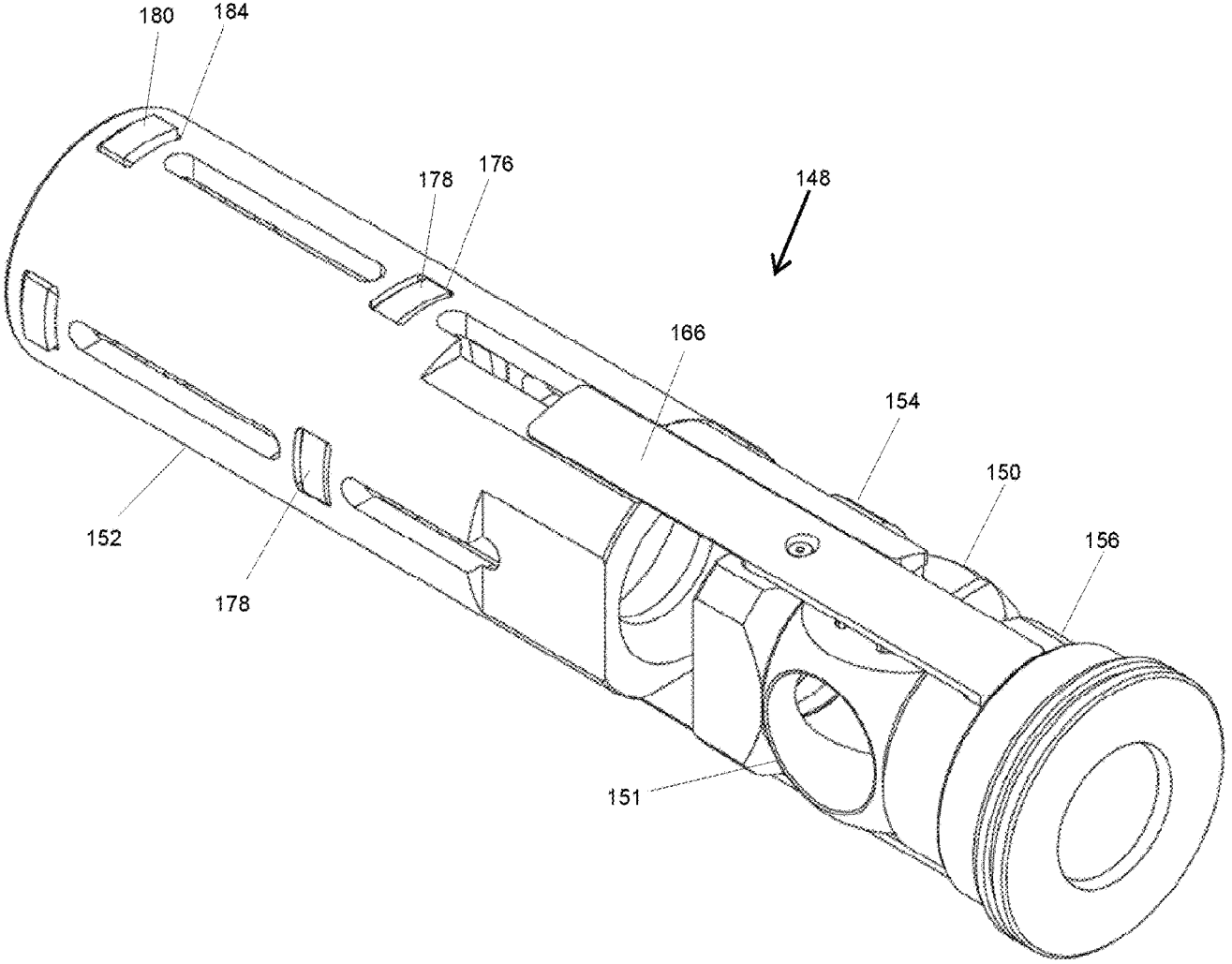
FIG. 17 shows a perspective view of the valve arrangement shown in FIGS. 14 and 15 configured to generate back pressure for use in operation of the jarring apparatus.

Referring also to FIG. 17, which shows a perspective view of the valve arrangement 126, relative axial movement between the mandrel 14 and the housing 12 has de-supported the dogs 178 which have moved radially inwards and engaged the upper dogs 180 with their recesses 184, permitting axial movement of the actuator sleeve 130 to reconfigure the valve member 150 to the obturated configuration with the orifice 190 aligned with the axial throughbore 38.

As can be seen from FIG. 17, the actuator sleeve 152 can move relative to the valve member 150 but the valve member 150 remains captivated between the valve seats 154,156.

Figure 18:
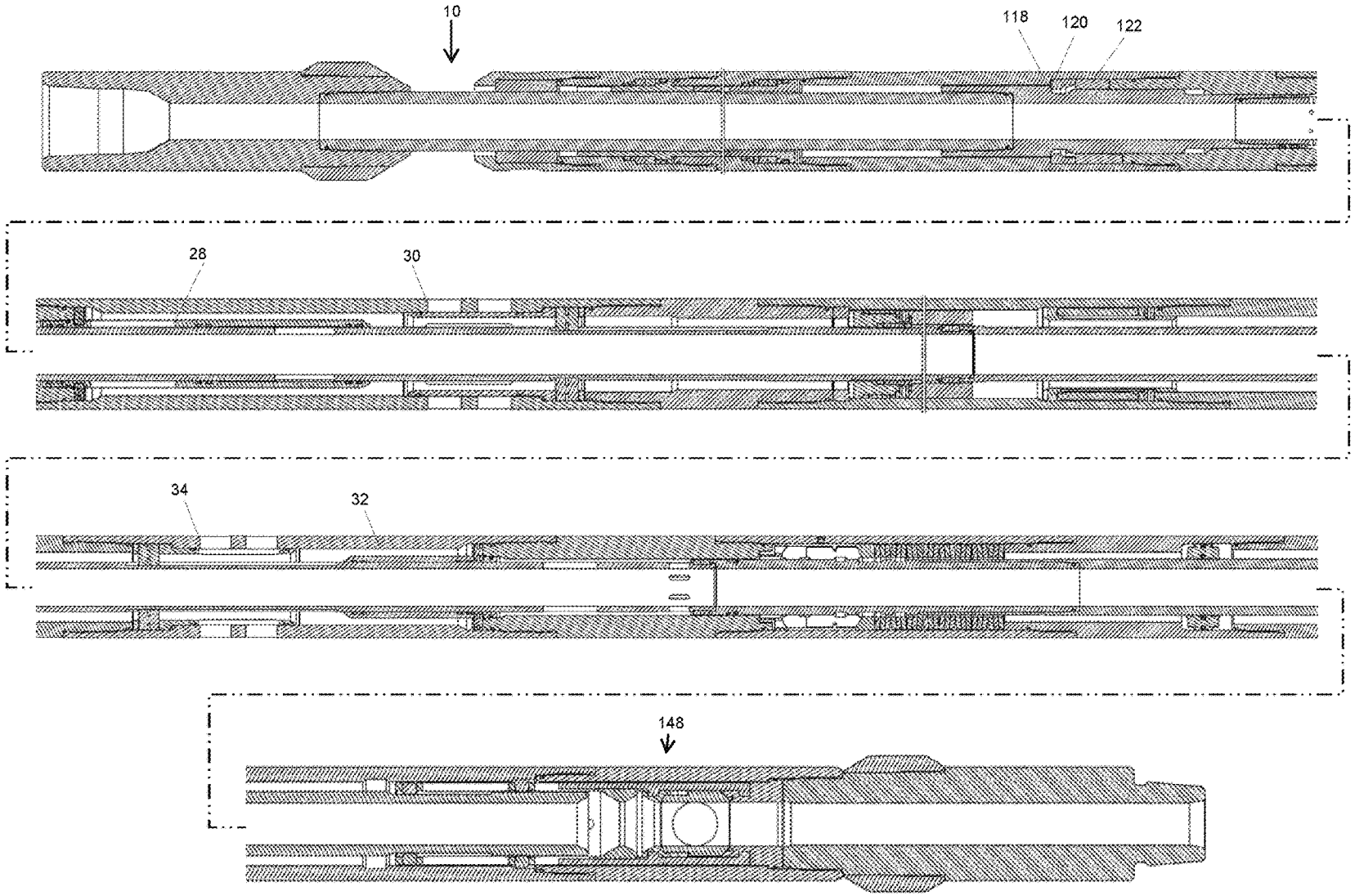
FIG. 18 shows a longitudinal sectional view of the downhole tool shown in FIG. 13, in a second phase of rotation.

FIG. 18 of the accompanying drawings shows the jarring apparatus 10 configured to generate a linear down-jar force. As shown in FIG. 18, the upper valve inlet 28 is in the closed configuration, the upper valve exhaust 30 is in the open configuration, the lower valve inlet 32 is in the closed configuration and the lower valve exhaust 34 is in the open configuration. The valve arrangement 148 is in the open configuration. The impact surfaces 118,120 are engaged.

It will be understood that various modifications may be made without departing from the scope of the invention as defined in the claims.

For example, FIGS. 19 to 23 of the accompanying drawings illustrate an alternative rotary valve assembly 1024. Similar components of the rotary valve assembly 1024 to the rotary valve assembly 24 are indicated with like reference signs incremented by 1000. While components of the rotary valve assembly 1024 are designated using reference signs corresponding to those of the upper rotary valve assembly 24, it will be recognised that the rotary valve assembly 1024 may be utilised in mirror image to alternatively or additionally form a lower rotary valve assembly corresponding to the lower rotary valve assembly 26.

Figure 19:
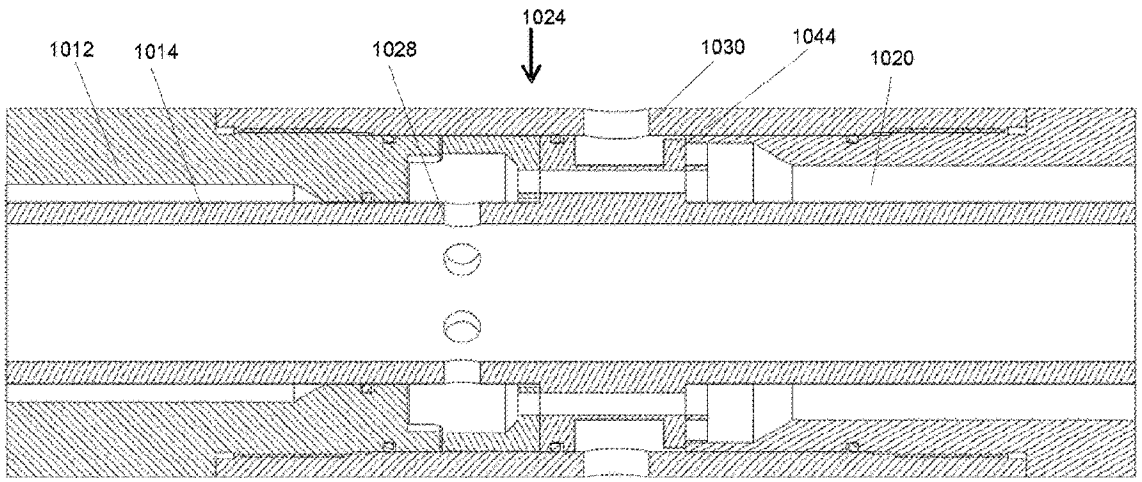
FIGS. 19 to 23 show an alternative valve arrangement for the jarring apparatus.
Figure 21:
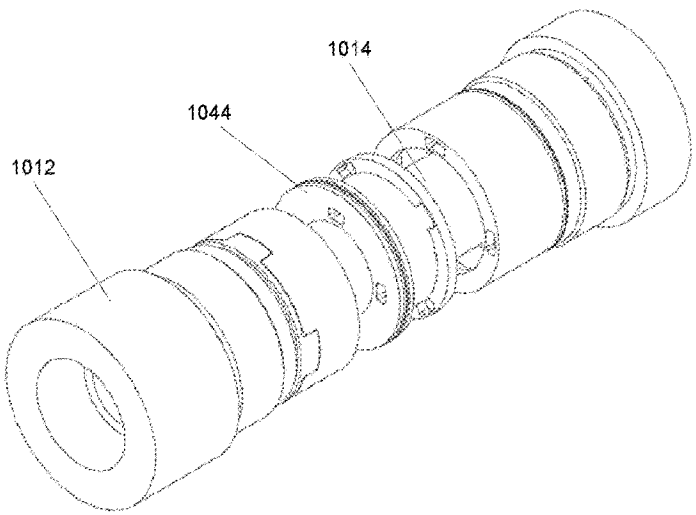
Figure 20:
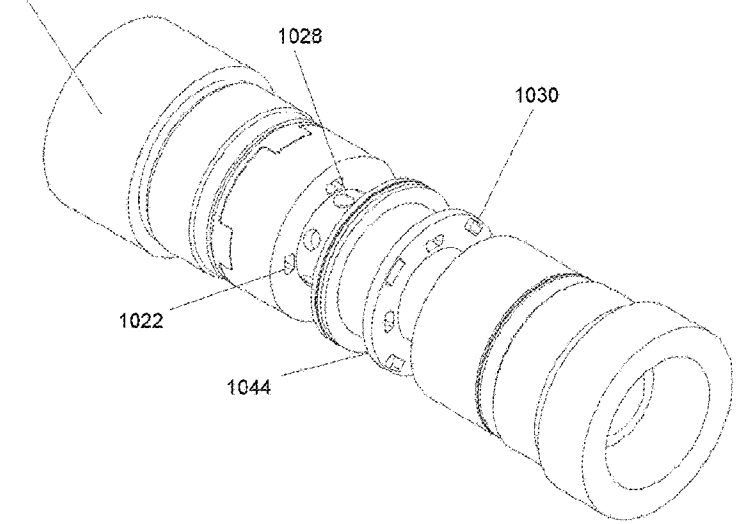

As shown in FIG. 19, the rotary valve assembly 1024 comprises valve inlet 1028 formed in mandrel 1014, valve exhaust 1030 formed in housing 1012, and annular piston chamber 1020.

Whereas the rotary valve assembly 24 comprises separate rotary valve members in the form of inlet selector sleeve and exhaust selector sleeves, in the rotary valve assembly 1024 a single rotary valve member 1044 is provided. The rotary valve member 1044 takes the form of a selector sleeve. The rotary valve member 1044 is operatively associated with the valve inlet 1028 and the valve exhaust 1030.

Figure 22:
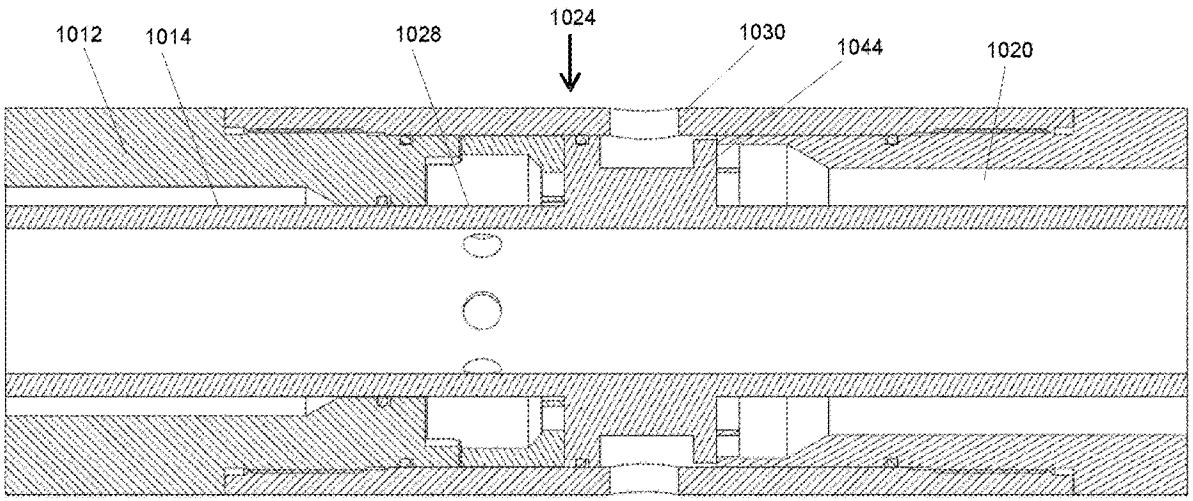
Figure 23:
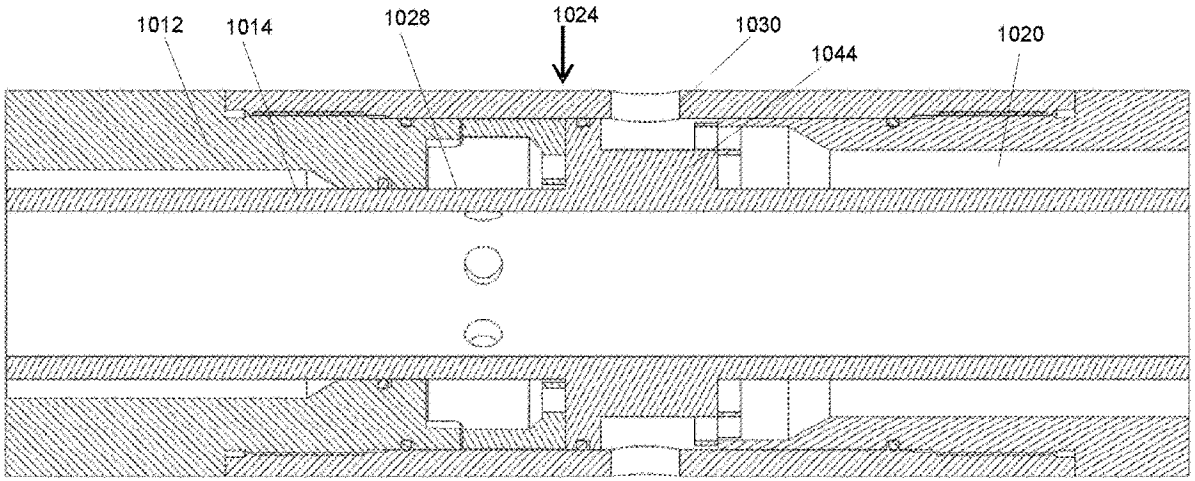

In use, during one phase of relative rotation (as shown in FIG. 22), the valve inlet 1028 defines an open configuration in which pressure communication with the piston chamber 1020 is permitted by the rotary valve member 1044 and pressure communication with the valve exhaust 1030 is prevented by the rotary valve member 1044. In another phase (as shown in FIG. 23), the valve inlet 1028 defines the closed configuration in which pressure communication with the piston chamber 1020 is prevented, substantially prevented or obturated by the rotary valve member 1044 and pressure communication with the valve exhaust 1030 is permitted by the rotary valve member 1044.

As described above, it will be understood that various modifications may be made without departing from the scope of the invention as defined in the claims.

Figure 24:
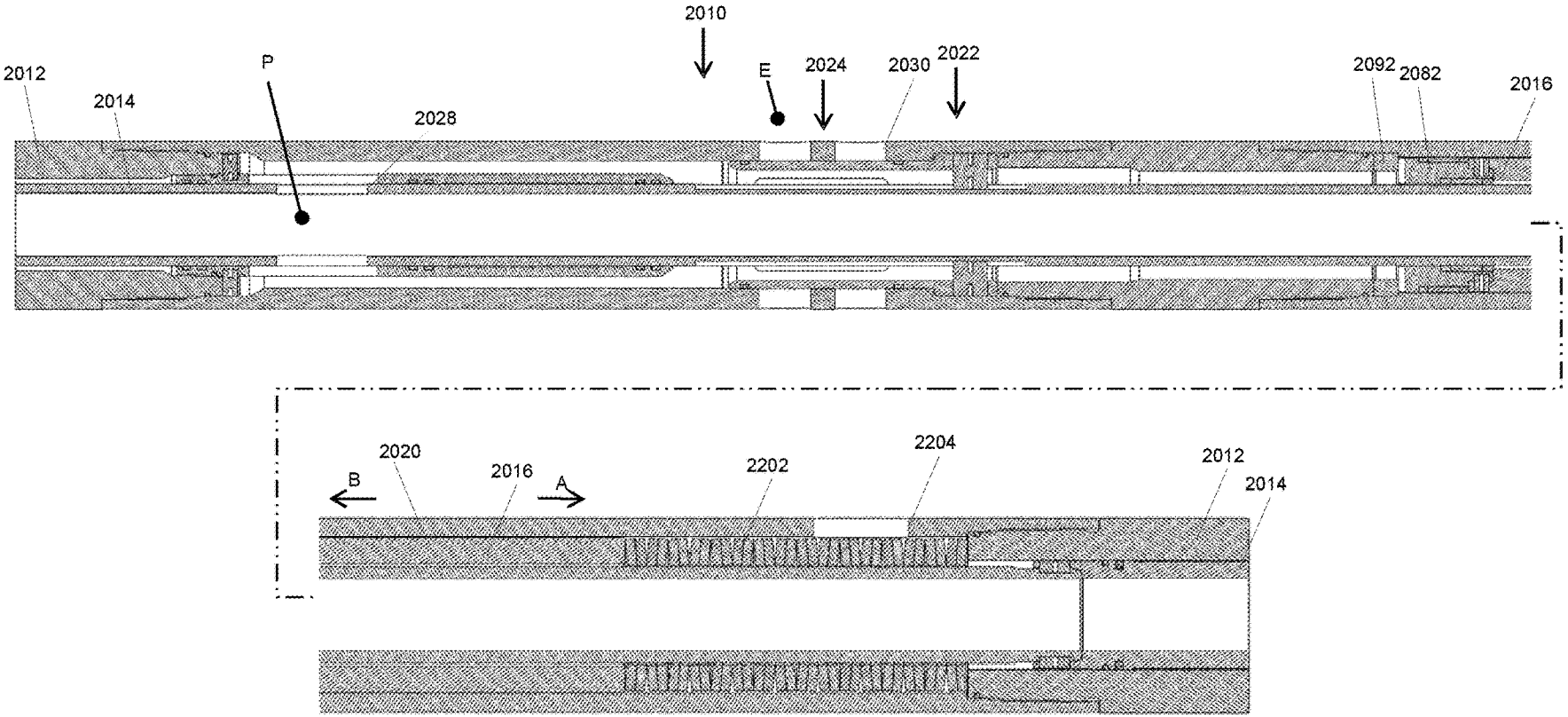
FIGS. 24 and 25 show alternative biasing arrangements for the jarring apparatus.

FIG. 24 of the accompanying drawings illustrates part of an alternative jarring apparatus 2010.

As shown in FIG. 24, rotary valve arrangement 2022 comprises a first, upper, valve assembly, generally denoted 2024, similar to valve assembly 24 described above but the second biasing arrangement provided by the second, lower, valve assembly 26 has been replaced by an alternative biasing arrangement as described below.

The upper rotary valve assembly 2024 comprises a valve inlet 2028 for communicating with a pressure region P and a valve exhaust 2030 for communicating with an exhaust region E.

The upper rotary valve assembly 2024 is operated by relative rotation between mandrel 2014 and housing 2012 to be cyclically reconfigured between: a pressure configuration in which the piston chamber 2020 is in pressure communication with the valve inlet 2028 and isolated from the valve exhaust 2030 to permit the jarring piston 2016 to move in the first axial direction A (to the right as shown in FIG. 24) in accordance with the piston chamber 2020 being pressurised via the valve inlet 2028; and an exhaust configuration in which the piston chamber 2020 is isolated from the valve inlet 2028 and in pressure communication with the valve exhaust 2030 to permit the piston chamber 2020 to be depressurised and the jarring piston 2016 to move in the second axial direction B (to the left as shown in FIG. 24). Movement of the jarring piston 2016 and the coupled hammer 3082 generates a jarring force within the jarring apparatus 2010.

As described above, the second, lower, valve assembly 26 has been replaced by an alternative biasing arrangement. In the illustrated jarring apparatus 2010, the biasing force applied to the jarring piston 2016 is provided by a spring arrangement 2202.

As shown in FIG. 24, exhaust ports 2204 are provided through the wall of the housing 2012 to prevent hydraulic locking.

In use, pressure moves the hammer 2082 against the bias of the spring arrangement 2202. When the valve exhaust 2030 is opened, the hammer 2082 is driven by the spring arrangement 2202 into engagement with the anvil 2092, to thereby generate the jarring forces within the jarring apparatus 2010.

Figure 25:
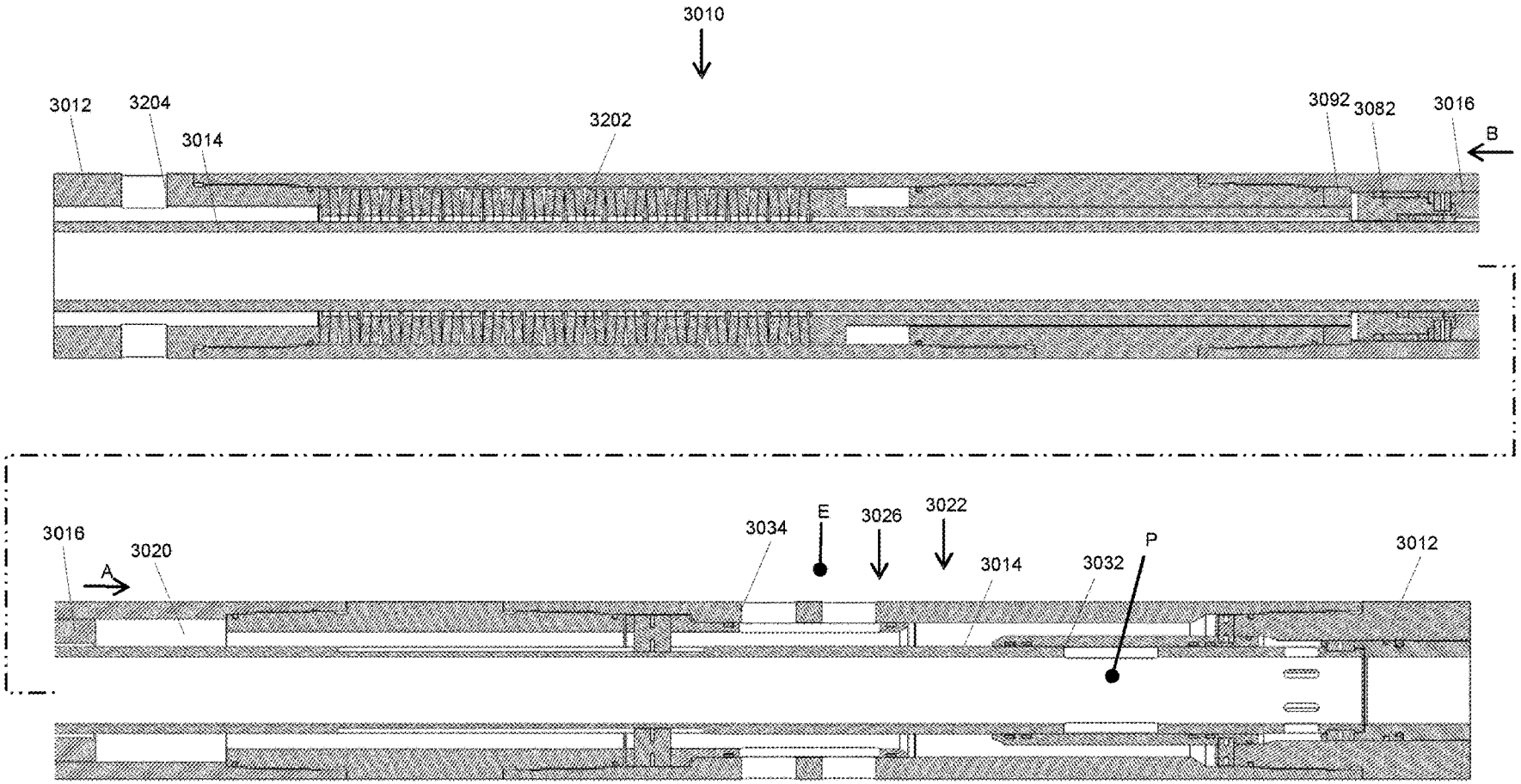

FIG. 25 of the accompanying drawings illustrates part of an alternative jarring apparatus 3010.

As shown in FIG. 25, the rotary valve arrangement 3022 comprises a lower valve assembly, generally denoted 3026, similar to the lower valve assembly 26.

The rotary valve assembly 3026 comprises a valve inlet 3032 for communicating with a pressure region P and a valve exhaust 3034 for communicating with an exhaust region E.

The rotary valve assembly 3026 is operated by relative rotation between mandrel 3014 and housing 3012 to be cyclically reconfigured between: a pressure configuration in which the piston chamber 3020 is in pressure communication with the valve inlet 3032 and isolated from the valve exhaust 3034 to permit the jarring piston 3016 to move in the second axial direction B (to the left as shown in FIG. 25) in accordance with the piston chamber 3020 being pressurised via the valve inlet 3032; and an exhaust configuration in which the piston chamber 3020 is isolated from the valve inlet 3032 and in pressure communication with the valve exhaust 3034 to permit the piston chamber 3020 to be depressurised and the jarring piston 3016 to move in the first axial direction A (to the right as shown in FIG. 25). Movement of the jarring piston 3016 and the coupled hammer 3082 generates a jarring force within the jarring apparatus 3010.

In the illustrated jarring apparatus 3010, the second biasing force applied to the jarring piston 3016 is provided by a spring arrangement 3202 in a similar manner to the apparatus 2010.

As shown in FIG. 25, exhaust ports 3204 are provided through the wall of the housing 3012 to prevent hydraulic locking.

In use, pressure lifts the hammer 3082 against the bias of the spring arrangement 3202 to cause an upwards jarring force. When the valve inlet 3032 is closed and the valve exhaust 3034 is opened the hammer 3082 is returned by the spring arrangement 3202 ready for another upward jar in the next cycle.

Figure 26:
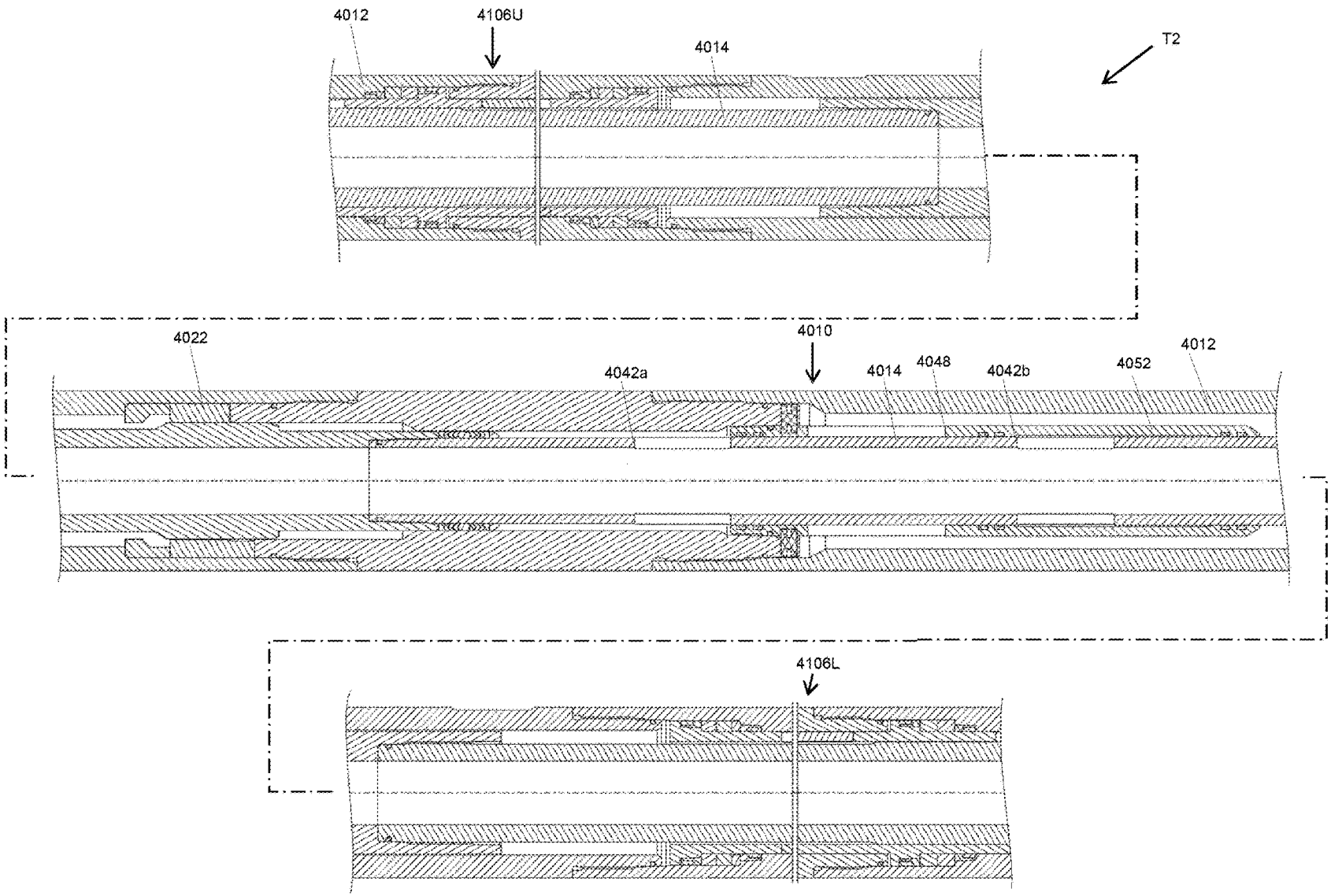
FIG. 26 shows a tool comprising an alternative jarring apparatus.

FIG. 26 of the accompanying drawings illustrates a tool T2 comprising an alternative jarring apparatus 4010, in a neutral configuration. The jarring apparatus 4010 is configured to facilitate rotary jarring with applied tension ("overpull") or applied weight using the same apparatus.

The jarring apparatus 4010 is similar to the apparatus 10 described above and like components are represented by like reference signs incremented by 4000.

As shown in FIG. 26, the apparatus 4010 comprises housing 4012, mandrel 4014 and inlet selector 4052. In the illustrated apparatus 4010, the mandrel 4014 comprises two axially spaced valve inlets 4042*a*, 4042*b*.

In use, relative axial movement in a downwards direction (to the right as shown in FIG. 26) is used to align the valve inlet 4042*a* with ports 4048 of the inlet selector 4052.

In use, relative axial movement in an upwards direction (to the left as shown in FIG. 26) is used to align the valve inlet 4042*b* with ports 4048 of the inlet selector 4052.

As shown in FIG. 26, the tool T2 further comprises two swivels in the form of upper swivel 4106U and lower swivel 4106L. The upper and lower swivels 4106U,4106L are substantially identical to the swivel 106 described above, with lower swivel 4106L being oriented in the opposite direction. As will be recognised, the swivels 4106U,4106L facilitate transmission of axial loading between the mandrel 4014 and the housing 4012, thus diverting such loading from other components within the apparatus 4010, which axial loading in this example may be in either axial direction dependent on whether the apparatus 4010 is subject to tensile/pull forces or weight/push forces.

As shown in FIG. 26, the spline 4022 have also been modified to permit disengagement when weight/push forces are applied.

As described above, further modifications may be made without departing from the scope of the claims.

For example, it will be understood that the apparatus 4010 may be readily modified to facilitate jarring with applied weight/push forces only by removing or blocking the ports 4042*b*.

Figure 27:
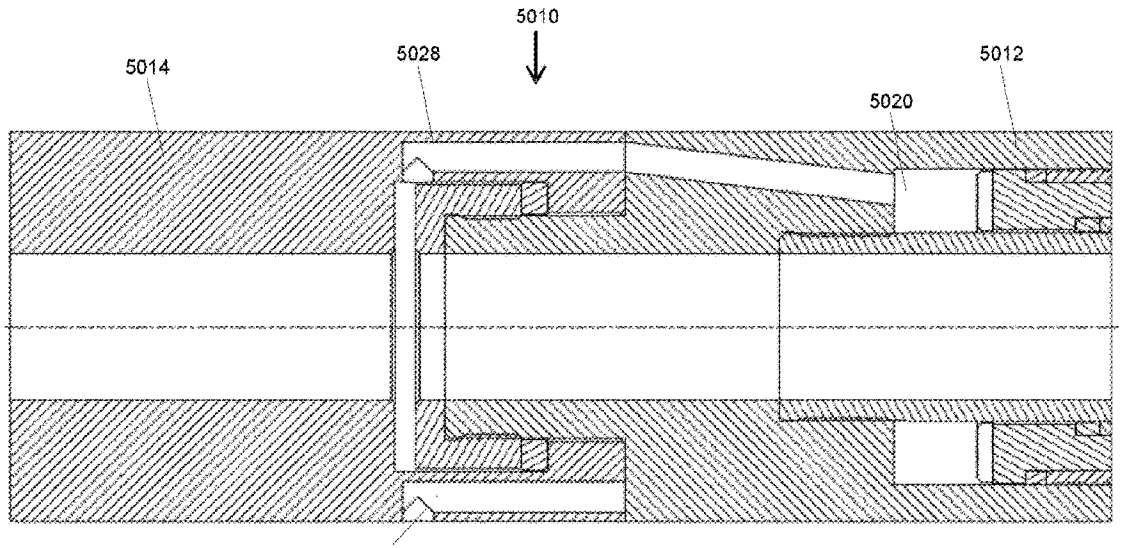
FIG. 27 shows part of an alternative jarring apparatus, in a first phase of rotation.
Figure 28:
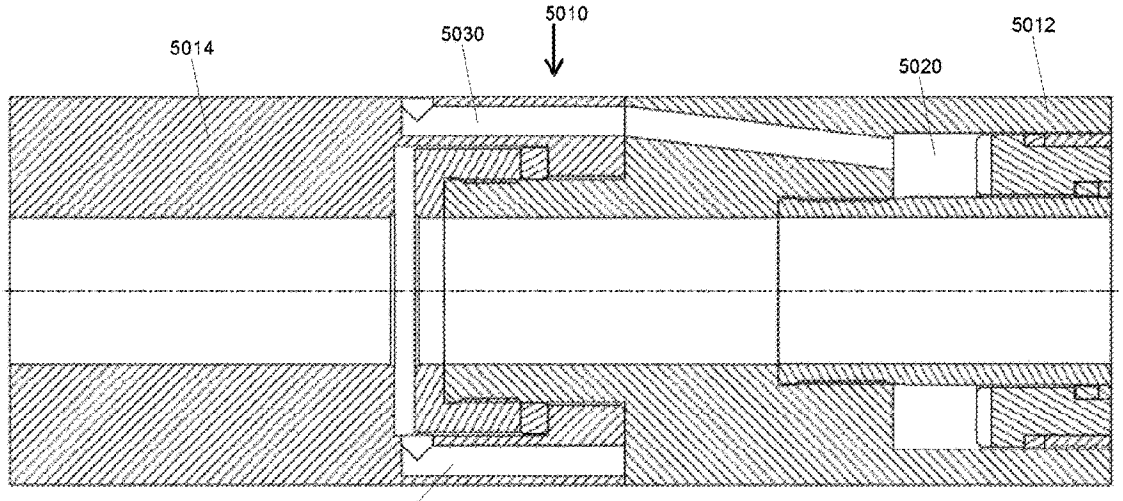
FIG. 28 shows the part of the jarring apparatus shown in FIG. 27, in a second phase of rotation.

For example, FIGS. 27 and 28 of the accompanying drawings diagrammatically show part of an alternative jarring apparatus 5010. FIG. 27 shows the jarring apparatus 5010 in a first phase of rotation in which the apparatus 5010 permits fluid communication between axial throughbore 5038 and piston chamber 5020 via valve inlet 5028 but prevents or restricts fluid communication between axial throughbore 5038 and the valve exhaust 5030. FIG. 28 shows the jarring apparatus 5010 in a second phase of rotation in which the apparatus 5010 prevents or restricts fluid communication between axial throughbore 5038 and piston chamber 5020 via valve inlet 5028 but permits fluid communication between piston chamber 5020 and the valve exhaust 5030.

While in examples above, the mandrel is at least partially mounted within the housing, as shown in FIGS. 27 and 28 in the apparatus 5010 mandrel 5014 and housing 5012 are disposed co-axially. In the illustrated apparatus 5010, the mandrel 5014 is disposed above the housing 5012, although it will be understood that in other examples the housing could be disposed above the mandrel.

As described above, various modifications may be made without departing from the scope of the appended claims.

For example, and referring now to FIGS. 29 to 32 of the accompanying drawings there is shown an alternative reciprocating drive apparatus 6010 in the form of a hammer apparatus.

In use, the apparatus 6010 is configured to generate an applied axial force output for transmission to a connected component, assembly or tool.

As shown, the apparatus 6010 comprises a housing 6012 and a mandrel 6014, the mandrel 6014 and the housing 6012 configurable to be rotated relative to each other. It will be understood that reference to relative rotation between the housing 6012 and the mandrel 6014 may include the apparatus 6010 being configured such that: the mandrel 6014 rotates while the housing 6012 is stationary; such that the housing 6012 rotates while the mandrel 6014 is stationary; or such that the mandrel 6014 and the housing 6012 both rotate. Beneficially, this facilitates flexibility in that hammering operations may be carried out in a number of different operational scenarios.

The apparatus 6010 further comprises a reciprocating piston 6016 mounted within piston housing 6018 so as to define a first piston chamber 6020*a* (shown most clearly in FIG. 31) and a second piston chamber 6020*b*. The piston 6016 is moveable within the first and second piston chambers 6020*a*,6020*b* in reverse first and second axial directions A,B.

The apparatus 6010 further comprises a rotary valve assembly 6024 comprises a valve inlet 6028 for communicating with a pressure region P and a valve exhaust 6030 for communicating with an exhaust region E.

The rotary valve assembly 6024 comprises a rotary valve member 6044 operatively associated with the valve inlet 6028. In the illustrated apparatus 6010, the rotary valve member 6044 takes the form of an inlet selector sleeve. The rotary valve member 6044 and the valve inlet 6028 are configured for relative rotation to each other such that rotation causes the rotary valve member 6044 to selectively block or obturate the valve inlet 6028. That is, during one phase of relative rotation, the valve inlet 6028 defines an open configuration in which pressure communication with the piston chamber 6020*a* is permitted and in another phase the valve inlet 6028 defines the closed configuration in which pressure communication with the piston chamber 6020*a* is prevented, substantially prevented or obturated.

In the illustrated apparatus 6010, the rotary valve member 6044 is fixed to the housing 6012 via thread connection 6206, such that relative rotation between the mandrel 6014 and the housing 6012 reconfigures the valve assembly 6024 as described further below. However, it will be understood that the rotary valve member 6044 may be coupled to the housing by any suitable means.

In the illustrated apparatus 6010, the housing 6012 comprises or takes the form of a sleeve that, in use, acts as a non-rotating element (or as a relatively lower rotational speed element compared to the mandrel 6014).

In use, the mandrel 6014—which by virtue of threaded box connection 6208 is coupled to and rotates with a rotating string (not shown) of which the apparatus 6010 forms a part—rotates while the housing 6012—which by virtue of its engagement with borehole H—does not rotate or rotates at a lower rotational speed than the mandrel 6014. As the rotary valve member 6044 is fixed to the housing 6012 via thread connection 6206, relative rotation is also provided between the mandrel 6014 and the rotary valve member 6044.

The valve assembly 6024 is operated by relative rotation between the mandrel 6014 and the housing 6012 and the rotary valve member 6044 to be cyclically reconfigured between: a pressure configuration in which the piston chamber 6020*a* is in pressure communication with the valve inlet 6028 and isolated from the valve exhaust 6030 to permit the piston 6016 to move in the first axial direction A in accordance with the piston chamber 6020*a* being pressurised via the valve inlet 6028; and an exhaust configuration in which the piston chamber 6020*a* is isolated from the valve inlet 6028 and in pressure communication with the valve exhaust 6030 to permit the piston chamber 6020*a* to be depressurised and the piston 6016 to move in the second axial direction B.

Figure 29:
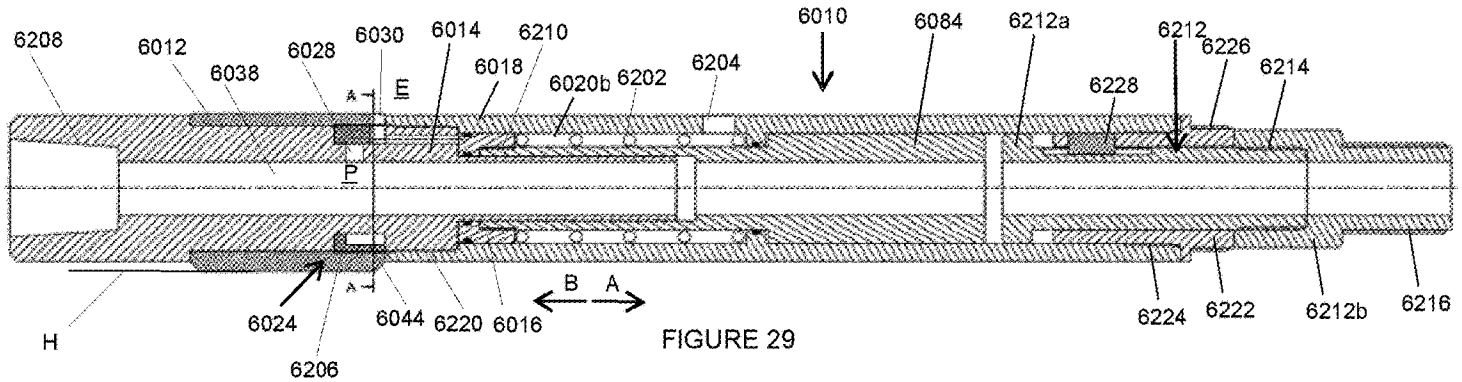
FIG. 29 shows a longitudinal sectional view of an alternative reciprocating drive apparatus, in a first phase of rotation.
Figure 30:
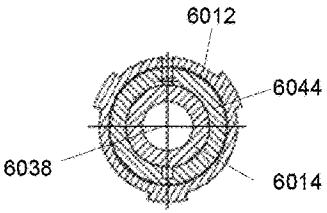
FIG. 30 shows cross-sectional view A-A of the apparatus shown in FIG. 29.

FIGS. 29 and 30 show the apparatus 6010 in a first phase of rotation corresponding to the exhaust configuration in which the apparatus 6010 prevents or restricts fluid communication between axial throughbore 6038 of the apparatus 6010 and piston chamber 6020*a* via valve inlet 6028 but permits fluid communication between piston chamber 6020*a* and the valve exhaust 6030.

Figure 31:
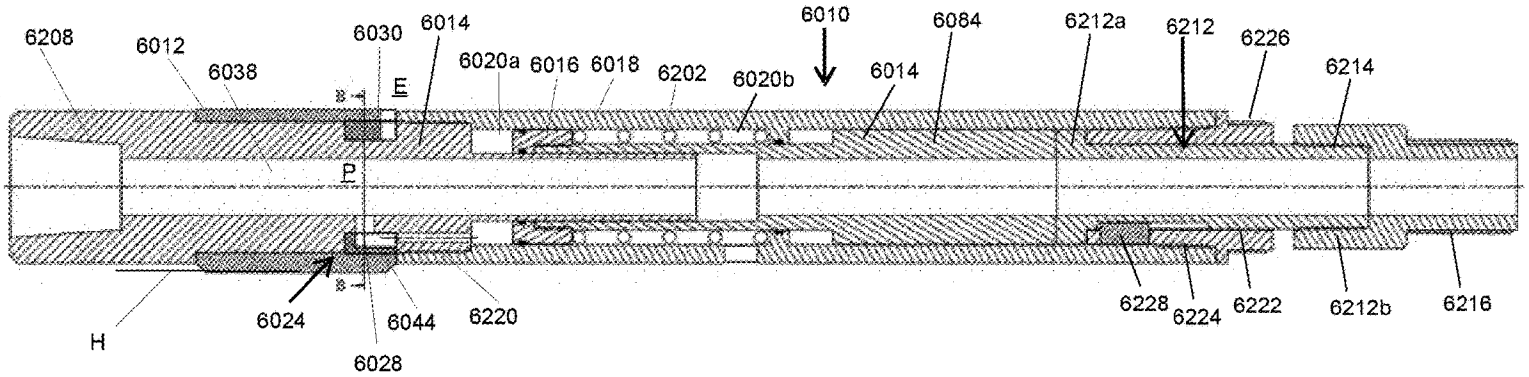
FIG. 31 shows a longitudinal sectional view of the apparatus shown in FIG. 29, in a second phase of rotation.
Figure 32:
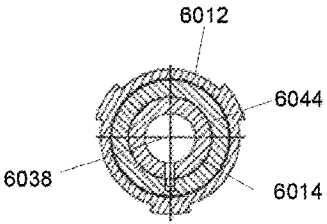
FIG. 32 shows cross-sectional view B-B of the apparatus shown in FIG. 29.

FIGS. 31 and 32 show the apparatus 6010 in a second phase of rotation corresponding to the pressure configuration in which the apparatus 6010 permits fluid communication between axial throughbore 6038 and piston chamber 6020*a* via valve inlet 6028 but prevents or restricts fluid communication between axial throughbore 6038 and the valve exhaust 6030.

As shown in FIGS. 31 and 32, when the apparatus 6010 defines the pressure configuration fluid pressure acting on the piston 6016 urges the piston 6016 axially relative to piston housing 6018 against the bias of spring arrangement 6202. As the piston 6016 translates relative to the piston housing 6018, fluid in piston chamber 6020*b* is displaced through exhaust ports 6204, thereby preventing a hydraulic lock.

Referring again to FIGS. 29 and 31, it can be seen that the piston 6016 is coupled to a hammer 6084 by a coupling arrangement 6210, which in the illustrated apparatus 6010 takes the form of a thread connection. As such, axial movement of the piston 6016 also moves the hammer 6084 axially.

In use, axial movement of the hammer 6084 in the first direction A by the piston 6016 engages a distal end portion of the hammer 6084 with an output shaft, generally denoted 6212, generating an impact force.

In the illustrated apparatus 6010, the output shaft 6212 comprises a first component 6212*a* forming an anvil, chisel or receiver for receiving the impact force from the hammer 6084 and a second component 6212*b* forming an end effector of the apparatus 6010. However, it will be understood that the output shaft 6212 may alternatively comprise or take the form of a unitary member. As shown in FIGS. 29 and 31, a distal end portion of the first component 6212*a* is coupled to the second component 6212*b* by a coupling arrangement 6214, which in the illustrated apparatus 6010 takes the form of a thread connection. The output shaft 6212 (in particular the second component 6212*b*) has a coupling arrangement 6216, which in the illustrated apparatus 6010 takes the form of a thread connection formed on an outer surface of the output shaft 6212. The coupling arrangement 6216 may be utilised to transmit the applied axial force output from the apparatus 6010 to a connected component, assembly or tool.

In the illustrated apparatus 6010, a proximal end portion of the piston housing 6018 is coupled to the mandrel 6014 by a coupling arrangement 6220, which in the illustrated apparatus 6010 takes the form of a thread connection. As such, rotational movement and/or applied torque from the mandrel 6014 is transmitted to the piston housing 6018. A distal end portion of the piston housing 6018 is coupled to a bottom sub 6222 of the apparatus 6010 by a coupling arrangement 6224, which in the illustrated apparatus 6010 takes the form of a thread connection. The bottom sub 6222 comprises a further coupling arrangement 6226, which in the illustrated apparatus 6010 takes the form of a thread connection formed on an outer surface of the bottom sub 6222. The coupling arrangement 6222 facilitates connection and transmission of rotational movement and/or applied torque to downhole components of the tool string, such as the housing of a connected component or tool, where required.

As shown in FIGS. 29 and 31, a key 6228 is provided and functions to transmit torque from the mandrel 6014 (via the piston housing 6018) to the output shaft 6212.

As described above, the apparatus 6010 may be utilised to generate an applied axial force output for transmission to a connected component, assembly or tool.

Figure 33:
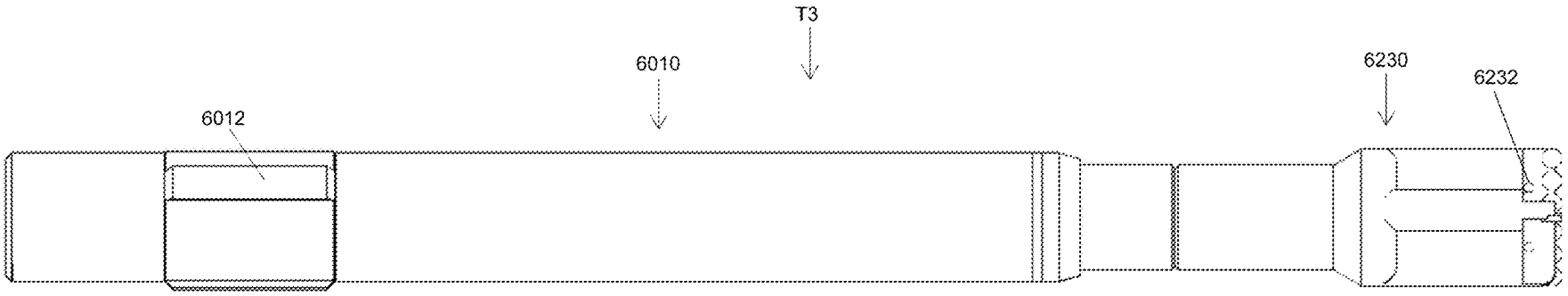
FIG. 33 shows a downhole tool comprising the apparatus of FIG. 29.
Figure 34:
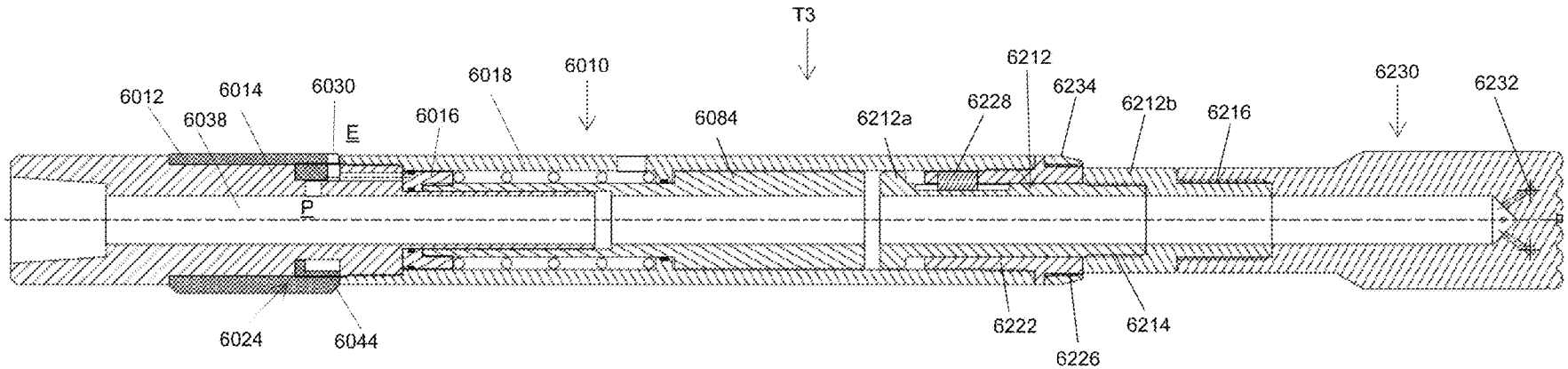
FIG. 34 shows a longitudinal sectional view of the downhole tool shown in FIG. 33.

Referring now also to FIGS. 33 and 34 of the accompanying drawings, there is shown a downhole tool T3 comprising the apparatus 6010 and a bit 6230, which in the illustrated tool T3 takes the form of a drill bit.

In use, the downhole tool T3 takes the form of a percussion drilling tool.

As shown in FIGS. 33 and 34, the bit 6230 comprises ports 6232 which communicate with the throughbore 6038, facilitating amongst other things lubrication of the bit 6230 in use and fluid circulation to surface.

As shown in FIG. 34, the output shaft 6212 of the apparatus 6010 is coupled to the bit 6230 via the coupling arrangement 6216 such that the applied axial force output generated by the apparatus 6010 is transmitted to the bit 6230 while at the same time the rotational movement and/or applied torque from the mandrel 6014 is also transmitted to the bit 6230 via the key 6228 to drive rotation of the bit 6230 and drill the borehole H. In the downhole tool T3, the bit 6230 forms the distal leading end of a tool string, and so an end cap 6234 is located on coupling arrangement 6226.

A downhole tool T4 comprising an alternative hammer apparatus 7010 and a radial hammer assembly 7236 is shown in FIGS. 35 to 38 of the accompanying drawings.

Figure 35:
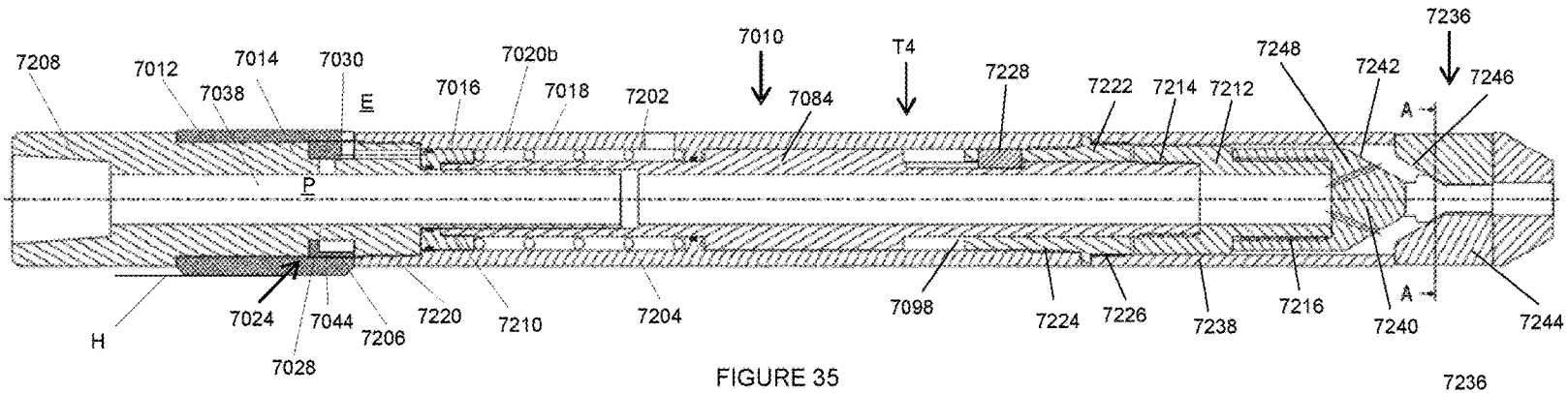
FIG. 35 shows a longitudinal sectional view of another downhole tool comprising an alternative reciprocating drive apparatus, in a first phase of rotation.
Figure 37:
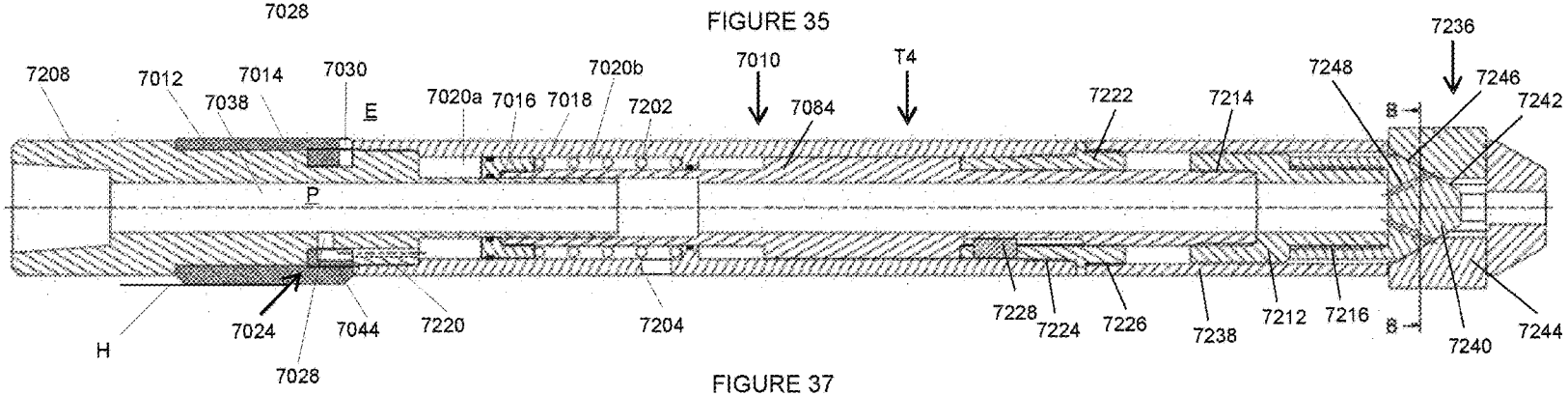
FIG. 37 shows a longitudinal sectional view of the downhole tool shown in FIG. 35, in a second phase of rotation.

As shown in FIGS. 35 and 37, the apparatus 7010 comprises a housing 7012 and a mandrel 7014, the mandrel 7014 and the housing 7012 configurable to be rotated relative to each other. It will be understood that reference to relative rotation between the housing 7012 and the mandrel 7014 may include the apparatus 7010 being configured such that: the mandrel 7014 rotates while the housing 7012 is stationary; such that the housing 7012 rotates while the mandrel 7014 is stationary; or such that the mandrel 7014 and the housing 7012 both rotate. Beneficially, this facilitates flexibility in that hammering operations may be carried out in a number of different operational scenarios.

The apparatus 7010 further comprises a reciprocating piston 7016 mounted within piston housing 7018 so as to define first and second piston chambers 7020*a*,7020*b*. The piston 7016 is moveable within the first and second piston chambers 7020*a*,7020*b* in reverse first and second axial directions A,B.

The apparatus 7010 further comprises a rotary valve assembly 7024 comprises a valve inlet 7028 for communicating with a pressure region P and a valve exhaust 7030 for communicating with an exhaust region E.

The rotary valve assembly 7024 comprises a rotary valve member 7044 operatively associated with the valve inlet 7028. In the illustrated apparatus 7010, the rotary valve member 7044 takes the form of an inlet selector sleeve. The rotary valve member 7044 and the valve inlet 7028 are configured for relative rotation to each other such that rotation causes the rotary valve member 7044 to selectively block or obturate the valve inlet 7028. That is, during one phase of relative rotation, the valve inlet 7028 defines an open configuration in which pressure communication with the piston chamber 7020*a* is permitted and in another phase the valve inlet 7028 defines the closed configuration in which pressure communication with the piston chamber 7020*a* is prevented, substantially prevented or obturated.

In the illustrated apparatus 7010, the rotary valve member 7044 is fixed to the housing 7012 via thread connection 7206, such that relative rotation between the mandrel 7014 and the housing 7012 reconfigures the valve assembly 7024 as described further below.

In the illustrated apparatus 7010, the housing 7012 comprises or takes the form of a sleeve that acts as a non-rotating element (or as a relatively lower rotational speed element compared to the mandrel 6014).

In use, the mandrel 7014—which by virtue of threaded box connection 7208 is coupled to and rotates with a rotating string (not shown) of which the apparatus 7010 forms a part—rotates while the housing 7012—which by virtue of its engagement with borehole H (which in this application takes the form of a bore-lining tubing such as casing)—does not rotate or rotates at a lower rotational speed than the mandrel 7014. As the rotary valve member 7044 is fixed to the housing 7012 via thread connection 7206, relative rotation is also provided between the mandrel 7014 and the rotary valve member 7044.

The valve assembly 7024 is operated by relative rotation between the mandrel 7014 and the housing 7012 and the rotary valve member 7044 to be cyclically reconfigured between: a pressure configuration in which the piston chamber 7020*a* is in pressure communication with the valve inlet 7028 and isolated from the valve exhaust 7030 to permit the piston 7016 to move in the first axial direction A in accordance with the piston chamber 7020*a* being pressurised via the valve inlet 7028; and an exhaust configuration in which the piston chamber 7020*a* is isolated from the valve inlet 7028 and in pressure communication with the valve exhaust 7030 to permit the piston chamber 7020*a* to be depressurised and the piston 7016 to move in the second axial direction B.

Figure 36:
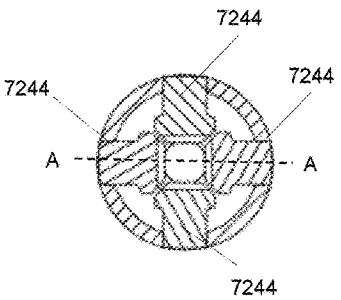
FIG. 36 shows cross-sectional view A-A of the downhole tool shown in FIG. 35.

FIGS. 35 and 36 show the apparatus 7010 in a first phase of rotation corresponding to the exhaust configuration in which the apparatus 7010 prevents or restricts fluid communication between axial throughbore 7038 of the apparatus 7010 and piston chamber 7020*a* via valve inlet 7028 but permits fluid communication between piston chamber 7020*a* and the valve exhaust 7030.

Figure 38:
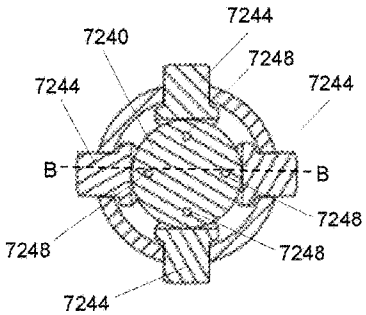
FIG. 38 shows cross-sectional view B-B of the downhole tool shown in FIG. 37.

FIGS. 37 and 38 show the apparatus 7010 in a second phase of rotation corresponding to the pressure configuration in which the apparatus 7010 permits fluid communication between axial throughbore 7038 and piston chamber 7020*a* via valve inlet 7028 but prevents or restricts fluid communication between axial throughbore 7038 and the valve exhaust 7030.

As shown, when the apparatus 7010 defines the pressure configuration fluid pressure acting on the piston 7016 urges the piston 7016 axially relative to piston housing 7018 against the bias of spring arrangement 7202. Fluid in piston chamber 7020*b* is displaced through exhaust ports 7204, thereby preventing a hydraulic lock.

Referring again to FIGS. 35 and 37, it can be seen that the piston 7016 is coupled to a hammer 7084 by a coupling arrangement 7210, which in the illustrated apparatus 7010 takes the form of a thread connection. As such, axial movement of the piston 7016 also moves the hammer 7084 axially.

In the downhole tool T4, a distal end portion of the hammer 7084 is coupled to an output shaft 7212 of the apparatus 7010 by a coupling arrangement 7214, which in the illustrated apparatus 7010 takes the form of a thread connection. The output shaft 7212 has a coupling arrangement 7216, which in the illustrated apparatus 7010 takes the form of a thread connection formed on an outer surface of the output shaft 7212. The coupling arrangement 7216 may be utilised to transmit the applied axial force output from the apparatus 7010 to the radial hammer assembly 7236.

As shown in FIGS. 35 and 37, a proximal end portion of the piston housing 7018 is coupled to the mandrel 7014 by a coupling arrangement 7220, which in the illustrated apparatus 7010 takes the form of a thread connection. As such, rotational movement and/or applied torque from the mandrel 7014 is transmitted to the piston housing 7018. A distal end portion of the piston housing 7018 is coupled to a bottom sub 7222 of the apparatus 7010 by a coupling arrangement 7224, which in the illustrated apparatus 7010 takes the form of a thread connection. The bottom sub 7222 comprises a further coupling arrangement 7226, which in the illustrated apparatus 7010 takes the form of a thread connection formed on an outer surface of the bottom sub 7222. The coupling arrangement 7222 facilitates connection to a housing 7238 of the radial hammer assembly 7236.

In the illustrated apparatus 7010, a key 7228 is provided and functions to transmit torque from the mandrel 7014 (via the piston housing 7018 and the hammer 7084) to the output shaft 7212.

As described above, the apparatus 7010 may be utilised to generate an applied axial force output for transmission to the radial hammer assembly 7236.

As shown, the radial hammer assembly 7236 comprises a tapered bowl 7240 having a tapered outer surface 7242 and a plurality of circumferentially arranged and spaced hammer members 7244 each having a tapered inner surface 7246. In the illustrated tool T4, the hammer members 7244 take the form of dogs.

The radial hammer assembly 7236 is reconfigurable between a first configuration in which the hammer members 7244 define a radially retracted position within the apparatus 7010 and a second configuration in which the hammer members 7244 define a radially extended position which, in use, engages the borehole H.

In the illustrated tool T4, ports 7248 are provided in the bowl 7240 which communicate with the throughbore 7038, facilitating amongst other things lubrication of the radial hammer assembly 7236 in use and fluid circulation to surface.

As shown in FIGS. 35 and 37, the bowl 7240 is coupled to the output shaft 7212, such that the axial movement of the output shaft 7212 by the mandrel 7014 urges the bowl 7240 into engagement with the hammer members 7244, so as to reconfigure the radial hammer assembly 7236 from the first configuration to the second configuration.

The output force generated by the apparatus 7010 is also transmitted to the bowl 7240 which, by virtue of the engagement of the tapered surfaces 7242,7246 transmits the applied force output to the hammer members 7244.

FIGS. 39 to 46 of the accompanying drawings show an alternative reciprocating drive apparatus 8010 in the form of an axial hammer apparatus.

In use, the apparatus 8010 is configured to generate an applied axial force output for transmission to a connected component, assembly or tool.

The apparatus 8010 is similar to the apparatus 6010,7010 described above and like components are represented by like reference signs incremented by 8000. Whereas the apparatus

6010,7010 are configured to transmit applied axial forces and torque, the apparatus 8010 is configured to transmit axial forces only.

As shown, the apparatus 8010 comprises a housing 8012 and a mandrel 8014, the mandrel 8014 and the housing 8012 configurable to be rotated relative to each other. It will be understood that reference to relative rotation between the housing 8012 and the mandrel 8014 may include the apparatus 8010 being configured such that: the mandrel 8014 rotates while the housing 8012 is stationary; such that the housing 8012 rotates while the mandrel 8014 is stationary; or such that the mandrel 8014 and the housing 8012 both rotate. Beneficially, this facilitates flexibility in that hammering operations may be carried out in a number of different operational scenarios.

The apparatus 8010 further comprises a reciprocating piston 8016 mounted within piston housing 8018 so as to define a first piston chamber 8020*a* (shown most clearly in FIG. 43) and a second piston chamber 8020*b*. The piston 8016 is moveable within the first and second piston chambers 8020*a*,8020*b* in reverse first and second axial directions A,B.

The apparatus 8010 further comprises a rotary valve assembly 8024 comprises a valve inlet 8028 for communicating with a pressure region P and a valve exhaust 8030 for communicating with an exhaust region E.

The rotary valve assembly 8024 comprises a rotary valve member 8044 operatively associated with the valve inlet 8028. In the illustrated apparatus 8010, the rotary valve member 8044 takes the form of an inlet selector sleeve. The rotary valve member 8044 and the valve inlet 8028 are configured for relative rotation to each other such that rotation causes the rotary valve member 8044 to selectively block or obturate the valve inlet 8028. That is, during one phase of relative rotation, the valve inlet 8028 defines an open configuration in which pressure communication with the piston chamber 8020*a* is permitted and in another phase the valve inlet 8028 defines the closed configuration in which pressure communication with the piston chamber 8020*a* is prevented, substantially prevented or obturated.

The rotary valve member 8044 is supported within the apparatus 8010 by bearings 8248.

FIGS. 39 to 42 show the apparatus 8010 in a first phase of rotation corresponding to the pressure configuration in which the apparatus 8010 permits fluid communication between axial throughbore 8038 and piston chamber 8020*a* via valve inlet 8028 but prevents or restricts fluid communication between axial throughbore 8038 and the valve exhaust 8030.

Figure 39:
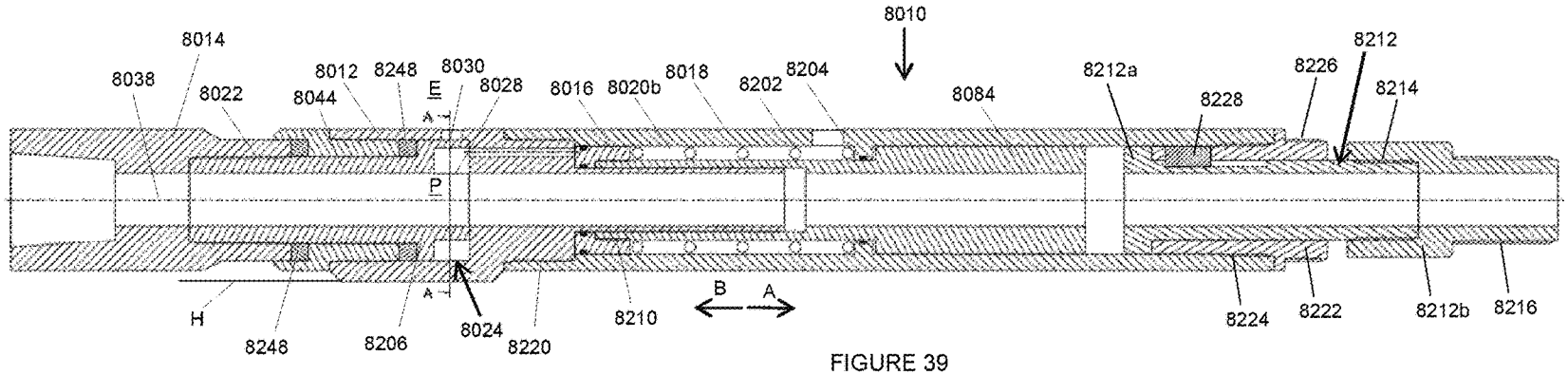
FIG. 39 shows a longitudinal sectional view of an alternative reciprocating drive apparatus, in a first phase of rotation and with the output shaft in an extended position.
Figure 41:
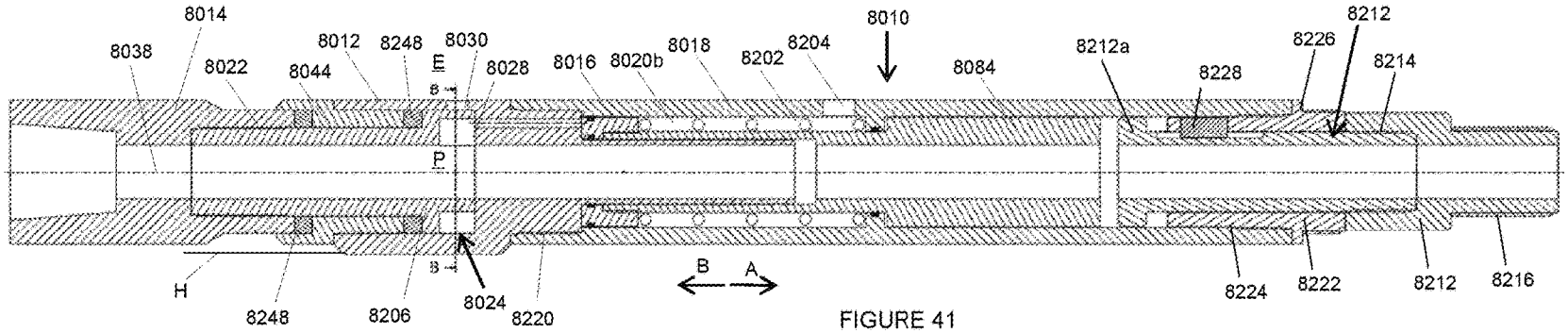
FIG. 41 shows another longitudinal sectional view of the apparatus shown in FIG. 39 and with the output shaft in a retracted position.
Figure 42:
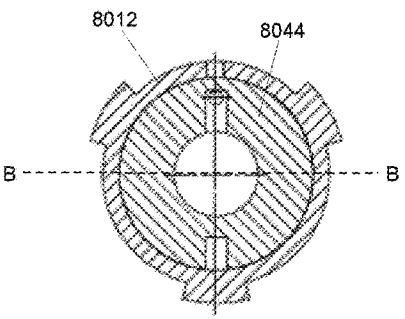
FIG. 42 shows cross-sectional view B-B of the apparatus shown in FIG. 41.
Figure 40:
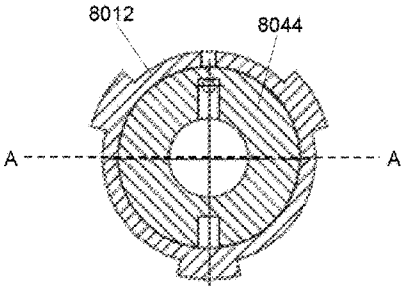
FIG. 40 shows cross-sectional view A-A of the apparatus shown in FIG. 39.
Figure 43:
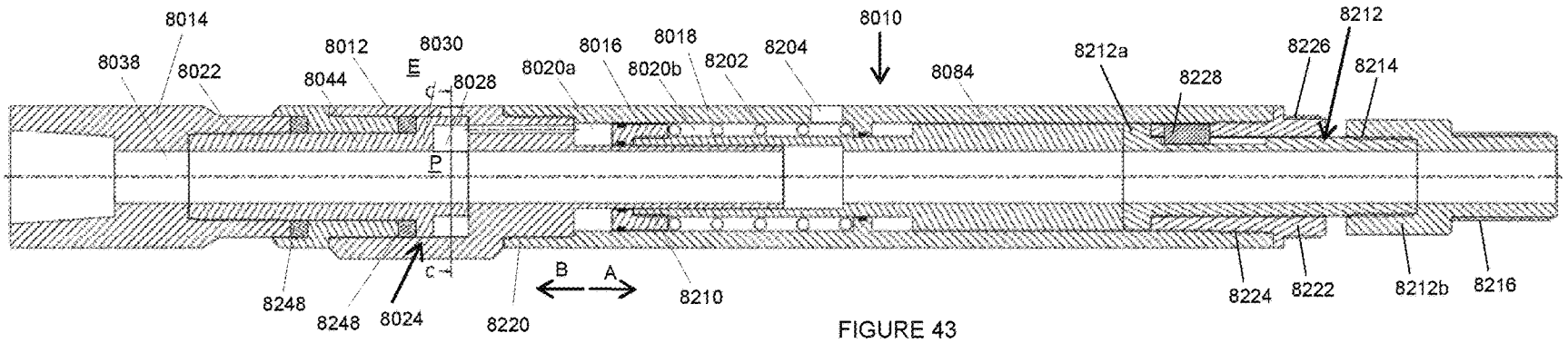
FIG. 43 shows a longitudinal sectional view of the apparatus shown in FIG. 39, in a second phase of rotation.

In FIG. 39, the output shaft 8212 is shown in an extended position. In FIG. 41, the output shaft 8212 is shown in a retracted position, for example after weight has been applied.

As shown, when the apparatus 8010 defines the pressure configuration fluid pressure acting on the piston 8016 urges the piston 8016 axially relative to piston housing 8018 against the bias of spring arrangement 8202. Fluid in piston chamber 8020*b* is displaced through exhaust ports 8204, thereby preventing a hydraulic lock.

It can be seen that the piston 8016 is coupled to a hammer 8084 by a coupling arrangement 8210, which in the illustrated apparatus 8010 takes the form of a thread connection. As such, axial movement of the piston 8016 also moves the hammer 8084 axially.

In use, axial movement of the hammer 8084 by the piston 8016 engages a distal end portion of the hammer 8084 with an output shaft, generally denoted 8212, generating an impact force.

In the illustrated apparatus 8010, the output shaft 8212 comprises a first component 8212*a* forming an anvil, chisel or receiver for receiving the impact force from the hammer 8084 and a second component 6212*b* forming an end effector of the apparatus 8010. However, it will be understood that the output shaft 8212 may alternatively comprise or take the form of a unitary member. As shown, a distal end portion of the first component 8212*a* is coupled to the second component 8212*b* by a coupling arrangement 8214, which in the illustrated apparatus 8010 takes the form of a thread connection. The output shaft 8212 (in particular the second component 8212*b*) has a coupling arrangement 8216, which in the illustrated apparatus 8010 takes the form of a thread connection formed on an outer surface of the output shaft 8212. The coupling arrangement 8216 may be utilised to transmit the applied axial force output from the apparatus 8010 to a connected component, assembly or tool.

As shown in FIGS. 39 and 41, a proximal end portion of the piston housing 8018 is coupled to the housing 8012 by a coupling arrangement 8220, which in the illustrated apparatus 8010 takes the form of a thread connection. A distal end portion of the piston housing 8018 is coupled to a bottom sub 8222 of the apparatus 8010 by a coupling arrangement 8224, which in the illustrated apparatus 8010 takes the form of a thread connection. The bottom sub 8222 comprises a further coupling arrangement 8226, which in the illustrated apparatus 8010 takes the form of a thread connection formed on an outer surface of the bottom sub 8222.

As shown in FIGS. 39 and 41, a key 8228 is provided and functions to rotationally lock the output shaft 8212 to the piston housing 8018. While in the illustrated apparatus 8010 a key 8228 is provided, it will be understood that in other forms of the apparatus the key 8228 may be omitted.

As described above, the apparatus 8010 may be utilised to generate an applied axial force output for transmission to a connected component, assembly or tool.

Figure 45:
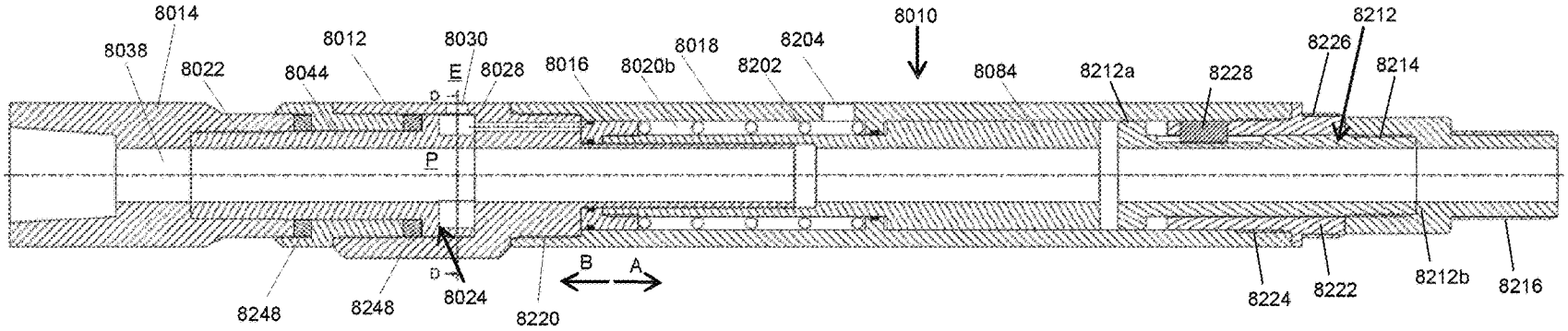
FIG. 45 shows a longitudinal sectional view of the apparatus shown in FIG. 39, in a third phase of rotation.
Figure 46:
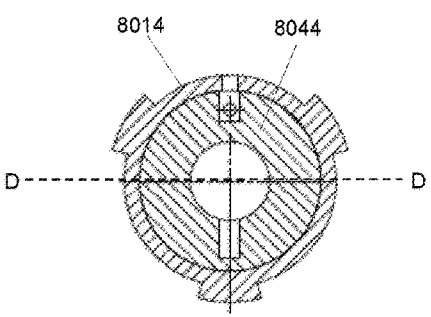
FIG. 46 shows cross-sectional view D-D of the apparatus shown in FIG. 45.
Figure 44:
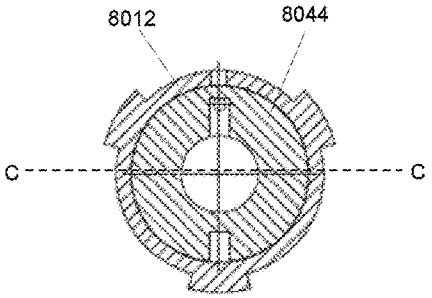
FIG. 44 shows cross-sectional view C-C of the apparatus shown in FIG. 43.

FIGS. 45 and 46 show the apparatus 8010 in a second phase of rotation corresponding to the exhaust configuration in which the apparatus 8010 prevents fluid communication between axial throughbore 8038 and piston chamber 8020*a* via valve inlet 8028 but permits fluid communication between axial throughbore 8038 and the valve exhaust 8030.

As shown, when the apparatus 8010 defines the exhaust configuration the spring arrangement 8202 urges the piston 8016 axially relative to piston housing 8018 in the direction B (to the left as shown in FIG. 45).

As described above, various modifications may be made without departing from the scope of the claims.

For example, referring now to FIGS. 47 to 50 of the accompanying drawings there is shown an alternative reciprocating drive apparatus 9010 in the form of an axial reciprocator apparatus.

In use, the apparatus 9010 is configured to generate an applied axial force output for transmission to a connected component or assembly of the apparatus 9010 or other connected tool.

As shown, the apparatus 9010 comprises a housing 9012 and a mandrel 9014, the mandrel 9014 and the housing 9012 configurable to be rotated relative to each other. It will be understood that reference to relative rotation between the housing 9012 and the mandrel 9014 may include the apparatus 9010 being configured such that: the mandrel 9014 rotates while the housing 9012 is stationary; such that the housing 9012 rotates while the mandrel 9014 is stationary; or such that the mandrel 9014 and the housing 9012 both rotate.

The apparatus 9010 further comprises a reciprocating piston 9016 mounted within piston housing 9018 so as to define a first piston chamber 9020*a* (shown most clearly in FIG. 49) and a second piston chamber 9020*b*. The piston 9016 is moveable within the first and second piston chambers 9020*a*,9020*b* in reverse first and second axial directions A, B.

The apparatus 9010 further comprises a rotary valve assembly 9024 comprises a valve inlet 9028 for communicating with a pressure region P and a valve exhaust 9030 for communicating with an exhaust region E.

The rotary valve assembly 9024 comprises a rotary valve member 9044 operatively associated with the valve inlet 9028. In the illustrated apparatus 9010, the rotary valve member 9044 takes the form of an inlet selector sleeve. The rotary valve member 9044 and the valve inlet 9028 are configured for relative rotation to each other such that rotation causes the rotary valve member 9044 to selectively block or obturate the valve inlet 9028. That is, during one phase of relative rotation, the valve inlet 9028 defines an open configuration in which pressure communication with the piston chamber 9020*a* is permitted and in another phase the valve inlet 9028 defines the closed configuration in which pressure communication with the piston chamber 9020*a* is prevented, substantially prevented or obturated.

In the illustrated apparatus 9010, the rotary valve member 9044 is fixed to the housing 9012 via thread connection 9206, such that relative rotation between the mandrel 9014 and the housing 9012 reconfigures the valve assembly 9024 as described further below.

In the illustrated apparatus 9010, the housing 9012 comprises or takes the form of a sleeve that acts as a non-rotating element (or as a relatively lower rotational speed element compared to the mandrel 9014).

In use, the mandrel 9014—which by virtue of threaded box connection 9208 is coupled to and rotates with a rotating string (not shown) of which the apparatus 9010 forms a part—rotates while the housing 9012—which by virtue of its engagement with borehole H—does not rotate or rotates at a lower rotational speed than the mandrel 9014. As the rotary valve member 9044 is fixed to the housing 9012 via thread connection 6906, relative rotation is also provided between the mandrel 9014 and the rotary valve member 9044.

The valve assembly 9024 is operated by relative rotation between the mandrel 9014 and the housing 9012 and the rotary valve member 9044 to be cyclically reconfigured between: a pressure configuration in which the piston chamber 9020*a* is in pressure communication with the valve inlet 9028 and isolated from the valve exhaust 9030 to permit the piston 9016 to move in the first axial direction A in accordance with the piston chamber 9020*a* being pressurised via the valve inlet 9028; and an exhaust configuration in which the piston chamber 9020*a* is isolated from the valve inlet 9028 and in pressure communication with the valve exhaust 9030 to permit the piston chamber 9020*a* to be depressurised and the piston 9016 to move in the second axial direction B.

Figure 47:
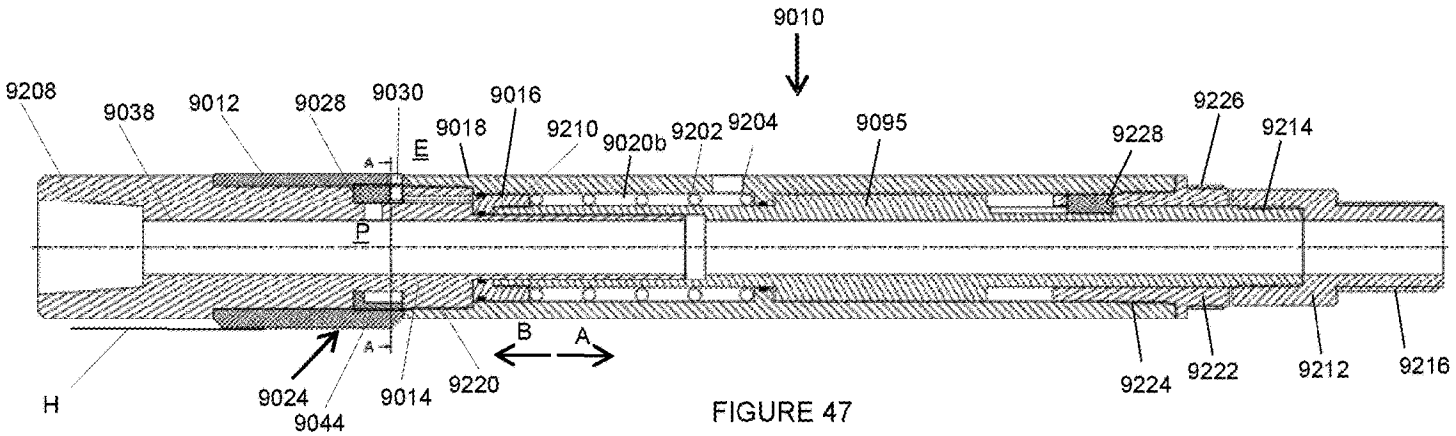
FIG. 47 shows a longitudinal sectional view of an alternative reciprocating drive apparatus, in a first phase of rotation.
Figure 48:
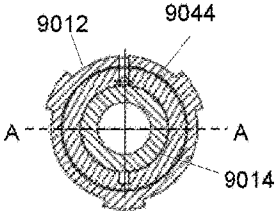
FIG. 48 shows cross-sectional view A-A of the apparatus shown in FIG. 47.

FIGS. 47 and 48 show the apparatus 9010 in a first phase of rotation corresponding to the exhaust configuration in which the apparatus 9010 prevents or restricts fluid communication between axial throughbore 9038 of the apparatus 9010 and piston chamber 9020*a* via valve inlet 9028 but permits fluid communication between piston chamber 9020*a* and the valve exhaust 9030.

Figure 49:
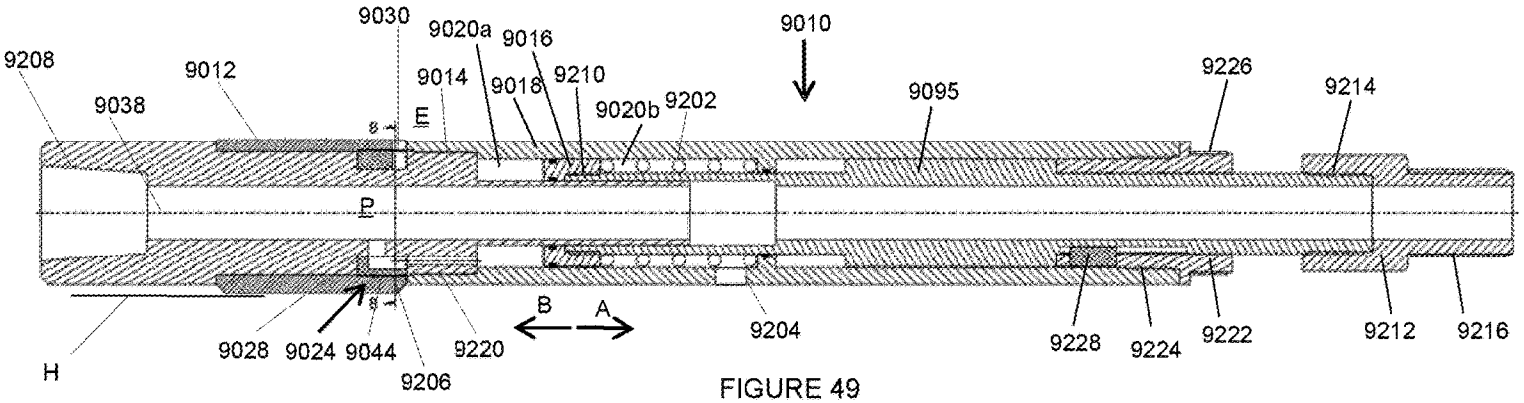
FIG. 49 shows a longitudinal sectional view of the apparatus shown in FIG. 47, in a second phase of rotation.
Figure 50:
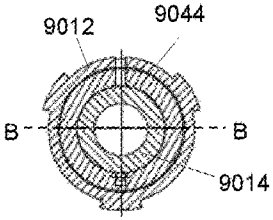
FIG. 50 shows cross-sectional view B-B of the apparatus shown in FIG. 49.

FIGS. 49 and 50 show the apparatus 9010 in a second phase of rotation corresponding to the pressure configuration in which the apparatus 010 permits fluid communication between axial throughbore 9038 and piston chamber 9020*a* via valve inlet 9028 but prevents or restricts fluid communication between axial throughbore 9038 and the valve exhaust 9030.

When the apparatus 9010 defines the pressure configuration, fluid pressure acting on the piston 9016 urges the piston 9016 axially relative to piston housing 9018 against the bias of spring arrangement 9202. Fluid in piston chamber 9020*b* is displaced through exhaust ports 9204, thereby preventing a hydraulic lock.

It can be seen that the piston 9016 is coupled to a shaft 9095 by a coupling arrangement 9210, which in the illustrated apparatus 9010 takes the form of a thread connection. As such, axial movement of the piston 9016 also moves the shaft 9095 axially.

As shown in FIGS. 47 and 49, a distal end portion of the shaft 9095 is coupled to an output shaft 9212 of the apparatus 9010 by a coupling arrangement 9214, which in the illustrated apparatus 9010 takes the form of a thread connection. The output shaft 9212 has a coupling arrangement 9216, which in the illustrated apparatus 9010 takes the form of a thread connection formed on an outer surface of the output shaft 9212. The coupling arrangement 9216 may be utilised to transmit the applied axial force output from the apparatus 9010 to a connected component or assembly of the apparatus 9010 or other connected tool.

A proximal end portion of the piston housing 9018 is coupled to the mandrel 9014 by a coupling arrangement 9220, which in the illustrated apparatus 9010 takes the form of a thread connection. As such, rotational movement and/or applied torque from the mandrel 9014 is transmitted to the piston housing 9018. A distal end portion of the piston housing 9018 is coupled to a bottom sub 9222 of the apparatus 9010 by a coupling arrangement 9224, which in the illustrated apparatus 9010 takes the form of a thread connection. The bottom sub 9222 comprises a further coupling arrangement 9226, which in the illustrated apparatus 9010 takes the form of a thread connection formed on an outer surface of the bottom sub 9222. The coupling arrangement 9222 facilitates connection and transmission of rotational movement and/or applied torque to downhole components of the tool string, such as the housing of a connected tool, where required.

As shown in FIGS. 47 and 49, a key 9228 is provided and functions to transmit torque from the mandrel 9014 (via the piston housing 9018 and the shaft 9095) to the output shaft 9212.

As described above, the apparatus 9010 may be utilised to generate an applied axial force output for transmission to a connected component, assembly or tool.

FIGS. 51 to 54 of the accompanying drawings show an alternative reciprocating drive apparatus 10010 in the form of an axial reciprocator apparatus.

In use, the apparatus 10010 is configured to generate an applied axial force output for transmission to a connected component or assembly of the apparatus 10010 or other connected tool.

The apparatus 10010 is similar to the apparatus 8010 described above and like components are represented by like reference signs incremented by 10000.

As shown, the apparatus 10010 comprises a housing 10012 and a mandrel 10014, the mandrel 10014 and the housing 10012 configurable to be rotated relative to each other. It will be understood that reference to relative rotation between the housing 10012 and the mandrel 10014 may include the apparatus 10010 being configured such that: the mandrel 10014 rotates while the housing 10012 is stationary; such that the housing 10012 rotates while the mandrel 10014 is stationary; or such that the mandrel 10014 and the housing 10012 both rotate. Beneficially, this facilitates flexibility in that hammering operations may be carried out in a number of different operational scenarios.

The apparatus 10010 further comprises a reciprocating piston 10016 mounted within piston housing 10018 so as to define a first piston chamber 10020*a* (shown most clearly in FIG. 53) and a second piston chamber 10020*b*. The piston 10016 is moveable within the first and second piston chambers 10020*a*,10020*b* in reverse first and second axial directions A, B.

The apparatus 10010 further comprises a rotary valve assembly 10024 comprising a valve inlet 10028 for communicating with a pressure region P and a valve exhaust 10030 for communicating with an exhaust region E.

The rotary valve assembly 10024 comprises a rotary valve member 10044 operatively associated with the valve inlet 10028. In the illustrated apparatus 10010, the rotary valve member 10044 takes the form of an inlet selector sleeve. The rotary valve member 10044 and the valve inlet 10028 are configured for relative rotation to each other such that rotation causes the rotary valve member 10044 to selectively block or obturate the valve inlet 10028. That is, during one phase of relative rotation, the valve inlet 10028 defines an open configuration in which pressure communication with the piston chamber 10020*a* is permitted and in another phase the valve inlet 10028 defines the closed configuration in which pressure communication with the piston chamber 10020*a* is prevented, substantially prevented or obturated.

The rotary valve member 10044 is supported within the apparatus 10010 by bearings 10248.

Figure 51:
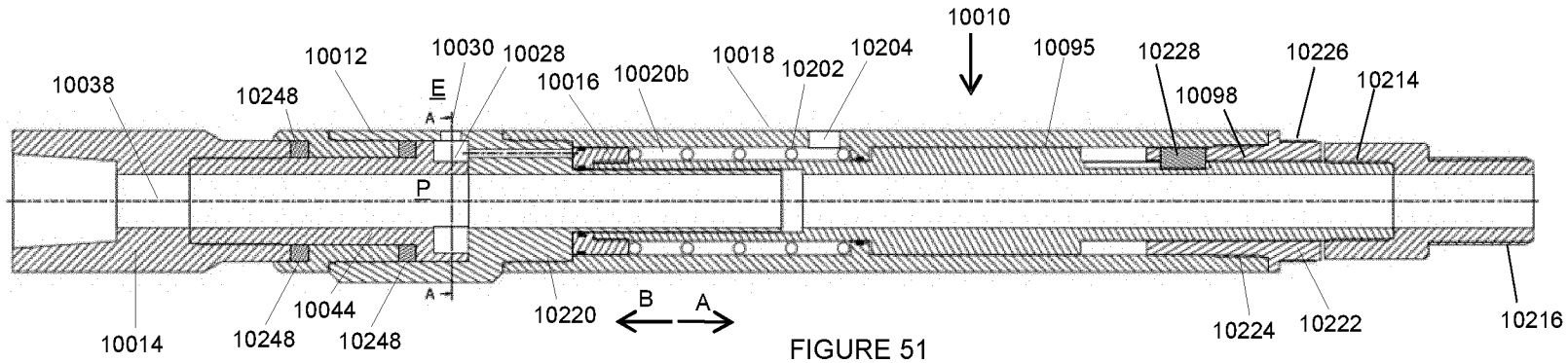
FIG. 51 shows a longitudinal sectional view of an alternative reciprocating drive apparatus, in a first phase of rotation.
Figure 52:
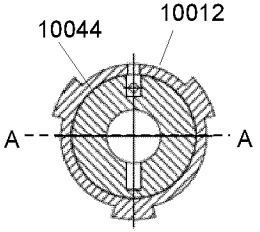
FIG. 52 shows cross-sectional view A-A of the apparatus shown in FIG. 51.

FIGS. 51 and 52 show the apparatus 10010 in a first phase of rotation corresponding to the exhaust configuration in which the apparatus 10010 prevents fluid communication between axial throughbore 10038 and piston chamber 10020*a* via valve inlet 10028 but permits fluid communication between axial throughbore 10038 and the valve exhaust 10030.

As shown, when the apparatus 10010 defines the exhaust configuration the spring arrangement 10202 urges the piston 10016 axially relative to piston housing 10018 in the direction B.

Figure 53:
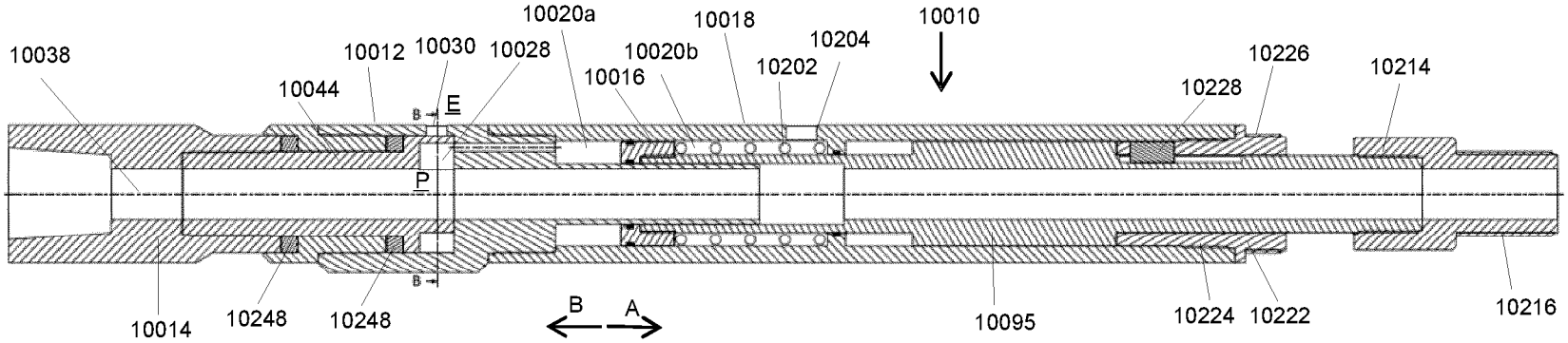
FIG. 53 shows a longitudinal sectional view of the apparatus shown in FIG. 51, in a second phase of rotation.
Figure 54:
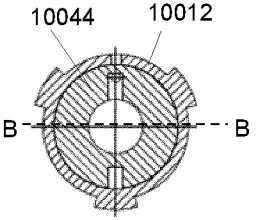
FIG. 54 shows cross-sectional view B-B of the apparatus shown in FIG. 51.

FIGS. 53 and 54 show the apparatus 10010 in a second phase of rotation corresponding to the pressure configuration in which the apparatus 10010 permits fluid communication between axial throughbore 10038 and piston chamber 10020*a* via valve inlet 10028 but prevents or restricts fluid communication between axial throughbore 10038 and the valve exhaust 10030.

As shown, when the apparatus 10010 defines the pressure configuration fluid pressure acting on the piston 10016 urges the piston 10016 axially relative to piston housing 10018 against the bias of spring arrangement 10202. Fluid in piston chamber 10020*b* is displaced through exhaust ports 10204, thereby preventing a hydraulic lock.

It can be seen that the piston 10016 is coupled to a shaft 10095 by a coupling arrangement 10210, which in the illustrated apparatus 10010 takes the form of a threaded connection. As such, axial movement of the piston 10016 also moves the shaft 10095 axially.

As shown, a distal end portion of the shaft 10095 is coupled to an output shaft 10212 of the apparatus 10010 by a coupling arrangement 10214, which in the illustrated apparatus 10010 takes the form of a thread connection. The output shaft 10212 has a coupling arrangement 10216, which in the illustrated apparatus 10010 takes the form of a thread connection formed on an outer surface of the output shaft 10212. The coupling arrangement 10216 may be utilised to transmit the applied axial force output from the apparatus 10010 to a connected component or assembly of the apparatus 10010 or other connected tool.

As shown, a proximal end portion of the piston housing 10018 is coupled to the housing 10012 by a coupling arrangement 10220, which in the illustrated apparatus 10010 takes the form of a thread connection. A distal end portion of the piston housing 10018 is coupled to a bottom sub 10222 of the apparatus 10010 by a coupling arrangement 10224, which in the illustrated apparatus 10010 takes the form of a thread connection. The bottom sub 10222 comprises a further coupling arrangement 10226, which in the illustrated apparatus 10010 takes the form of a thread connection formed on an outer surface of the bottom sub 10222.

As shown in FIGS. 51 and 53, a key 10228 is provided and functions to rotationally lock the shaft 10095 and the output shaft 10212 to the piston housing 10018. While in the illustrated apparatus 10010 a key 10228 is provided, it will be understood that in other forms of the apparatus the key 10228 may be omitted.

As described above, the apparatus 10010 may be utilised to generate an applied axial force output for transmission to a connected component or assembly of the apparatus 10010 or other connected tool.

Figure 55:
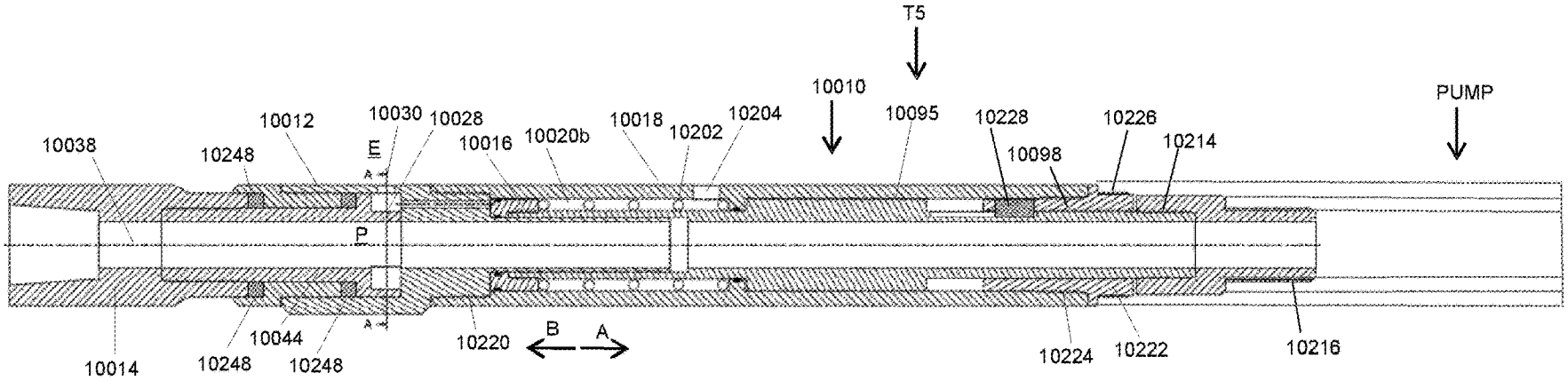
FIG. 55 shows a longitudinal sectional view of a pump tool comprising the apparatus shown in FIGS. 51 to 54.
Figure 56:
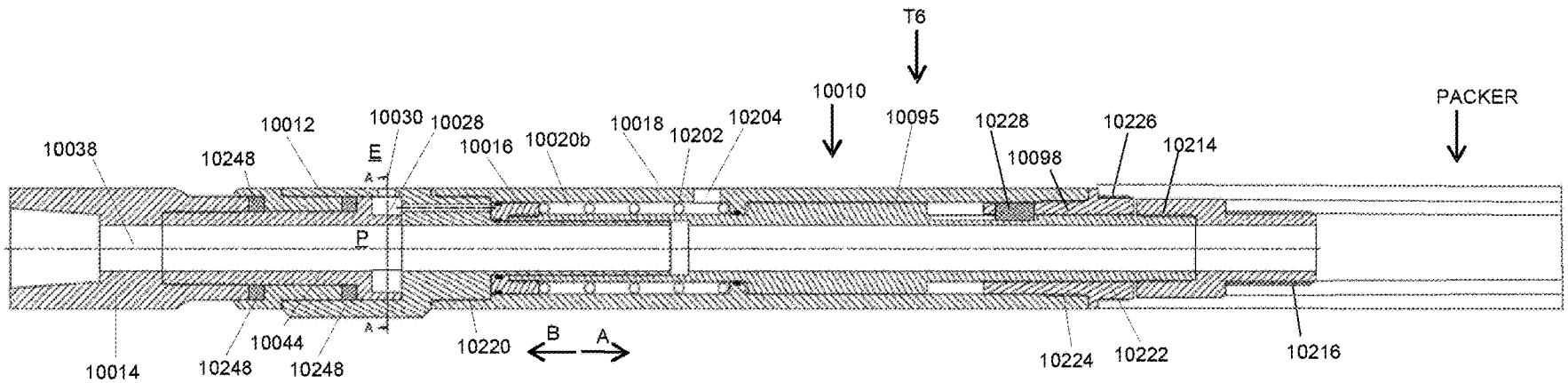
FIG. 56 shows a longitudinal sectional view of a packer tool comprising the apparatus shown in FIGS. 51 to 54.

FIGS. 55 and 56 of the accompanying drawings respectively show a pumping tool T5 and a packer tool T6 comprising a reciprocator apparatus according to the present disclosure. For illustrative purposes, the tools T5 and T6 employ the reciprocator apparatus 10010. However, it will be recognised that the tools T5 or T6 may alternatively employ the reciprocator apparatus 910.

Various modifications may be made without departing from the scope of the invention as defined in the appended claims.

For example, whereas the apparatus 6010, 8010, 9010, 10010 show a single acting spring return arrangement, the apparatus may alternatively comprise a double acting spring return arrangement.

In some instances, a plurality of piston may be arranged in series to present additive piston area to generate greater applied force.

It will be recognised that the above described apparatus may be utilised in a wide variety of tools, including for example but not exclusively a drilling tool, a fluid pump, a pressure multiplier, a mechanical jack, a radial impactor, a radial punch, an oscillating casing scrapers and/or brush tool, a casing/tubing cutter, a casing/tubing deformers, or other suitable tool.

It will be understood that references herein to the engagement with the borehole H includes, in open hole applications, engagement with the bore wall and, in cased hole applications, engagement with the inner wall of the bore-lining tubing such as casing.

The invention claimed is:

1. A reciprocating drive apparatus, comprising:

a housing and a mandrel configurable to be rotated relative to each other;

a reciprocating piston mounted within a piston housing to define a piston chamber, wherein the piston is moveable in reverse first and second axial directions; and a rotary valve assembly comprising a valve inlet for communicating with a pressure region and a valve exhaust for communicating with an exhaust region, the rotary valve assembly configured to be operated by relative rotation between the mandrel and the housing to be cyclically reconfigured between:

a pressure configuration in which the piston chamber is in pressure communication with the valve inlet and isolated from the valve exhaust to permit the piston to move in the first axial direction in accordance with the piston chamber being pressurised via the valve inlet; and an exhaust configuration in which the piston chamber is isolated from the valve inlet and in pressure communication with the valve exhaust to permit the piston chamber to be depressurised and the piston to move in the second axial direction, wherein the piston is configured to move in at least one of the first and second axial directions to generate an applied force within the apparatus and/or an applied force output from the apparatus, and wherein the rotary valve assembly is configured to operate based on continued or sustained relative rotation, in use, between the housing and the mandrel to cause the piston chamber to be pressurised and depressurised to permit reciprocating movement of the piston to gene re ted forces.

2. The apparatus of claim 1, comprising an axial throughbore.

3. The apparatus of claim 2, wherein the rotary valve assembly is configured to facilitate selective fluid communication between the valve inlet and the axial throughbore.

4. The apparatus of claim 2, wherein:

the apparatus is configurable in a first, open, configuration which permits access through the axial throughbore, and the apparatus is configurable in a second, obturated, configuration in which access through the apparatus is restricted or blocked, said second configuration providing an elevated fluid pressure or fluid pressure differential within the axial throughbore for use by the apparatus.

5. The apparatus of claim 4, wherein the apparatus comprises, is coupled to, or operatively associated with a valve arrangement configured to generate elevated pressure for use by the apparatus, wherein the valve arrangement comprises a valve member and an actuator configured to reconfigure the valve member from the open configuration to the obturated configuration in which fluid flow through the valve arrangement is prevented or restricted.

6. The apparatus of claim 5, wherein the valve arrangement is configured to provide selective fluid communication through the axial throughbore of the apparatus.

7. The apparatus of claim 5, wherein a valve member of the valve arrangement comprises an orifice, whereby the orifice is configured so that fluid through the orifice chokes flow and generates the elevated pressure for use by the apparatus, said elevated pressure taking the form of a back pressure.

8. The apparatus of claim 5, wherein the valve arrangement comprises, is coupled to, or operatively associated with an indexer mechanism.

9. The apparatus of claim 8, wherein the indexer mechanism comprises one or more dogs, the one or more dogs disposed on the mandrel such that relative axial movement of the mandrel and the housing de-supports the one or more dogs and permits axial movement of the actuator.

10. The apparatus of claim 1, wherein one of the housing and the mandrel defines the valve exhaust.

11. The apparatus of claim 1, wherein one of the mandrel and the housing defines the valve inlet.

12. The apparatus of claim 1, wherein the valve inlet and the valve exhaust are separate from each other.

13. The apparatus of claim 1, wherein the mandrel and the housing are configurable between:

a first configuration in which the mandrel and the housing are rotatably fixed such that the mandrel and the housing are configured to rotate together; and a second configuration in which the mandrel and the housing are released for relative rotation.

14. The apparatus of claim 1, wherein the mandrel and the housing are configured so as to define an axial flow passage therebetween, wherein the rotary valve assembly is configured to facilitate selective fluid communication between the axial flow passage defined between the mandrel and the housing and the piston chamber.

15. The apparatus of claim 1, wherein the rotary valve assembly forms a first rotary valve assembly of a rotary valve arrangement of the apparatus, and the rotary valve arrangement comprising a second rotary valve assembly.

16. The apparatus of claim 15, wherein the first rotary valve assembly and the second rotary valve assembly are disposed either side of and/or communicate with respective sides of the piston.

17. The apparatus of claim 15, wherein the first rotary valve assembly forms a first biasing arrangement of the apparatus and the second rotary valve assembly forms a second biasing arrangement of the apparatus.

18. The apparatus of claim 1, wherein the apparatus comprises a single rotary valve assembly in the form of said rotary valve assembly.

19. The apparatus of claim 18, wherein the rotary valve assembly forms a first biasing arrangement of the apparatus, and the apparatus comprises a second biasing arrangement.

20. The apparatus of claim 19, wherein the second biasing arrangement comprises a mechanical biasing arrangement.

21. The apparatus of claim 1, wherein the rotary valve assembly comprises at least one rotary valve member is rotatably fixed to one of the housing and the mandrel.

22. The apparatus of claim 1, wherein the apparatus comprises or takes the form of a jarring apparatus.

23. The apparatus of claim 1, wherein the apparatus comprises or takes the form of a hammer apparatus.

24. The apparatus of claim 1, wherein the apparatus comprises or takes the form of a reciprocator apparatus.

25. A tool comprising the apparatus of claim 1, wherein the tool comprises or defines at least one of a downhole tool, a hammer tool including at least one of an axial hammer tool and a radial hammer tool, a pump tool, or a packer tool.

26. A method for generating forces, the method comprising:

establishing continued or sustained relative rotation between a housing and a mandrel of a reciprocating device apparatus to operate a rotary valve assembly, the rotary valve assembly comprising a valve inlet for communicating with a pressure region and a valve exhaust for communicating with an exhaust region, such that the rotary valve assembly is cyclically reconfigured between:

a pressure configuration in which a piston chamber is in pressure communication with the valve inlet and isolated from the valve exhaust to permit a reciprocating piston to move in a first axial direction in accordance with the piston chamber being pressurised via the valve inlet; and an exhaust configuration in which the piston chamber is isolated from the valve inlet and in pressure communication with the valve exhaust to permit the piston chamber to be depressurised and the piston to move in a second axial direction, the second axial direction opposite the first axial direction, wherein movement of the piston in at least one of the first and second axial directions generates an applied force within the apparatus and/or an applied force output from the apparatus, and wherein the continued or sustained relative rotation between the housing and the mandrel operates the rotary valve assembly to cause the piston chamber to be cyclically pressurised and depressurised to permit reciprocating movement of the piston to generate repeated forces.

* * * * *